US010239735B2

(12) United States Patent
Stoof et al.

(10) Patent No.: US 10,239,735 B2
(45) Date of Patent: Mar. 26, 2019

(54) METHOD FOR ASSEMBLING A CRANE AND METHOD FOR OPERATING A CRANE

(71) Applicant: SUCOF B.V., Utrecht (NL)

(72) Inventors: Peter Paul Thomas Cornelia Stoof, Ulvenhoet (NL); Pieter Maria Stoof, Breda (NL)

(73) Assignee: Mammoet Engineering B.V., Schiedam (NL)

( * ) Notice: Subject to any disclaimer, the term of this patent is extended or adjusted under 35 U.S.C. 154(b) by 0 days.

(21) Appl. No.: 15/551,682

(22) PCT Filed: Feb. 18, 2016

(86) PCT No.: PCT/NL2016/050113
§ 371 (c)(1),
(2) Date: Aug. 17, 2017

(87) PCT Pub. No.: WO2016/133389
PCT Pub. Date: Aug. 25, 2016

(65) Prior Publication Data

US 2018/0065833 A1 Mar. 8, 2018

(30) Foreign Application Priority Data

Feb. 18, 2015 (NL) ..... 1041197
Sep. 23, 2015 (NL) ..... 1041484
(Continued)

(51) Int. Cl.
*B66C 23/70* (2006.01)
*B66C 23/74* (2006.01)
(Continued)

(52) U.S. Cl.
CPC ..... *B66C 23/70* (2013.01); *B66C 23/06* (2013.01); *B66C 23/74* (2013.01); *B66C 23/82* (2013.01)

(58) Field of Classification Search
CPC ..... B66C 23/00; B66C 23/06; B66C 23/08; B66C 23/18; B66C 23/20; B66C 23/62;
(Continued)

(56) References Cited

U.S. PATENT DOCUMENTS 4,243,148 A * 1/1981 Lampson ..... B66C 23/74 212/196
4,258,852 A * 3/1981 Juergens ..... B66C 23/74 212/178
(Continued)

FOREIGN PATENT DOCUMENTS

NL 1007079 C1 3/1999
NL 1031932 C1 12/2007
(Continued)

OTHER PUBLICATIONS

PCT search report in the parent application published as WO2016/133389A3.
(Continued)

*Primary Examiner* — Minh Truong
*Assistant Examiner* — Juan J Campos, Jr.
(74) *Attorney, Agent, or Firm* — Blank Rome LLP

(57) ABSTRACT

A method for assembling a crane that comprises erecting an upright ballast mast with a back mast top slide that is movable along the ballast mast and constructing a back mast using the upright ballast mast. This comprises the steps of providing a back mast upper section, multiple back mast intermediate sections, and a back mast lower section. The method also comprises connecting a part of the back mast including at least the back mast upper section, and possibly further including one or more pre-connected intermediate sections, to the back mast top slide. The part of the back mast that has been connected to the back mast top slide is stepwise extended by attaching further back mast interme-
(Continued)

diate sections and the back mast lower section. During the extension of the back mast the back mast top slide is stepwise raised along the upright ballast mast.

32 Claims, 33 Drawing Sheets

(30) Foreign Application Priority Data

Sep. 23, 2015 (NL) ..... 1041485
Oct. 26, 2015 (NL) ..... 1041546

(51) Int. Cl.
*B66C 23/82* (2006.01)
*B66C 23/06* (2006.01)

(58) Field of Classification Search
CPC ..... B66C 23/70; B66C 23/72; B66C 23/74; B66C 23/82
See application file for complete search history.

(56) References Cited

U.S. PATENT DOCUMENTS 4,537,317 A * 8/1985 Jensen ..... B66C 23/74 212/195
4,863,044 A * 9/1989 Trask ..... B66C 23/36 212/306
5,035,337 A * 7/1991 Juergens ..... B66C 23/36 212/195
2010/0264105 A1 10/2010 Settlemier

FOREIGN PATENT DOCUMENTS

NL 1040507 C 5/2015
WO 2014/178712 A1 11/2014

OTHER PUBLICATIONS

PCT Written Opinion in the parent application published as WO2016/133389.

* cited by examiner

METHOD FOR ASSEMBLING A CRANE AND METHOD FOR OPERATING A CRANE

CROSS REFERENCE TO RELATED APPLICATIONS

This application claims priority based on PCT/NL2016/050113, filed Feb. 18, 2016, which in turn claims priority based on NL 1041197 filed Feb. 18, 2015, NL 1041484 filed Sep. 23, 2015, NL1041485 filed Sep. 23, 2015 and NL 1041546 filed Oct. 26, 2015, each of which are incorporated herein by reference their entireties.

FIELD OF THE INVENTION

This invention pertains to the field of cranes, in particular large cranes of modular design wherein the crane is transported in disassembled condition to a site where a lift job is to be performed and then assembled.

BACKGROUND OF THE INVENTION

In the field large lattice boom cranes operate that are assembled on site in order to be used. Often the main boom and/or the back mast of the crane are assembled whilst lying on the ground. A quite common problem is that limited space is available at the site to build up the crane, e.g. when a new reactor vessel is to be installed at an existing petrochemical plant.

NL1040507 proposes to build up the crane on site from individual parts, which have a length that allows them to be transported by road and/or sea in regular ISO freight containers, e.g. having 20 or 40 ft. length. The individual parts are releasably connected to each other to form for example a ballast mast, a back mast and a main boom. These completed main components of the crane are then connected to each other, and then they are tilted upwards to complete the crane. In practice, even this known crane still requires quite some spaces one site, because the masts and main boom have to be assembled on the ground to their full length.

A further issue related to existing cranes is that they often have to operate on sites where existing buildings and/or equipment is present and needs to be avoided. So, there is often little room to arrange the crane and operate it in a safe and adequate manner.

The above issues are in particular of relevance for very large cranes, e.g. having a length of back mast and/or main boom of over 100 meters, so without counting any fly jib.

BRIEF SUMMARY OF THE INVENTION

In a first aspect, the invention aims to provide an improved method for assembling a crane, which crane comprises a main boom, a back mast and a ballast mast, said back mast having in an assembled state a foot end and a ballast mast end, said main boom having in an assembled state a foot end and a load end, wherein both the main boom and the back mast are at their foot ends pivotably connected to a mast foot assembly, and wherein the back mast is at its ballast mast end pivotably connected to the ballast mast, which method comprises the following steps:

- erecting an upright ballast mast with a back mast top slide that is movable along the ballast mast and which back mast top slide is preferably fixable in a plurality of positions relative to the ballast mast,

- constructing a back mast using the upright ballast mast, which comprises the following steps:
  - providing a back mast upper section, which has a length that is shorter than the final length of the back mast, and which back mast upper section has a ballast mast side end and a back mast side end,
  - providing multiple back mast intermediate sections, which each have a length that is shorter than the final length of the back mast, and each have a first end and a second end,
  - providing a back mast lower section, which has a length that is shorter than the final length of the back mast, and which back mast lower section has a foot side end and a back mast side end,
  - connecting a part of the back mast including at least the back mast upper section, and possibly further including one or more pre-connected intermediate sections, to the back mast top slide,
  - stepwise extending the part of the back mast that has been connected to the back mast top slide by attaching further back mast intermediate sections and the back mast lower section,
  - stepwise raising the back mast top slide along the upright ballast mast during the extension of the back mast.

The method according to the first aspect of the invention proposes to build up the back mast from separate sections that are one by one interconnected to the back mast top slide, either directly or through one or more sections that have been connected to the back mast top slide before. In this extension process of the back mast the slide is lifted or raised stepwise along the ballast mast. These separate sections can be a back mast upper section, back mast intermediate sections, and/or subsections thereof, and/or a back mast lower section.

Herewith, it is not necessary any more to assemble the entire back mast before connecting the ballast mast end of the back mast to the back mast top slide of the ballast mast. This reduces the amount of space that is necessary in the direct vicinity of the site where the crane is assembled compared to the common "on the ground assembly" of the back mast. Moreover, the assembly of the crane may be performed using only one or just a few relatively small auxiliary surface based cranes, e.g. mobile telescopic boom cranes that only take up little space at the assembly site. For example the invention allows for the practical assembly of a crane with a back mast of over 100 meters length, e.g. even with a back mast of over 200 meters length. In embodiments the length of the main boom is substantially the same as the length of the back mast.

As is preferred the back mast is assembled from individual parts, which have a length that allows them to be transported by road and/or sea in regular ISO freight containers, e.g. having 20 or 40 ft. container length.

In an embodiment the method in accordance with the first aspect of the invention comprises the following steps:

- assembling the upright ballast mast,
- arranging a back mast top slide on the ballast mast, which back mast top slide is movable along the ballast mast in the axial direction of the ballast mast and which back mast top slide is fixable in a plurality of positions relative to the ballast mast,
- constructing a back mast, which comprises the following steps:
  - providing a back mast upper section, which has a length that is shorter than the final length of the back mast, and which back mast upper section has a ballast mast side end and a back mast side end, with the back mast top slide arranged in a first fixed position on the ballast mast, pivotably connecting the back mast upper section to the back mast top slide, and suspending the back mast upper section from the back mast top slide, providing a back mast intermediate section, which has a length that is shorter than the final length of the back mast, and has a first end and a second end, connecting the first end of a back mast intermediate section to the back mast side end of the back mast upper section, making the back mast intermediate section come to extend in line with the axial direction of the back mast upper section, and fixing the back mast intermediate section to the back mast upper section, providing a back mast lower section, which has a length that is shorter than the final length of the back mast, and which back mast lower section has a foot side end and a back mast side end, connecting the back mast side end of the back mast lower section to the second end of the back mast intermediate section, and making the back mast lower section come to extend in line with the axial direction of the back mast intermediate section, and fixing the back mast intermediate section to the back mast lower section, providing a mast foot assembly, pivotably connecting the foot side end of the back mast lower section to the mast foot assembly, assembling a main boom, which is pivotably connected to the mast foot assembly, wherein the back mast top slide is moved upwards along the ballast mast to a second fixed position on the ballast mast after pivotably connecting the back mast upper section to the back mast top slide, but before fixing the back mast side end of the back mast lower section to the second end of the back mast intermediate section.

It is noted that with 'pivot', 'pivotable', 'pivotably' and similar wording the ability for rotational movement of an object with respect to another one around one or more axes is also meant. A pivot can thus for instance allow on object to rotate around a single axis, or allow for motion around two axes in case of a ball joint or gimbal.

It is noted that 'around' can be fully around or only over a limited angle.

Examples of cranes that can be assembled using the method according to the first aspect of the invention are heavy duty lattice boom cranes and/or super lift cranes and/or ringer cranes.

A crane that can be assembled using the method according to the first aspect of the invention, in its fully assembled state, further comprises, in a possible embodiment, a main load hoisting system comprising a hoisting member, e.g. a hook, which is moveable and suspended from the main boom via one or more hoisting lines, e.g. hoisting cables, strand jacks or chains. The main hoisting device for example further comprises hoisting winches, strand jacks, hoisting chains, and/or rigid hoisting plates with pens.

A crane that can be assembled using the method according to the first aspect of the invention, in its fully assembled state, further comprises, in a possible embodiment, one or more guy lines that extend between the top or upper section of the main boom and the top or upper section of the back mast. The guy line can comprise cables and/or chains, e.g. cables connecting to the main boom and then extended by chains that connect to the back mast. Lengthening and shortening of the one or more guy lines can be done with winches and/or strand jacks, and/or chain winches, e.g. linear. The chain may e.g. be made of plates and linking pens, similar to yet vastly larger than bicycle chain.

A crane that can be assembled using the method according to the first aspect of the invention, in its fully assembled state, further comprises, in a possible embodiment, a boom stop, which is adapted to avoid an undesired amount of pivoting of the main boom towards the back mast, e.g. during a lifting operation.

A crane that can be assembled using the method according to the first aspect of the invention, in its fully assembled state, further comprises, in a possible embodiment, a ballast onto which the ballast mast is arranged. Alternatively, the ballast mast may be connected to a ballast mast anchor for stability. If a ballast is used, this ballast can be a fixed ballast or a moveable ballast that is movable over the surface, e.g. on one or more (skid) rails, ground engaging wheels, crawler tracks, etc.

Optionally, the ballast comprises a ballast frame onto which ballast weights, e.g. ballast material, e.g. sand, filled containers, are arranged.

In accordance with the first aspect of the invention, first an upright ballast mast may be assembled. This ballast mast remains fixated in the upright position during the assembling of the crane, at least until the back mast has been completed and connected to a mast foot assembly. Preferably, the ballast mast is fixated in a vertical or substantially vertical position. After assembly of the back mast and with the connection of the back mast foot end to the mast foot assembly, the ballast mast may become pivotable around one or more horizontal axes and/or rotatable around a vertical axis, e.g. by means of a ball joint, e.g. by means of a gimbal.

The back mast top slide is arranged on the ballast mast, during or after assembling the ballast mast. The back mast top slide is moveable along the ballast mast in the axial direction of the ballast mast. It can be moved upwards and downwards along the ballast mast from one position to the other along the ballast mast. In one embodiment, the design of the ballast mast and the back mast top slide may be such that the back mast top slide can be fixed or secured relative to the ballast mast in any desired position. In an alternative embodiment, the design of the ballast mast and the back mast top slide may be such that the back mast top slide can be fixed relative to the ballast mast in a plurality of predefined positions.

The slide may include slide bearings that slide along the back mast but may also include rollers, endless tracks, or the like.

The ability to move the back mast top slide along the ballast mast and to fix to the ballast mast in a plurality of predefined positions allows the ballast mast to remain substantially vertical when the distance between ballast and mast foot assembly is varied during hoisting operations.

The back mast top slide may for example be moveable relative to ballast mast by means of a stepwise climbing mechanism, e.g. by a system comprising one or more hydraulic climbing cylinders, or for example by a winch powered cable system.

When the ballast mast has been erected in upright state the back mast is assembled.

The back mast may for example be single, elongate mast or it may have various shapes, for example have an A-shape, an inverted Y-shape or a shape with two parallel legs (e.g. an H-shape). An A-shape is preferred, as it provides for a most stable back mast. The back mast may be more than 100 meters or even more than 200 meters in length.

The assembly of the back mast comprises providing a back mast upper section. The back mast upper section has a length that is shorter than the final length of the back mast. It has a ballast mast side end and a back mast side end. The back mast upper section will form the upper part of the back mast of the assembled crane.

The back mast upper section is then connected to the back mast top slide. The back mast top slide is fixed in a first position along the ballast mast when the back mast upper section is connected to it. The back mast top slide is now preferably in a position which is high enough to allow the back mast upper section to become oriented at an incline from the back mast top slide, e.g. using an auxiliary surface based crane holding the lower end of the upper section, e.g. to keep the section clear from the ballast. Preferably in this position the lower end of the upper section is easily accessible to connect an intermediate section to said upper section.

Preferably, after connecting the back mast upper section to the back mast top slide, the back mast upper section is pivotable around at least two orthogonal pivot axis relative to the ballast mast.

The back mast upper section can be lifted to the back mast top slide for connection to the back mast top slide by means of an auxiliary crane that is arranged on, for example on top of, the ballast mast, or by a separate surface based crane that is arranged in the vicinity of the ballast mast. Alternatively, the auxiliary crane may assemble the ballast mast in its entirety.

The auxiliary crane may move along the side of the ballast mast oriented towards the mast foot assembly, but may also move along the opposite side of the ballast mast that faces away from the mast foot assembly.

In the invention multiple back mast intermediate sections are provided in practice. The back mast intermediate sections each have a length that is shorter than the final length of the back mast. The back mast intermediate section has a first end and a second end.

The first end of a back mast intermediate section is connected to the back mast side end of the back mast upper section. The back mast intermediate section is made to come to extend in line with the axial direction of the back mast upper section, and the back mast intermediate section is fixed to the back mast upper section. In the fixed position, the back mast intermediate section extends in line with the axial direction of the back mast upper section. This may be carried out in different ways.

In a possible embodiment the extension of the part of the back mast connected to the back mast top slide by means of a further intermediate section involves making a pivotal connection of said further intermediate section to said part and then raising the back mast top slide along the upright ballast mast so as to align the further intermediate section with said part and then fixing said intermediate section to said part.

In an embodiment the back mast lower section is pivotally connected to the part of the back mast connected to the back mast top slide and also to a foot assembly of the crane, where after the back mast top slide is raised along the upright ballast mast, so that the back mast lower section is aligned with said part, where after the back mast lower section is fixed to said part.

In an embodiment the back mast top slide is moved a step upwards along the upright ballast mast after pivotable connecting the back mast upper section to the back mast top slide, but before further extending the back mast by connecting a further back mast intermediate section to the back mast side end of the back mast upper section.

In an embodiment, during the stepwise raising of the back mast top slide, said slide is periodically fixed relative to the ballast mast in positions thereof along the ballast mast, e.g. the slide comprising a fastening pin and the ballast mast comprises holes at different heights to receive the fastening pin therein.

In a step in the method according to the first aspect of the invention, a back mast lower section is provided. The back mast lower section has a length that is shorter than the final length of the back mast. The back mast lower section has a foot side end and a back mast side end.

The back mast side end of the back mast lower section may be connected to the second end of the lowermost back mast intermediate section, and the back mast lower section is made to come to extend in line with the axial direction of the back mast intermediate section. Then, the back mast intermediate section is fixed to the back mast lower section. In the fixed position, the back mast lower section extends in line with the axial direction of the back mast intermediate section.

Making the back mast lower section to come to extend in line with the axial direction of the back mast intermediate section optionally involves moving the back mast top slide upwards along the ballast mast and fixing the back mast top slide at a higher position than the position it had on the ballast mast when the back mast lower section was connected to the back mast intermediate section.

In a preferred embodiment the back mast is completed to be as long as the main boom of the crane. This similarity in lengths of the main boom and back masts allows for enhanced lifting capacity as the guy wire or wires then extend more or less horizontal between the top ends of the back mast and the crane main boom.

In the method according to the first aspect of the invention, a mast foot assembly is provided and the foot side end of the back mast lower section is pivotably connected to the mast foot assembly. This may take place before or after the back mast lower section is connected to a lowermost back mast intermediate section.

The mast foot assembly may be a fixed mast foot assembly, which has a fixed position on the support surface onto which the crane is assembled, or a moveable mast foot assembly, which can travel over the support surface onto which the crane is assembled, either freely or along a track.

The mast foot assembly preferably comprises multiple mast feet, for example two mast feet.

The mast foot assembly may contain a rotation device, which is adapted to allow the main boom and the back mast to rotate around a vertical rotation axis. The mast foot assembly may comprise skid shoes, wherein one or more skid shoes may be rotatable around a vertical axis of rotation and/or around a horizontal axis of rotation relative to a mast foot assembly body which also forms part of the mast foot assembly. For example the foot assembly comprises a left-hand foot and a right-hand foot, with each foot comprising a left-hand set of skid members, e.g. two, engaging on a first skid rail, and a right-hand set of skid members, e.g. two, engaging on a second skid rail. For example with the back mast and/or main boom construed as an A-frame or H-frame, one foot is arranged at the lower ends of the back mast and main boom frame. For example each skid member is rotatable about a vertical axis relative to the main body of the foot. For example each skid member is vertically adjustable, e.g. hydraulically, relative to the main body of the foot.

In accordance with the method according to the first aspect of the invention, a main boom is assembled, which is pivotably connected to the mast foot assembly.

The main boom may for example be a single elongate mast, or it may for example have an A-shape, an inverted Y-shape or a shape with two parallel masts (e.g. an H-shape). The main boom may be 100 meters, possibly even 200 or more meters in length.

In accordance with the first aspect of the invention, the back mast top slide is moved upwards along the ballast mast to a second fixed position on the ballast mast after pivotably connecting the back mast upper section to the back mast top slide, but before fixing the back mast side end of the back mast lower section to the second end of the back mast intermediate section. This provides a suitable approach for assembling the back mast from separate sections, without needing a large free space at the site where the crane is assembled.

In a possible embodiment of the first aspect of the invention, the step of making the back mast intermediate section come to extend in line with the axial direction of the back mast upper section involves moving the back mast top slide upwards along the ballast mast.

In a possible embodiment of the first aspect of the invention, the step of making the back mast lower section come to extend in line with the axial direction of the back mast intermediate section involves moving the back mast top slide upwards along the ballast mast.

In a possible embodiment of the first aspect of the invention, the back mast top slide is moved upwards along the ballast mast after pivotably connecting the back mast upper section to the back mast top slide, but before connecting the first end of a back mast intermediate section to the back mast side end of the back mast upper section.

In a possible embodiment of the first aspect of the invention, the back mast top slide is moved upwards along the ballast mast after connecting the first end of a back mast intermediate section to the back mast side end of the back mast upper section but before connecting the back mast side end of the back mast lower section to the second end of the back mast intermediate section.

In a possible embodiment of the first aspect of the invention, the step of assembling main boom comprises the following steps:

- providing a main boom lower section, which has a length that is shorter than the final length of the main boom, and which main boom lower section has a foot side end and a main boom side end,
- pivotably connecting the foot side end of the main boom lower section to the mast foot assembly,
- pivoting the main boom lower section upwardly and fixing it temporarily to the back mast,
- providing a main boom intermediate section, which has a length that is shorter than the final length of the main boom, and which main boom intermediate section has a first end and a second end,
- connecting the first end of the main boom intermediate section to the main boom side end of the main boom lower section, making the main boom intermediate section come to extend in line with the axial direction of the main boom lower section and fixing the main boom intermediate section to the main boom lower section.

Optionally, a main boom upper section is arranged on the main boom intermediate section.

In this embodiment, main boom is built up from several sections which in themselves are shorter than the overall length of the main boom. This further helps to make it possible to assemble the crane in a small space.

In an embodiment, the main boom sections are provided by an auxiliary crane that is provided on the ballast mast, e.g. at the top thereof. In an alternative embodiment, the main sections are provided by a separate surface based auxiliary crane, e.g. a tower crane that is arranged in the vicinity of the mast foot assembly.

In a variant of this embodiment, a pivotal motion of the ballast mast around a pivot point at the bottom end of the ballast mast was enabled prior to the step of assembling of the main boom. If this pivotal motion was enabled, said ballast mast is fixed to the ballast, that is, the pivotal motion is disabled, before the provision of a main boom lower section.

In a variant of this embodiment, the main boom lower section is pivoted upwardly so that it comes to rest against the back mast lower section.

Optionally, after construction of the back mast, a mast section guide is provided along the back mast, and the main boom intermediate section is lifted to the top of the back mast, and then lowered onto the main boom lower section along the mast section guide.

In a further variant of this embodiment, at least one of the main boom lower section and the main boom intermediate section is arranged into position by an auxiliary crane which is arranged on the ballast mast. Alternatively, at least one of the main boom lower section and the main boom intermediate section is arranged into position by a separate crane which is arranged in the vicinity of the back mast, which separate crane is optionally arranged on the support surface on which the crane is assembled.

In a further variant of this embodiment, the main boom intermediate section is constructed by stacking multiple main boom subsections on top of each other.

In a possible embodiment of the first aspect of the invention, the method further comprises the following steps,

- providing a main boom upper section, which has a length that is shorter than the final length of the main boom, and which main boom upper section has a main boom side end,
- before connecting the back mast intermediate section to the back mast upper section, arranging the main boom upper section adjacent to the back mast upper section, and connecting the main boom upper section to the back mast upper section,
- after connecting the back mast intermediate section to the back mast upper section, preferably but before connecting the back mast intermediate section to the back mast lower section, connecting an intermediate main boom subsection to the main boom side end of the main boom upper section,
- after connecting the back mast lower section to the back mast intermediate section, connecting a main boom lower section to the main boom intermediate section,
- pivotably connecting the main boom lower section to the mast foot assembly.

In this embodiment, the main boom is assembled simultaneously with the assembly of the back mast. The main boom upper section is arranged adjacent to the back mast upper section, and connected thereto. The main boom upper section will therewith generally be retained from this connection. Optionally, the main boom upper section comes to rest against back mast upper section.

Then, a back mast intermediate section is connected—and preferably also aligned with and fixed- to the back mast upper section. Optionally, the back mast top slide is moved upwardly along the ballast mast after connecting the main boom upper section to the back mast upper section but before connecting the back mast intermediate section to the back mast upper section. Preferably, after this upward movement, the back mast top slide is fixed in position relative to the ballast mast.

After connecting the back mast intermediate section to the back mast upper section, a main boom intermediate section is connected to—and preferably also aligned with and fixed to—the main boom upper section. Optionally, the main boom intermediate section comes to rest against back mast intermediate section.

In a possible variant of this embodiment, the back mast intermediate section and the main boom intermediate section are assembled by stepwise addition of multiple back mast subsections and main boom subsections, respectively. Optionally, the back mast top slide is moved upwardly along the ballast mast after and/or before the addition of a subsequent subsection, e.g. before the addition of each subsequent back mast subsection and/or before the addition of each subsequent main boom subsection.

Then, after connecting the back mast lower section to the back mast intermediate section, a main boom lower section is connected to—and preferably also aligned with and fixed to—the main boom intermediate section. Optionally, the main boom lower section comes to rest against back mast lower section.

Then, the main boom lower section is connected to the mast foot assembly. Optionally, the main boom is then pivoted away from the back mast.

In a variant of this embodiment, the back mast top slide is moved upwards along the ballast mast after connecting the main boom upper section to the back mast upper section but before connecting the back mast side end of the back mast lower section to the second end of the back mast intermediate section.

In a possible embodiment of the first aspect of the invention, assembling an upright ballast mast comprises the following steps:

- providing a first ballast having a ballast mast support,
- providing a first ballast mast section, which first ballast mast section has a length which is shorter than the final length of the ballast mast to be constructed,
- arranging the first ballast mast section on top of the ballast mast support in an upright position,
- providing a second ballast mast section, which second ballast mast section has a section length which is shorter than the length of the ballast mast to be constructed,
- fixing the second ballast mast section on top of the first ballast mast section in an upright direction.

Optionally, one or more further ballast mast sections are provided, and the further ballast mast sections are stacked on top of the second ballast mast section until a desired length of the upright ballast mast has been obtained. The further ballast mast sections have a section length which is shorter than the length of the ballast mast to be constructed.

Optionally, at least one of the first ballast mast section, the second ballast mast section and the further ballast mast section are arranged into position by an auxiliary crane which is arranged on the ballast mast and/or by a separate crane which is arranged—e.g. on the ground or any other kind of support surface on which the crane is assembled—in the vicinity of the ballast mast. In general, the first ballast mast section will be arranged into place by a separate crane which is arranged in the vicinity of the location where the ballast mast is built up.

Optionally, at least one of a first ballast mast section, a second ballast mast section and a further ballast mast section is constructed from elongate elements that are releasably connected to each other, for example by pen-slot connections. Optionally, such elongate elements have a length such that they fit in the space of standard size road containers or standard size sea containers. Optionally, the assembly of at least one of a first ballast mast section, a second ballast mast section and a further ballast mast section takes place on the site where the crane is assembled.

Optionally, at least one of a first ballast mast section, a second ballast mast section and a further ballast mast section is constructed on the site where the crane is assembled in accordance with the first aspect of the invention.

Optionally, the ballast mast support which is provided comprises a ballast mast pivot, e.g. a ball joint, which is adapted to allow the ballast mast to pivot relative to the first ballast. Preferably, the ballast mast pivot allows the ballast mast to pivot around at least two pivot axis. In this embodiment, the first ballast mast section is locked in an upright position relative to the first ballast before the second ballast mast section is arranged on the first ballast mast section and until the assembling of the ballast mast is completed and the ballast mast has been connected to the mast foot assembly. Only thereafter can the locking of the first ballast mast section, and therefore the ballast mast, relative to the first ballast be released.

Optionally, the back mast top slide is rotatable around the ballast mast, e.g. while the ballast mast itself remains stationary, at least not-rotation around its axis. For example the ballast mast top slide comprises a vertical motion part that is movable up and down along the ballast mast and a rotational motion part that is rotatable around said vertical motion part, e.g. said parts being annular. The rotational connection between the parts may include a multi-axis joint, e.g. a ball joint.

During hoisting operations sections of the ballast mast may be removed or added to facilitate the hoisting task at hand.

In a possible embodiment of the first aspect of the invention, at least one of a back mast upper section, a back mast intermediate section, a back mast lower section, a main boom lower section, and a main boom intermediate section is constructed from elongate elements that are releasably connected to each other, for example by pin connections. E.g. each section having main corner elements and diagonal bracing elements between neighboring main corner elements.

Optionally, such elongate elements have a length such that they fit in standard size road containers or standard size sea containers, e.g. 20 ft. or 40 ft. ISO containers.

The elongated elements, e.g. at the corners of the section or subsection, can for example be tubes, e.g. tubes preferably with an octagonal cross section, or beams, for example as described in NL1040507.

The releasable connection of the elongate elements allows said back mast upper section, back mast intermediate section, back mast lower section, main boom lower section, and/or main boom intermediate section to have lateral or cross-sectional dimensions that largely exceeds current lateral dimensions, e.g. the inventive crane may have one or more of these main components with lateral dimensions of 8×8 meters instead of the currently standard 2.4×2.4 meters, as a section can be assembled on site and therefore does not have to be transported in the assembled state. Such a scaling of the width of said crane sections allows a substantial increase, e.g. a two or three fold increase, in lifting capacity of the crane.

Optionally, at least one of a back mast upper section, a back mast intermediate section, a back mast lower section, a main boom lower section, and a main boom intermediate section is constructed on the site where the crane is assembled in accordance with the first aspect of the invention.

In a possible embodiment of the first aspect of the invention, the back mast intermediate section is constructed from multiple back mast subsections. Each back mast subsection has a length that is shorter than the final length of the back mast intermediate section. Each back mast subsection has a primary connection end and a secondary connection end.

In this embodiment, the primary connection end of the back mast subsection that is arranged on one end of the back mast intermediate section forms the first end of the back mast intermediate section. The secondary connection end of the back mast subsection that is arranged on the opposite end of the back mast intermediate section forms the second end of the back mast intermediate section.

The back mast intermediate section optionally is constructed by stepwise adding a predetermined number of back mast subsections.

Optionally, a back mast subsection is constructed from elongated elements that are releasably connected to each other, for example by pen-slot connections. Optionally, such elongate elements have a length such that they fit in standard size road containers or standard size sea containers. The elongate elements can for example be tubes, e.g. tubes with an octagonal cross section, or beams, for example as described in NL1040507.

Optionally, a back mast subsection is constructed on the site where the crane is assembled in accordance with the first aspect of the invention.

In a variant of this embodiment, the back mast intermediate section is constructed by the following steps:

a) providing a plurality of back mast subsections, b) connecting the primary connection end of a first back mast subsection to the back mast side end of the back mast upper section, thereby making the primary connection end of the first back mast subsection the first end of the back mast intermediate section, c) moving the back mast top slide upwards along the ballast mast, and making the first back mast subsection come to extend in line with the axial direction of the back mast upper section with the secondary connection end of the first back mast subsection facing downwards, and fixing the first back mast subsection to the back mast upper section, d) connecting the primary connection end of a further back mast subsection to the secondary connection end of the first back mast subsection, e) moving the back mast top slide upwards along the ballast mast, and making the further back mast subsection come to extend in line with the axial direction of the first back mast subsection with the secondary connection end of the further back mast subsection facing downwards, and fixing the further back mast subsection to the first back mast subsection, f) connecting the primary connection end of a subsequent further back mast subsection to the secondary connection end of the previous further back mast subsection, g) moving the back mast top slide upwards along the ballast mast, and making said subsequent further back mast subsection come to extend in line with the axial direction of said previous further back mast subsection with the secondary connection end of the subsequent further back mast subsection facing downwards, and fixing said subsequent further back mast subsection to said previous first back mast subsection, h) repeating steps f) and g) until a desired length of the back mast intermediate section is obtained, thereby making the secondary connection end of the last back mast subsection that is applied the second end of the back mast intermediate section.

In a possible embodiment, the method according to the first aspect of the invention comprises the following steps:

assembling an upright ballast mast, arranging a back mast top slide on the ballast mast, which back mast top slide is movable along the ballast mast in the axial direction of the ballast mast and which back mast top slide is fixable in a plurality of positions relative to the ballast mast, constructing a back mast, which comprises the following steps:

providing a back mast upper section, which has a length that is shorter than the final length of the back mast, and which back mast upper section has a ballast mast side end and a back mast side end, pivotably connecting the back mast upper section to the back mast top slide, providing a plurality of back mast subsections, connecting the primary connection end of a first back mast subsection to the mast side end of the back mast upper section, thereby making the primary connection end of the first end of the back mast intermediate section, moving the back mast top slide upwards along the ballast mast, and making the first back mast subsection come to extend in line with the axial direction of the back mast upper section with the secondary connection end of the first back mast subsection facing downwards, and fixing the first back mast subsection to the back mast upper section, connecting the primary connection end of a further back mast subsection to the secondary connection end of the first back mast subsection, moving the back mast top slide upwards along the ballast mast, and making the further back mast subsection come to extend in line with the axial direction of the first back mast subsection with the secondary connection end of the further back mast subsection facing downwards, and fixing the further back mast subsection to the first back mast subsection, connecting the primary connection end of a subsequent further back mast subsection to the secondary connection end of the previous further back mast subsection, moving the back mast top slide upwards along the ballast mast, and making said subsequent further back mast subsection come to extend in line with the axial direction of said previous further back mast subsection with the secondary connection end of the subsequent further back mast subsection facing downwards, and fixing said subsequent further back mast subsection to said previous first back mast subsection, repeating steps h) and i) until a desired length of the back mast intermediate section is obtained, thereby making the secondary connection end of the last back mast subsection that is applied the second end of the back mast intermediate section, providing a back mast lower section, which has a length that is shorter than the final length of the back mast, and which back mast lower section has a foot side end and a back mast side end, connecting the back mast side end of the back mast lower section to the second end of the back mast intermediate section, and making the back mast lower section come to extend in line with the axial direction of the back mast intermediate section, and fixing the back mast intermediate section to the back mast lower section, providing a mast foot assembly, pivotably connecting the foot side end of the back mast lower section to the mast foot assembly, assembling a main boom, which is pivotably connected to the mast foot assembly.

In a possible embodiment of the first aspect of the invention, at least one of the first ballast mast section, the second ballast mast section and the further ballast mast section comprise a main elongate element and at least two, optionally three, auxiliary elongated elements, which are releasably connected to each other. The elongated elements can for example be tubes, e.g. tubes preferably with an octagonal cross section, or beams.

Optionally, all of the first ballast mast section, the second ballast mast section and optionally any further ballast mast sections that are present comprise a main elongate element and at least two, optionally three or more, auxiliary elongate elements, which are releasably connected to each other. Preferably, the main elongate elements of the first ballast mast section, the second ballast mast section and optionally any further ballast mast sections are connected to each other to form a single tensile element.

Optionally, the tensile element is adapted to bear the entire tensile load that is expected to be exerted on the ballast mast. In this variant, the auxiliary elongate elements of the first ballast mast section, the second ballast mast section and optionally any further ballast mast sections that are present are designed to bear the further ballast mast load that is to be expected including fall-back load, comprising bending loads, buckling loads, pushing load and torsion loads, that are expected to be exerted on the ballast mast. The fall-back load is the load which can be expected when the back mast falls back and is going to rest upon the ballast mast.

In a possible embodiment the ballast mast is embodied as a triangular tower mast comprising multiple triangular tower mast sections. Each triangular tower mast section comprises two main elongate element sections, a back mast top slide guide section and multiple connector elongate elements that interconnect the main elongate element sections and back mast top slide guide. Each main elongate element section and back mast top slide guide section are provided at a distance from each other so as to span a volume having a triangular base plane.

In use, preferably, the back mast top slide guide section will also bear at least a part of the load on the ballast mast, e.g. a tensile load, pressure load and/or a buckling load.

In a possible embodiment the ballast mast is embodied as a polygonal tower mast comprising multiple polygonal tower mast sections, e.g. squared tower mast sections. Each tower mast section comprises two or more main elongate element sections, a back mast top slide guide section and multiple connector elongate elements that interconnect the main elongate element sections and back mast top slide guide. Each main elongate element section and back mast top slide guide are provided at a distance from each other so as to span a volume having a polygonal, e.g. square, base plane.

In the above embodiments of the ballast mast as a tower mast the back mast top slide guide sections are connected end-to-end to form the back mast top slide guide. The back mast top slide guide guides the back mast top slide in its motion along the ballast mast.

In a possible embodiment of said polygonal tower mast said tower mast sections further comprise connector elements, e.g. pins, to releasably connect the connector elongate elements to the main elongate elements sections and back mast top slide guide section. The connector elements allow the assembly and disassembly of said tower mast section into its components, that is, into the main elongate element sections, back mast top slide guide, connector elongate elements and connector elements, e.g. for transport.

In a possible embodiment of said ballast mast the back mast top slide guide section is embodied as a bundle of parallel steel strips. Multiple climbing holes are provided through said bundle.

The back mast top slide may comprise a housing provided partially around the back mast top slide guide section, e.g. a C-shaped housing provided around the front side, the side planes and a part of the back side of the back mast top slide guide section. The housing may be provided with a first pin hole. Moreover, the back mast top slide may further comprise a fastening pin that can be moved between a withdrawn position and a fastening position, wherein in said fastening position the fastening pin extend through the first pin hole of the housing and through climbing hole of the strip bundle to fasten said back mast top slide to said back mast top slide guide, wherein said back mast top slide guide comprises multiple climbing holes.

The back mast top slide may further comprise a movable closure part. Said movable closure part is movably connected to the housing and comprises a second pin hole that can be aligned with the first pin hole of the housing and the climbing hole of the strip bundle. Said movable closure part is movable to a closed position. In said closed position the second pin hole is provided at the opposite side of the strip bundle compared to the first pin hole of the housing. In the fastening position of the fastening pin said pin extends through the first pin hole of the housing, the climbing hole of the strip bundle, and the second pin hole of the movable closure part. The movable closure part provides further support to the fastening pin in the fastening position thereof, so as to provide a fastening between the back mast top slide and ballast mast that can withstand a high load.

The back mast top slide may further comprise two trunnions. The back mast top end and guy lines are attached to said trunnions in such a manner that allows rotation of said back mast top end and guy line around said trunnion.

The back mast top slide may comprise a gimbal that forms a pivotal connection, e.g. a pivotal connection around a first horizontal axis, e.g. a pivotal connection provided by a trunnion, both between back mast top end and back mast top slide and between back mast top end and guy line. The gimbal moreover provides a pivotal connection, e.g. a pivotal connection around a second horizontal axis perpendicular to said first horizontal axis, e.g. a pivotal connection provided by the fastening pin, between the ballast mast and the back mast top slide.

In a possible embodiment one or more back mast subsections and/or one or more main boom subsection are assembled on the site where it is to be used prior to its inclusion in the crane. Preferably all components of a back mast subsection and/or a main boom subsection fit in a standard size road container or standard size sea container. Thus, the crane assembled as described in the following may be a containerized crane.

The first aspect of the invention also relates to a method for assembling a crane comprises erecting an upright ballast mast with a back mast top slide that is movable along the ballast mast and constructing a back mast using the upright ballast mast. This comprises the steps of providing a back mast upper section, multiple back mast intermediate sections, and a back mast lower section. The method also comprises connecting a part of the back mast including at least the back mast upper section, and possibly further including one or more pre-connected intermediate sections, to the back mast top slide. The part of the back mast that has been connected to the back mast top slide is stepwise extended by attaching further back mast intermediate sections and the back mast lower section. During the extension of the back mast the back mast top slide is stepwise raised along the upright ballast mast.

In a second aspect, the invention pertains to a method for assembling a crane, which crane comprises a main boom and a back mast, wherein the main boom and the back mast are each pivotably connected to a mast foot assembly of the crane, which method comprises the following steps:

- arranging a back mast at an incline relative to a surface on which the crane is assembled, said back mast being provided with a mast section guide that extends along and is held by the back mast, said mast section guide having an upper end and a lower end,
- providing a main boom lower section, which has a length that is shorter than the final length of the main boom, and which main boom lower section has a foot side end and a main boom side end,
- providing multiple main boom intermediate sections, which each have a length that is shorter than the final length of the main boom, and which main boom intermediate sections each have a first end and a second end,
- providing a main boom top section, has a length that is shorter than the final length of the main boom,
- wherein main boom sections are successively made to engage with said mast section guide at one of said upper end and lower end thereof, and are displaced there along towards the other end so as to stack said main boom sections end to end, said main boom sections being fixed to another so as to complete the main boom.

In an embodiment the lower main boom section is connected pivotable to a foot assembly of the crane, and wherein further main boom sections are engaged with the mast section guide via the upper end thereof, e.g. using an auxiliary crane mounted on a ballast mast that support the back mast at a top end thereof, e.g. a climbing crane used in assembly of said back mast, said further main boom sections being connected to the lower main boom section.

In an embodiment the main boom section are engaged with the mast section guide via the lower end thereof, e.g. using a surface based auxiliary crane, e.g. an actuator device being arranged near the lower end adapted and operated to push main boom sections upward along the mast section guide. In an embodiment, the main boom is extended beyond the top end of the back mast so as to complete a main boom longer than said back mast.

In an embodiment the completed main boom is released from the mast section guide or the mast section guide is released from the back mast whilst remaining connected to the main boom, and wherein the main boom is tilted away from the back mast into an operational main boom position, e.g. said tilting involving the use of one or more tilt actuators, e.g. comprising one or more hydraulic jacks mounted on the main boom or the back mast.

In an embodiment the method comprises the following steps:

- providing the back mast, and fixing the back mast relative to a surface onto which the crane is assembled,
- arranging a mast section guide along the back mast,
- providing a main boom lower section, which has a length that is shorter than the final length of the main boom, and which main boom lower section has a foot side end and a main boom side end,
- pivotably connecting the foot side end of the main boom lower section to the mast foot assembly,
- pivoting the main boom lower section upwardly,
- providing a main boom intermediate section, which has a length that is shorter than the final length of the main boom, and which main boom intermediate section has a first end and a second end,
- connecting the first end of the main boom intermediate section to the main boom side end of the main boom lower section, making the main boom intermediate section come to extend in line with the axial direction of the main boom lower section and fixing the main boom intermediate section to the main boom lower section,
- wherein the main boom intermediate section is lifted to the top of the back mast, and then lowered onto the main boom lower section along the mast section guide.

The second aspect of the invention allows to assemble the main boom of a crane in a small area, therewith reducing the size of the footprint required for assembling the crane.

The method according to the second aspect of the invention can be combined with the method according to the first aspect of the invention.

In a possible embodiment of the second aspect of the invention, the main boom lower section is pivoted upwardly so that it comes to rest against the back mast lower section.

In a possible embodiment of the second aspect of the invention, the back mast is fixed in a position under an acute angle relative to the surface onto which the crane is assembled.

In a possible embodiment of the second aspect of the invention, the main boom intermediate section is assembled by stepwise addition of multiple main boom subsections.

In a possible embodiment of the second aspect of the invention, the anchor is one of a fixed ballast, a moveable ballast or a ground anchor.

In a third aspect, the invention aims to provide an improved method for operating a crane.

A crane which can be used in the method according to the third aspect of the invention comprises:

- a first anchor connection, e.g. a first ballast mast, an anchor chain, an anchor cable or a set of anchor chains and/or anchor cables, or a combination of a an anchor chain or anchor cable in combination with a tube or beam,
- a primary anchor and a secondary anchor, which are located at a distance from each other, wherein before operating the crane, the first anchor connection is connected to the primary anchor,
- a back mast, which has a back mast lower section which is pivotably connected to a mast foot assembly and a back mast upper section which is pivotably connected to the first anchor connection, and wherein the anchor connection provides a connection between the primary anchor and the back mast upper section, a main boom, which has a main boom lower section which is pivotably connected to the mast foot assembly, and a main boom upper section, a main load hoisting system comprising a hoisting member, which is moveable and suspended from the main boom via one or more hoisting lines.

Optionally, the crane which is operated using the third aspect of the invention comprises a back mast top slide which is arranged on the first anchor connection, e.g. a first ballast mast, which back mast top slide is movable along the first anchor connection in the axial direction of the anchor connection and which back mast top slide is fixable in a plurality of positions relative to the first anchor connection.

Optionally, the crane which is operated using the third aspect of the invention comprises a first guy-line which extends between the back mast upper section and the main boom upper section.

Optionally, the crane which is operated using the third aspect of the invention comprises a back mast boom stop which is adapted to prevent undesired pivoting of the back mast, in particular in the direction away from the main boom. This is in particular advantageous when the first anchor connection is an anchor chain, an anchor cable or a set of anchor chains and/or anchor cables.

The crane which is used in the third aspect of the invention can be a crane that is assembled in accordance with the first aspect of the invention, but this is not necessary.

The method according to the third aspect of the invention comprises the following steps:

connecting the hoisting line to a main boom anchor, and fixing the main boom relative to the mast foot assembly such that pivoting of the main boom relative to the mast foot assembly towards and away from the back mast is prevented, disconnecting the back mast upper section from the primary anchor, moving the back mast upper section towards the secondary anchor, connecting the back mast upper section to the secondary anchor, e.g. through pulling or pushing means that also functions as a backmast-boomstop, disconnecting the hoisting line from the main boom anchor, releasing the fixing of the main boom relative to the mast foot assembly, thereby allowing pivoting of the main boom relative to the mast foot assembly again.

In accordance with the third aspect of the invention, the main boom is fixed relative to the mast foot assembly such that pivoting of the main boom relative to the mast foot assembly towards and away from the back mast is prevented.

This can for example be achieved by connecting the hoisting line (e.g. a hoisting cable or hoisting chain) to a main boom anchor, so fixing the length of the hoisting cable between the main boom anchor and the main boom upper section which prevents that the main boom pivots towards the back mast and by providing a temporary guy-line which is connected to the main boom in such a way that it prevents pivoting of the main boom relative to the mast foot assembly in a direction away from the back mast. Instead of the temporary guy-line, a rod or tube may be used.

The main boom anchor can for example be a ballast, for example made from stacked heavy objects such as metal weights or containers, for example sea containers filled with sand. Alternatively, the main boom anchor can be a heavy object, for example a heavy object or an object that is fixed to the ground, or an anchor e.g. in the form of a hook or ring that is fixed to the world, e.g. to a rock.

As a next step in the method according to the third aspect of the invention, the back mast upper section is disconnected from the primary anchor.

There are several ways in which this can be carried out. For example, the first anchor connection can be disconnected from the primary anchor, or the back mast top slide can be disconnected from the first anchor connection, or the back mast upper section can be disconnected from the back mast top slide, or the ballast mast can be disconnected halfway.

As a next step in the method according to the third aspect of the invention, the back mast upper section is moved towards the secondary anchor. It is not necessary that the back mast upper section is brought all the way to the secondary anchor, it is very well possible that at the end of the movement the back mast upper section is at a distance from the secondary anchor. For example, at the end of the movement, the back mast upper section is located at a distance above the secondary anchor, optionally at a distance straight above the secondary anchor.

In a preferred embodiment, the distance from the primary anchor to the mast foot assembly is shorter than the distance from the secondary anchor to the mast foot assembly, at least in this step of the method according to the third aspect of the invention.

As a next step in the method according to the third aspect of the invention, the back mast upper section is connected to the secondary anchor. This can be carried out in several ways, depending on how the back mast upper section was disconnected from the primary anchor. This will be discussed in more detail below.

As next steps in the method according to the third aspect of the invention, the hoisting cable is disconnected from the main boom anchor and the fixing of the main boom relative to the mast foot assembly is released, thereby allowing pivoting of the main boom relative to the mast foot assembly again.

The crane is now ready for moving a load.

The method according to the third aspect of the invention allows to use a long outreach of the crane in combination with a large lifting capacity. In the type of crane to which the claim pertains, a long outreach requires that the back mast is pivoted backwards to a relatively small angle with the support surface on which the crane is assembled, e.g. the ground, for example 30° to 45°.

In known cranes, this requires that the anchor (e.g. a ballast) is placed or moved relatively far away from the mast foot assembly to which the main boom and the back mast are pivotably connected. The entire space between the anchor and the mast foot assembly has to be available to the crane and free of obstructions. The crane therewith requires a lot of space to be operated and generally also to be assembled. This amount of space is often not available, as for example refineries, chemical and industrial plants and in town building sites are densely packed with building and large equipment.

The method of operating the crane in accordance to the third aspect of the invention allows to assemble the crane in a relatively small space, with the primary anchor located close to the mast foot assembly. Optionally, the method in accordance with the first aspect of the invention and/or the method according to the second aspect of the invention is used for assembling the crane, so that only a very limited free space suffices to assemble the crane.

The secondary anchor can be located at a location further away from the mast foot assembly, for example at a location on the other side of a building or large piece of equipment. Before lifting the load, the main boom is stabilized and fixed to the world, and then the back mast upper section is disconnected from the primary anchor, for example by disconnecting the anchor connection (e.g. a first ballast mast or an anchor cable) from the primary anchor, by disconnecting the back mast top slide from the anchor connection or by disconnecting the back mast top section from the back mast top slide. The back mast upper section, optionally with the anchor connection still attached to it, is than moved towards the secondary anchor and subsequently connected to the secondary anchor. The back mast top, optionally with the anchor connection still attached to it, can be moved over buildings or large pieces of equipment in order to reach a position near, for example above, optionally straight above, the secondary anchor.

The method in accordance with the third aspect of the invention allows to make better use of the lifting capacity of the crane when operated in densely built areas, which often results in the possibility to use a smaller crane, with a smaller maximum lifting capacity than in known methods.

In a possible embodiment of the method according to the third aspect of the invention, the disconnecting of the back mast upper section from the primary anchor is carried out by disconnecting the first anchor connection from the primary anchor. In this embodiment, connecting the back mast upper section to the secondary anchor is carried out by connecting the first anchor connection to the secondary anchor.

Optionally, the first anchor connection is longer or shorter when it is connected to the second anchor as compared to when it is connected to the first anchor.

Optionally, the length of the first anchor connection from the back mast upper section to the part which is to be attached to the anchor is changed after the disconnecting of the back mast upper section from the primary anchor but before connecting the back mast upper section to the secondary anchor.

In a possible embodiment of the method according to the third aspect of the invention, the first anchor connection is a first ballast mast, and the disconnecting of the back mast upper section from the primary anchor is carried out by disconnecting the first ballast mast from the primary anchor. In this embodiment, connecting the back mast upper section to the secondary anchor is carried out by connecting the first ballast mast to the secondary anchor.

Optionally, in this embodiment, after the first ballast mast has been disconnected from the primary anchor but before the first ballast mast is connected to the secondary anchor, the first ballast mast is moved upwardly relative to the back mast top slide and away from the primary anchor and then the first ballast mast is moved downwardly relative to the back mast top slide and towards from the secondary anchor. Alternatively, the first ballast mast is partly disassembled, to make it lower than it was before.

Optionally, in this embodiment, the first ballast mast is moved to the secondary anchor while maintaining the first ballast mast in a substantial vertical position.

In a possible embodiment of the method according to the third aspect of the invention, disconnecting the back mast upper section from the primary anchor is carried out by disconnecting the first anchor connection from the back mast upper section. In this embodiment, connecting the back mast upper section to the secondary anchor is carried out by connecting the back mast upper section to a second anchor connection which second anchor connection is connected to the secondary anchor. The second anchor connection is for example, a second ballast mast, a second anchor cable, a second anchor chain or a second set if anchor cables and/or anchor chains.

Optionally, in this embodiment, the first anchor connection is moved away from a line that extends between the mast foot assembly and the secondary anchor after disconnecting the back mast upper section from the primary anchor but before moving the back mast upper section towards the secondary anchor.

Optionally, in this embodiment, the first anchor connection is moved downwards by vertical translation or by pivoting around a horizontal pivot axis after disconnecting the back mast upper section from the primary anchor but before moving the back mast upper section towards the secondary anchor. This is in particular suitable when the first anchor connection is a first ballast mast.

Optionally, in this embodiment, the secondary anchor connection is of lighter or heavier construction than the first anchor connection.

Optionally, the secondary anchor connection is shorter or longer than the first anchor connection.

In a possible embodiment of the method according to the third aspect of the invention, the method further comprises the following steps:

- moving the main boom and the hoisting cable to a load to be repositioned, which load is in an initial position,
- connecting the hoisting cable to the load,
- repositioning of the load to a first load position, which first load position is preferably closer to the mast foot assembly than the initial position,
- fixing the main boom relative to the mast foot assembly such that pivoting of the main boom relative to the mast foot assembly towards and away from the back mast is prevented,
- disconnecting the back mast upper section from the secondary anchor,
- moving the back mast upper section towards the primary anchor, and
- connecting the back mast upper section to the primary anchor.

In this embodiment, the hoisting cable is connected to a load, and the load is then lifted and repositioned to a first load position, for example on the ground and close to the mast foot assembly. If the load in itself is heavy, or if it can be anchored securely to the world, the load can serve as a main boom anchor. By using the load as main boom anchor, the back mast upper section can be connected again to another anchor, for example the primary anchor.

Usually, the primary anchor is arranged relatively close to the mast foot assembly, or closer to the mast foot assembly than the secondary anchor. With the load and the anchor to which the back mast upper section is connected close to the mast foot assembly, the crane can rotate in a small space to arrange the load at a second load location.

Optionally, in a variant, this embodiment of the third aspect of the invention further comprises the following steps:

- releasing the fixing of the main boom relative to the mast foot assembly,
- rotating the crane around the mast foot assembly,
- arranging the load at a second load location.

Optionally, in a variant, this embodiment of the third aspect of the invention further comprises the following steps:

releasing the fixing of the main boom relative to the mast foot assembly, rotating the crane around the primary anchor, and arranging the load at a second load location.

Optionally, in a variant, this embodiment of the third aspect of the invention further comprises the following steps:

releasing the fixing of the main boom relative to the mast foot assembly, rotating the crane around the load, and arranging the load at a second load location.

In these variants of the embodiment, it is furthermore possible that the back mast upper section is connected to a further, e.g. a tertiary, anchor to move the load to a third load position. To that end, optionally the following steps may be performed:

fixing the main boom relative to the mast foot assembly such that pivoting of the main boom relative to the mast foot assembly towards and away from the back mast is prevented, disconnecting the back mast upper section from the primary anchor, moving the back mast upper section towards a tertiary anchor, releasing the fixing of the main boom relative to the mast foot assembly, thereby allowing pivoting of the main boom relative to the mast foot assembly again, rotating the crane around the tertiary anchor or around the mast foot assembly, and arranging the load at a third load position.

In a possible embodiment of the method according to the third aspect of the invention, a moveable anchor is provided, e.g. in the form of a moveable ballast. The moveable anchor is moveable between a primary anchor position and a secondary anchor position. In this embodiment, the moveable anchor is the primary anchor when it is in the primary anchor position and the moveable anchor is the secondary anchor when it is in the secondary anchor position.

In a possible embodiment the moveable anchor is moveable between said first and second anchor position after being disconnected from the rest of the crane, e.g. from the back mast. In an alternative embodiment the moveable anchor is moveable between said first and second anchor position while remaining connected to the rest of the crane. During the moving of the moveable anchor the back mast top slide will move up or down so as to maintain said ballast mast substantially vertical.

In a possible embodiment each back mast subsection or main boom subsection is of four sided design and comprises multiple, e.g. four, main elongate element sections, e.g. corner tubes, and multiple connector elongate elements, e.g. connector tubes. The connector elongate elements interconnect the main elongate element sections so as to form a polygonal, e.g. square, ground plane. One or more diagonal connector elongate elements may also be provided, for instance in combination with four main elongate element sections and a square ground plane. Said diagonal connector elongate elements interconnect two main elongate elements across a diagonal.

The main elongate element sections may be of the same cross sectional size, or may be of a different cross sectional size.

In a possible embodiment an assembly device is provided for assembly of said back mast subsections or main boom subsections. Said assembly device may comprise multiple, e.g. four, supports, e.g. elongated supports, to support the main elongate element sections. The upper surface of the inner supports may be higher than those of the outer ones. In between outermost and inner supports a sliding surface may be provided.

To assemble the back mast subsection or main boom subsection or ballast mast section, the main elongate element sections are provided on the supports, with connector elongate elements provided on the sliding surfaces between the outermost and inner supports, said connector elongate elements connected, e.g. pivotally connected, to the main elongate element sections. In case of a square ground plane, and therefore the provision of four supports, the inner main elongate element sections on the inner supports are also interconnected by a connector elongate element. Moreover, in case of a square ground plane a diagonal connector elongate element may be connected to one of the main elongate element sections provided on the inner supports. The system of main elongate element sections and connector elongate elements is lifted at or near the main elongate element section or sections provided on the inner supports. When elevated, the main elongate element sections provided on the outer supports move towards the main elongate element sections that were previously provided on the inner supports. Moreover, in said elevated state the diagonal connector elongate elements, if provided, may be connected across a diagonal to a main elongate element section. Subsequently a connector elongate element may be provided below said elevated system and said system may be lowered again to allow the connector elongate element to be connected to said system.

In a possible embodiment the crane is provided with a linear track, e.g. a linear skidding track, and/or curved track, e.g. a circular or oval skidding track. Said linear track may extend from the ballast mast and said circular track may extend around the ballast mast. Alternatively, said circular track may extend around the load to allow the crane to be rotated around a heavy load.

The crane as described in the foregoing may carry out various linear as well as rotational movements. As mentioned in the previous section, the crane may rotate around the ballast mast. Moreover, as mentioned in the description of the mast foot assembly, the crane may rotate around the mast foot assembly, more specifically around a vertical axis that extends through one of the mast feet. The crane may moreover rotate around a heavy load that is provided on a suitable support on the ground or a suitable structure. Moreover, the entire crane may be moved along a linear track. The above movements may be performed subsequently in order to hoist, transport and release a load. Moreover, the crane may be mounted upon a ring construction to allow rotational motion of said crane.

The present invention also relates to a ballast mast, e.g. for use in assembling a back mast and/or a crane, as described herein, e.g. a triangular cross-section ballast mast as described herein.

The present invention also relates to the combination of a ballast mast support assembly and a ballast mast that is erected on top of said ballast mast support assembly as described herein, e.g. for use in assembly of a back mast and/or a crane as described herein.

The present invention also relates to a crane having an upright ballast mast, said ballast mast being provided with a tensile connector that forms a tensile connection between a back mast connector member, e.g. a back mast top slide slidable along the ballast mast, on the one hand, and a ballast at a lower end of the ballast mast on the other hand, wherein the tensile connector is embodied as a strip bundle comprising multiple parallel and adjoining tensile strips, e.g. of steel, e.g. cut from steel plate, e.g. of strip bundle sections connected end-to-end.

In an embodiment the strip bundle is four sided with planar front and back sides that extend vertically along the ballast mast.

In an embodiment the strip bundle is provided at regular intervals along its length with holes or other engagement formations for engagement with a climbing device associated with a back mast top slide that is displaceable along the ballast mast by said climbing device.

The present invention also a crane having a ballast mast supporting a top end of a back mast, said ballast mast being assembled from latticed ballast mast elements, e.g. triangular cross-section elements, and a back mast top carrier being mounted on said ballast mast so as to be movable along the mast by a climbing device.

The present invention also relates to a back mast as disclosed herein provided with guide for assembly of a main boom by sliding sections of the main boom along said guide, e.g. from above or below as disclosed herein. The present invention also relates to a crane provided with such a back mast, and to a method of assembly of the main boom of a crane using such a back mast.

The present invention also relates to a ballast for use with a crane, said ballast comprising a floor, a column connected to and raised from said floor, and a circumferential wall that forms together with said floor a ballast container that is to be filled with ballast material, e.g. with sand. Preferably, e.g. with a circular or polygonal wall, the column is arranged centrally with the ballast container and, as preferred, a ballast mast is connectable to the top end of the column, e.g. as described herein.

The column is preferably stabilized by diagonal braces that extend to the floor.

The floor preferably is composed of a framework and floor panels placed over the framework.

As is preferred the ballast container has a volume that exceeds 1000 cubic meters, e.g. is able to retain more than 1500 tonnes of sand.

As is preferred the wall is assembled from wall panels, e.g. in a polygonal arrangement, wherein each wall panel fits within an ISO container, e.g. has a length of less than 12 meters and a width of at most 2.40×2.40 meters. Preferably the wall is circular or polygonal, a rectangular or square embodiment is also possible, yet less preferred in view of stability of the wall under the load of the filled ballast material In an embodiment tension rods or cables extend for example diametrically across the wall and/or to the central column to stabilize the wall against the load of the filled ballast material.

Filling may be done from above once the container is fully assembled, e.g. using a conveyor belt. In another embodiment the wall is heightened in pace with the filling of the container and/or some closable openings are present over the height of the wall to facilitate filling of the container.

In an embodiment doors or the like are provided in multiple of the wall panels, e.g. along the lower edge of the wall, e.g. so as to allow for discharge of ballast material when the crane is to be disassembled.

It will be appreciated that the ballast may be included in or used with a crane as described herein or in or with another crane, e.g. as a replacement of a stacked container type ballast as is now common, e.g. in combination with a so-called ringer crane.

This kind of ballast container can also be used as a test weight to test a crane.

The ballast container in accordance with the invention facilitates the transport of the ballast to the construction site compared to known ballasts. Known ballasts commonly comprise a large number of stacked road or sea containers that have to be transported to the construction site. Said road or sea containers may already be filled with ballast material prior to transport, which adds to the weight that has to be transported. Alternatively, said road or sea containers may be filled with ballast material at the construction site. The ballast container in accordance with the invention takes a smaller amount of space during transport in comparison with said large number of road or sea containers. Possibly the ballast container in accordance with the invention is also lighter than the known ballast, which further facilitates transport of the ballast to the construction site.

The present invention also relates to a method for assembly of a crane back mast or crane main boom section as described herein, e.g. with reference to FIG. 27. It will be appreciated that the back mast section or main boom section may be included in a crane as described herein or in another crane.

When using the method for assembly of a crane, a crane may be constructed of which the back mast is shorter, longer or of equal length to the main boom.

When using the method for assembly of a crane, a crane may be constructed of which the shape of the back mast and the main boom are either the same, e.g. both comprising A-frame, or different, e.g. comprising one A-frame and one H-frame.

BRIEF DESCRIPTION OF THE DRAWINGS

The various aspects of the invention will be described in more detail below with reference to the figures, in which in a non-limiting manner exemplary embodiments of the invention will be shown.

DETAILED DESCRIPTION OF THE INVENTION

Figure 1:
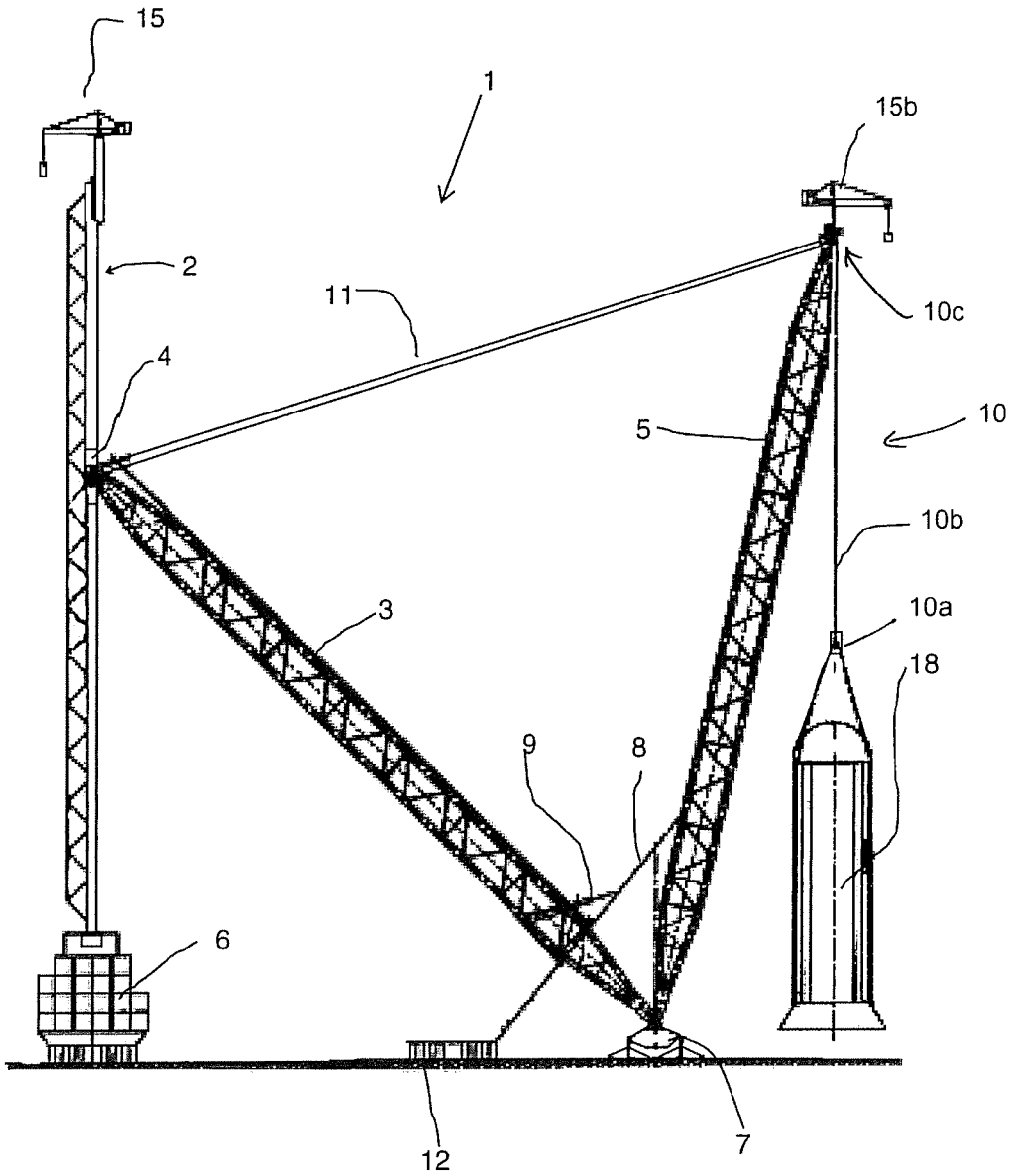
FIG. 1: schematically illustrates an example of a crane which can be assembled by the first and/or second aspect of the invention, and which can be used in accordance with the third aspect of the invention.

FIG. 1 schematically illustrates an example of a crane 1 which can be assembled by the first and/or second aspect of the invention, and which can be used in accordance with the third aspect of the invention.

The crane 1 as shown in FIG. 1 comprises an upright or generally vertically arranged ballast mast 2. The crane 1 further comprises a back mast 3 and a main boom 5.

The crane 1 has been assembled on a surface 12. The surface 12 is for example the ground, most common, or a floating vessel, e.g. a barge, a heavy lifting vessel.

The ballast mast 2 is connected to a primary anchor which in this example is a ballast 6.

For example the ballast 6 is composed of stacked ISO containers 6*a* filled with ballast material, e.g. sand and/or gravel, as is known in the art. An alternative embodiment of the ballast 6 will be discussed with reference to FIG. 31-FIG. 33.

The ballast mast 2 is mounted on a ballast mast support 16, which, as is preferred also supports and/or is integrated with the ballast 6.

Figure 2:
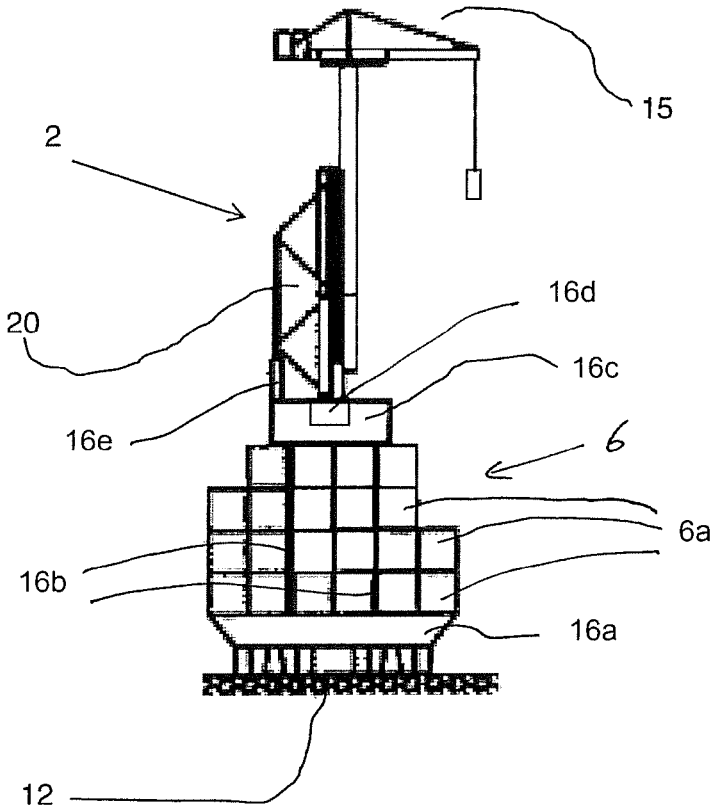
FIG. 2-FIG. 7: schematically illustrate subsequent stages in an exemplary embodiment of the method according to the first aspect of the invention.

As shown in FIG. 2 the ballast mast support 16 may comprise a ballast supporting floor 16*a* that rests on the surface 12, e.g. stationary and immobile or in a mobile manner, e.g. on a (skid) rail track, wheeled with surface engaging wheels, etc. The ballast, here in containers 6*a*, rests on said floor 16*a*. One or more, preferably at least three, columns 16*b* extend upward from the floor 16*a*, and are connected via a ballast mast connector assembly 16*c* to the lower end of the ballast mast 2.

As is preferred the ballast mast connector assembly 16*c* includes a bearing that allows for at least a rotation of the ballast mast 2 around its, generally vertical, axis. Preferably the ballast mast connector assembly 16*c* also allows for pivotal motion of the ballast mast 2 around one or more horizontal axes, e.g. allowing for gimballing of the ballast mast 2. For example the assembly 16*c* comprises a ball joint or a Cardan joint to allow for such gimballing motion of the ballast mast 2. This allows to avoid undue loads during operation of the crane on the ballast mast and/or the connection at the lower end thereof. The vertical rotation bearing and/or gimbal device are denoted with reference numeral 16*d*. The gimballing may be restricted to a limit angular range, e.g. a few degrees relative to vertical.

As is preferred the ballast mast connector assembly 16*c* also comprises a fixation device 16*e* that is embodied to temporarily fixate the lower end of the ballast mast 2, e.g. so that its rotation around the vertical axis thereof and/or any gimballing motion is selectively blocked.

During construction of the back mast 2 and/or or main boom 5 and/or during hoisting operations performed after the crane 1 has been assembled, the ballast mast 2 may be rotated, or allowed to rotate, around a vertical axis, and/or optionally be moved into an inclined position.

Preferably during construction of the ballast mast 2, the ballast mast 2 is retained in a fixed orientation, e.g. relative to ballast 6, e.g. by temporary locking by means of device 16*d* at the lower end of the ballast mast 2.

The back mast 3 is for example a single leg mast, or it may for example have an A-shape, an inverted Y-shape, a shape with two parallel masts (e.g. an H-shape) or a V-shape.

The main boom 5 too, can for example be of a linear design, or it may for example have an A-shape, an inverted Y-shape, an H-shape or a V-shape.

It is preferred for the back mast 3 and the main boom 5 to both have an A-frame shape, each with two legs joined at or near their upper ends and diverging at their lower ends, e.g. with one or more intermediate bracing between the legs. The A-frame design provides for optimal stability of the respective back mast 3 and main boom 5 at a relatively low weight thereof.

The ballast mast 2 is preferably a single mast or one legged mast, that is assembled from multiple ballast mast sections 20, 21, 22 that are stacked on top of one another and interconnected.

Onto the ballast mast 2, a back mast top slide 4 is arranged. The back mast top slide 4 is movable along the length or height of the ballast mast 2, thus in axial direction of the ballast mast 2.

As is preferred the back mast top slide 4 is fixable in a plurality of positions relative to the ballast mast 2.

The back mast 3 is at its top pivotable connected to the back mast top slide 4, e.g. at least around a horizontal pivot axis. As is preferred the slide 4 is connected to the mast 2 such that some pivotal motion around another horizontal axis, perpendicular to the vertical median plane of the back mast 3, is possible. The same mobility may be achieved by a Cardan joint between the back mast 3 and the slide 4.

At its lower end, the back mast 3 is pivotable connected to a mast foot assembly 7 around a horizontal back mast pivot axis. The lower end of the main boom 5 is also pivotable connected to the mast foot assembly 7.

In an embodiment the mast foot assembly is immobile relative to the surface 12. In another, more preferred, embodiment, the mast foot assembly is of a mobile design allowing for displacement over the surface, e.g. rotation and/or linear displacement, e.g. along a rail or another track.

The mast foot assembly 7 preferably, as here, includes a left-hand and right-hand foot device. Here the left-hand leg of the back mast 3 and main boom 5 are each hinged to the left-hand footy device and the right-hand legs of the back mast 3 and the main boom are each hinged to the right-hand foot device.

Each foot device may, as is preferred, comprise one or more vertical adjusters, e.g. hydraulic adjusters, e.g. to compensate for irregularities in the supporting surface 12 or other supporting structure, e.g. skid rail track, for ground deformation. The vertical adjusters may alternatively be arranged at another location in the mast foot structure.

Each foot device may, as is preferred, comprise a skid displacement device, e.g. including one or more hydraulic skid jacks, e.g. horizontal skid jacks, to allow for controlled displacement of the foot device, e.g. over a skid rail structure with one or more skid rails.

The mast foot assembly 7 may contain a rotation device, e.g. a vertical axis bearing, possibly with a rotation actuator, which device is adapted to allow for and/or cause rotation of a respective foot device around a vertical rotation axis.

The exemplary embodiment of the crane 1 as shown in FIG. 1 further comprises, optionally, a temporary guy-line, rod or tube 8 for temporarily stabilizing the main boom 5 relative to the surface.

The crane 1 may comprise a boom stop 9 to avoid undesired contact between the main boom 5 and the back mast 3 during booming operations.

The exemplary embodiment of the crane 1 as shown in FIG. 1 further comprises, optionally, a main load hoisting system 10 comprising a hoisting member, e.g. a hook 10*a*, which is moveable and suspended from the main boom 5 via one or more hoisting lines 10*b*, e.g. hoisting cables. The main hoisting device for example further comprises hoisting winches or strand jacks 10*c*.

The exemplary embodiment of the crane 1 as shown in FIG. 1 further comprises one or more guy-lines 11 between the top of the back mast 3 and the main boom 5.

Figure 3:
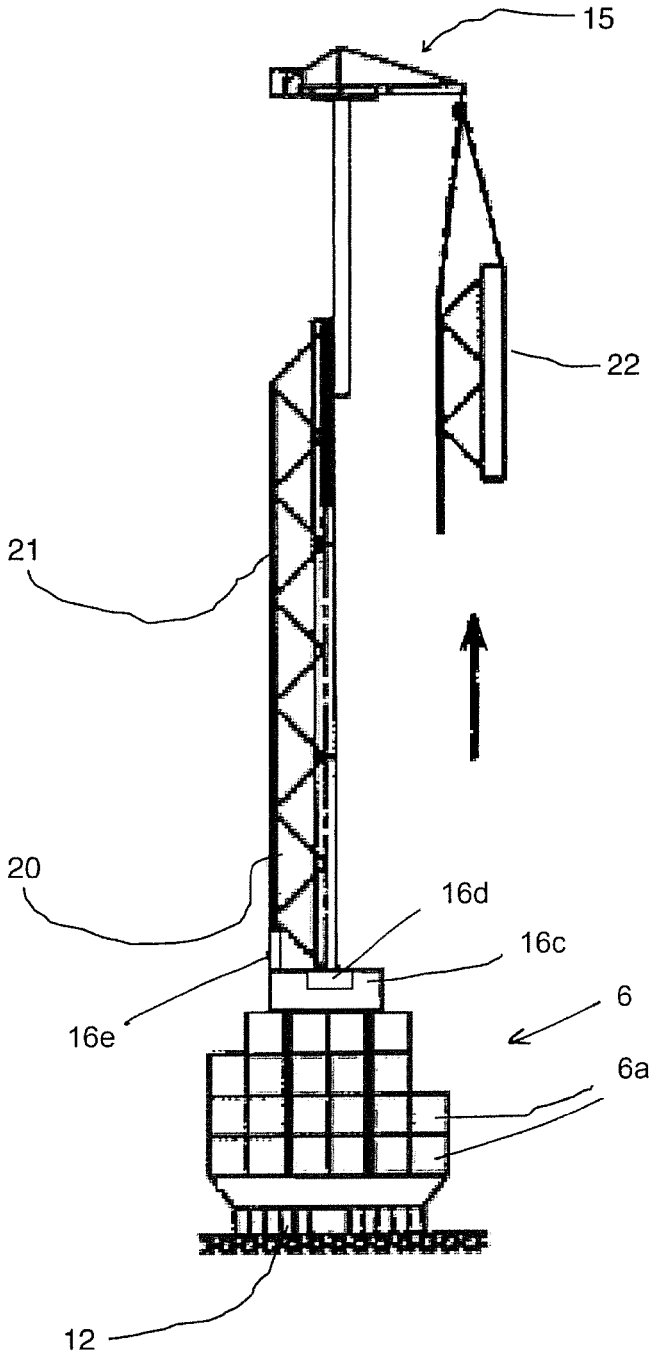
Figure 4:
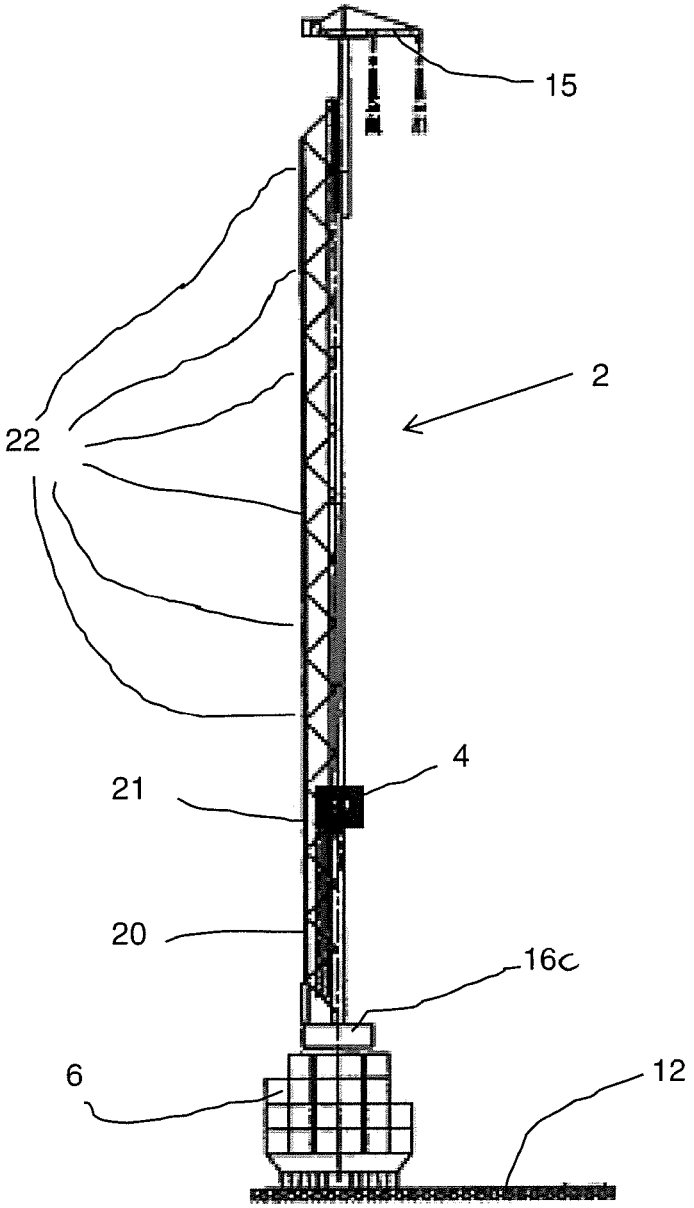

As depicted in FIG. 2-FIG. 4 it is envisaged, in an embodiment, that the ballast mast 2 is assembled using a climbing auxiliary crane 15 that has capacity to lift a section 21, 22 of the mast 2 and place it on top of the already construed part of the mast 2. Then the crane 15 is made to move up the extended mast 2 to repeat the lifting and assembly step until the mast 2 reaches the desired height. This approach using a climbing crane 15 allows to assemble the mast 2 on a minimal foot print, and allows to dispense with the need for a surface based major height crane. The auxiliary or climbing crane 15 may remain on the back mast 2 as shown here above the slide 4. In another embodiment the crane 15 is embodied so as to allow for the lowering thereof after assembly of the mast 2 or after the later assembly of the back mast 3 using the ballast mast 2 as will be explained. The crane 15 can be embodied to slide along the same structural components of the mast 2 as the slide 4, but one can also envisage that the crane 15 is mobile along an opposite side of the mast 2 relative to the side where the slide 4 moves.

If desired a further auxiliary crane 15*b* can be mounted on top of the main boom 5, e.g. to assist in the placement of one or more strand jack devices on the top of the main boom 5.

In FIG. 1, the exemplary embodiment of the crane is shown in a situation in which it carries a load 18, e.g. a vessel to be used in the (petro-)chemical industry, a power plant vessel, a module of an FPSO vessel to be placed on deck of such a vessel, etc.

FIG. 2-FIG. 12 show a possible embodiment of the method according to the first aspect of the invention.

In the first portion of the exemplary method in accordance with the first aspect of the invention as shown in FIG. 2-FIG. 12, the upright ballast mast 2 is assembled.

FIG. 2 shows a first stage in a possible embodiment of the method according to the first aspect of the invention.

In this step, a first ballast 6 is provided. A ballast mast support 16 is adapted to support the ballast mast 2. The ballast mast support 16 is placed on the surface 12 and the one or more ballast container 6 are placed on or connected to the support 16.

During operation of the crane 1, the ballast 6 may be moveable relative to surface 12.

FIG. 2 shows that a first ballast mast section 20 is provided. The first ballast mast section 20 has a length which is shorter than the final length of the ballast mast 2 to be constructed. In the step shown in FIG. 2, the first ballast mast section 20 is arranged on top of the ballast mast support 16 in an upright position, e.g. by means of a mobile crane.

In the embodiment shown in FIG. 2-FIG. 12, an auxiliary or climbing crane 15 is arranged on the ballast mast 2. The auxiliary crane 15 moves upward along the ballast mast 2 while the ballast mast is constructed. This concept is known from common methods of erecting tower cranes.

FIG. 3 shows a later stage in a possible embodiment of the method according to the first aspect of the invention.

A second ballast mast section 21 has been provided. The second ballast mast section 21 has a section length which is shorter than the length of the ballast mast 2 to be constructed. The second ballast mast section 21 has been fixed on top of the first ballast mast section 20 in an upright direction.

FIG. 3 shows that a further ballast mast section 22 is provided. The further ballast mast section 22 has a section length which is shorter than the length of the ballast mast 2 to be constructed.

The further ballast mast section 22 will be stacked on top of the second ballast mast section 21.

Additional further ballast mast sections are added until a desired length of the upright ballast mast 2 has been obtained.

In the exemplary embodiment of FIG. 2-FIG. 12, the second ballast mast section 21 and the further ballast mast sections 22 are lifted into position by an auxiliary crane 15 which is arranged on the ballast mast 2. In an alternative embodiment that is not shown in the drawings, they can be arranged into position by a separate crane which is arranged in the vicinity of the ballast 6, e.g. on the support surface 12 on which the crane is assembled.

The ballast mast 2 remains fixed in the upright position by means of temporal fixation, e.g. by device 16*e*, at least until the mast 2 has been complete, preferably at least until the back mast 3 has been constructed.

Optionally, at least one of a first ballast mast section 20, a second ballast mast section 21, and a further ballast mast section 22 is constructed from elongate elements that are releasably connected to each other, for example by pen-slot connections. Optionally, such elongate elements have a length such that they fit in the space of standard size road containers or standard size sea containers. The elongate elements can for example be tubes, e.g. tubes with an octagonal cross section, or beams.

Optionally, the assembly of at least one of a first ballast mast section 20, a second ballast mast section 21 and a further ballast mast section 22 takes place on the site where the crane 1 is assembled.

FIG. 4 shows a subsequent stage in a possible embodiment of the method according to the first aspect of the invention.

The ballast mast 2 has now been completed. It comprises a first ballast mast section 20, a second ballast mast section 21 and multiple further ballast mast sections 22.

Now the ballast mast 2 has been completed, or earlier, a back mast top slide 4 is arranged on the ballast mast 2. The back mast top slide 4 is movable along the ballast mast 2 in the axial direction of the ballast mast 2 and the back mast top slide 4 is fixable, e.g. in a plurality of pre-determined positions, relative to the ballast mast 2.

Figure 5:
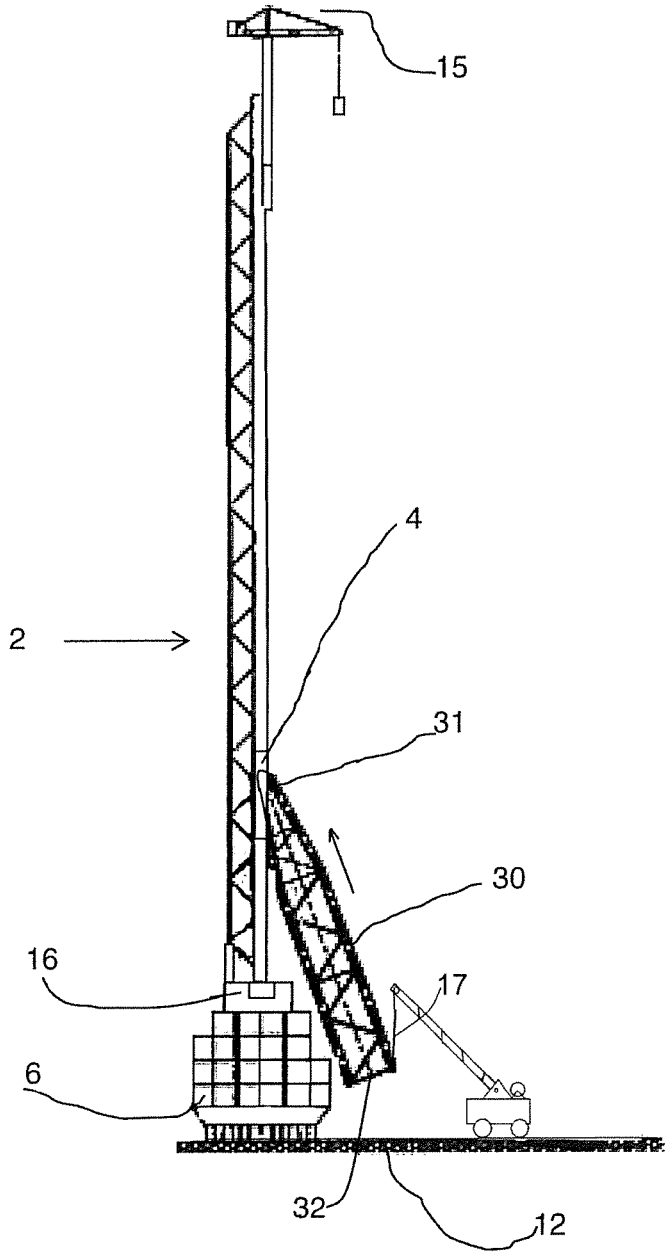

FIG. 5 shows a subsequent stage in a possible embodiment of the method according to the first aspect of the invention.

After the ballast mast 2 has been constructed, the back mast 3 will be assembled.

The back mast 3 may for example be of a linear or single legged design, or it may for example have an A-shape, an inverted Y-shape, a shape with two parallel masts (e.g. an H-shape), etc.

The construction of the back mast comprises providing a back mast upper section 30. The back mast upper section 30 has a length that is shorter than the final length of the back mast 3. It has a ballast mast side end 31 and a back mast side end 32. The back mast upper section 30 will form the upper part of the back mast 3 of the assembled crane 1. For example a pair of upper sections 30 is arranged side by side, diverging according to the A-frame shape back mast 3 to be assembled.

Optionally, the back mast upper section 30 is constructed from elements that are releasably connected to each other, e.g. including elongated chords along respective corners of a four sided element with diagonal trusses between chords. Connections between adjoining elements of the back mast may for example be pen-slot connections.

Optionally, such elongate elements have a length such that they fit in the space of standard size road containers or standard size sea containers. The elongate elements can for example be tubes, e.g. tubes with an octagonal cross section, or beams. Optionally, the assembly of the back mast upper section 30 takes place on the site where the crane 1 is assembled.

The back mast upper section 30 is pivotable connected to the back mast top slide 4.

Preferably the back mast top slide 4 is brought into a lowered position thereof to connect the upper section or sections 30 to it, e.g. using a relatively small surface based crane. As is preferred the connection is pivotal around a horizontal pivot axis and is held or fixed in a first or lower position along the ballast mast 2 when the back mast upper section 30 is connected to it. In the example shown in FIG. 5, the back mast top slide 4 is in a position which is high enough to allow the back mast upper section 30 to become attached to the back mast top slide 4, but low enough to allow further upward movement of the back mast top slide 4 along the ballast mast 2.

Optionally, after connecting the back mast upper section 30 to the back mast top slide 4, the back mast upper section 30 is pivotable around at least two pivot axis relative to the back mast top slide 4.

The back mast upper section 30 is connected to the back mast top slide 4. In the example of FIG. 5, this is achieved by fixing the back mast top slide 4 at such a position on the ballast mast 2 that the back mast upper section 30 finds itself above the support surface 12 on which the crane is assembled when the back mast upper section 30 is connected to the back mast top slide 4. The back mast side end of the back mast upper section 30 is supported and lifted by a crane hook or other suitable lifting means 17.

Alternatively, not shown in the drawings, when connecting the back mast upper section 30 to the back mast top slide 4, the back mast top slide 4 is fixed to the ballast mast 2 in a relatively low position, at a distance from the support surface 12 which is smaller than the length of the back mast upper section 30, so the back mast end 32 of the back mast upper section 30 still rests on the support surface 12 on a base structure. The back mast top slide 4 is then moved upwards along the ballast mast 2 after the back mast upper section 30 is connected to the back mast top slide 4.

In the example of FIG. 5 the back mast side end 32 of the back mast upper section 30 is supported and lifted by a crane 17 or elevating construction (not shown). Alternatively, in an embodiment not shown in the drawings, the back mast side end 32 of the back mast upper section 30 may still rest on the support surface 12.

The back mast upper section 30 can be lifted to the back mast top slide 4 for connection to the back mast top slide 4 by means of an auxiliary crane 15 that is arranged on top of the ballast mast, or by a separate crane that is arranged in the vicinity of the ballast mast 2.

Figure 6:
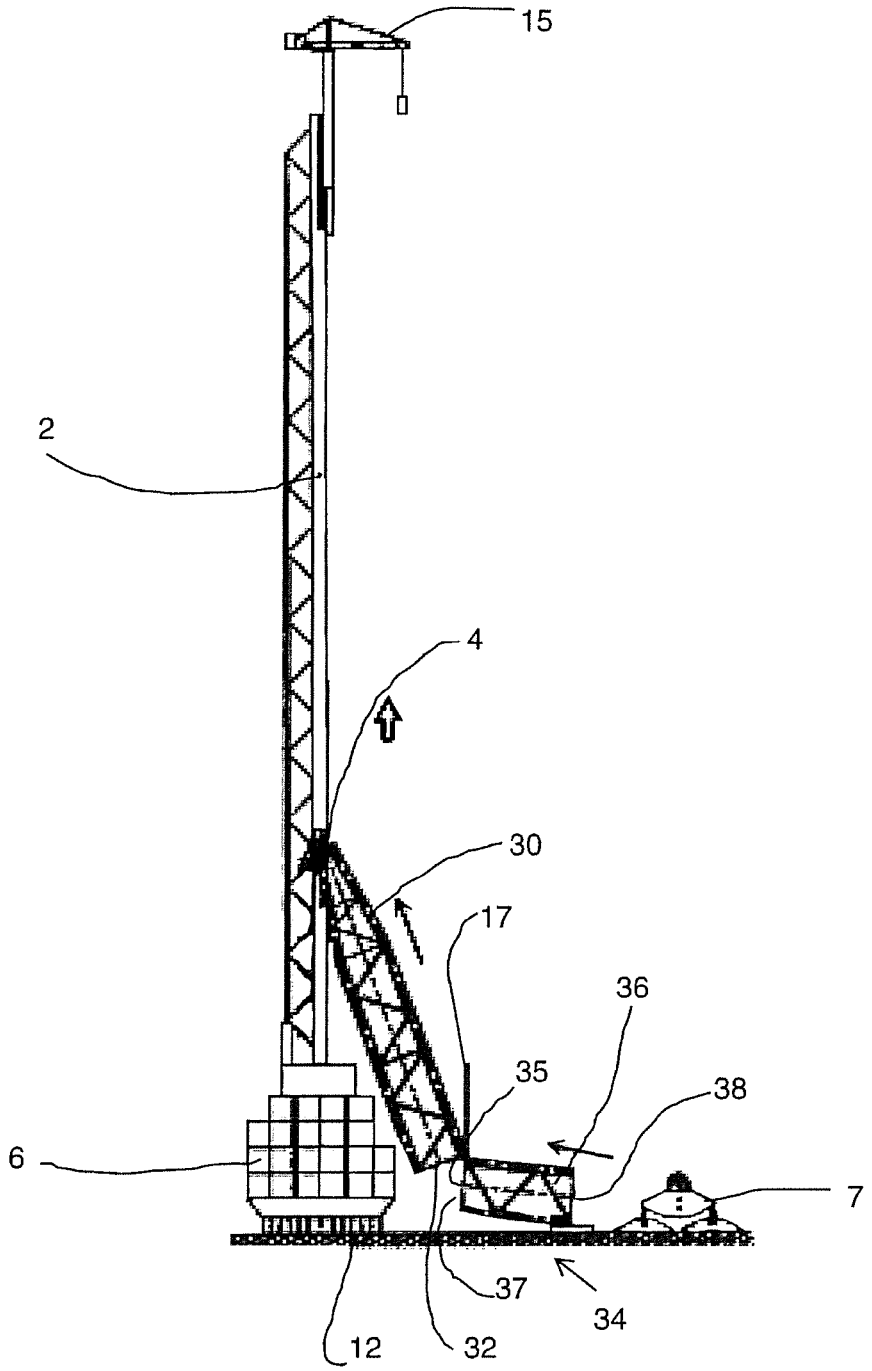

FIG. 6 shows a subsequent stage in a possible embodiment of the method according to the first aspect of the invention.

A back mast intermediate section 34 is provided and connected to the back mast upper section.

The back mast intermediate section 34 has a length that is shorter than the final length of the back mast 3. The back mast intermediate section 34 has a first end 35 and a second end.

The first end 35 of the back mast intermediate section 34 is connected to the back mast side end 32 of the back mast upper section 30.

In the embodiment of the first method according to the invention as shown in FIG. 2-FIG. 12, the back mast intermediate section 34 is assembled by stepwise addition of multiple back mast subsections 36. In this example, the back mast top slide 4 is moved upwardly along the ballast mast 2 after and/or before the addition of a subsequent back mast subsection 36.

Each back mast subsection 36 has a length that is shorter than the final length of the back mast intermediate section 34. Each back mast subsection has a primary connection end 37 and a secondary connection end 38.

FIG. 6 shows the connection of the first back mast subsection 36 to the back mast end 32 of the back mast intermediate section 30. The primary connection end 37 of this back mast subsection 36 forms the first end 35 of the back mast intermediate section 36. The secondary connection end of the back mast subsection that is arranged on the opposite end of the back mast intermediate section will form the second end of the back mast intermediate section once the back mast intermediate section has been completed. In this example, the primary connection end 37 of the back mast subsection 36 lifted towards the back mast side end 32 of the back mast upper section 30 by a separate crane 17 (partly shown in FIG. 6). Alternatively, the auxiliary crane 15 with extended boom on top of the ballast mast 2 can be used for this.

The back mast intermediate section 34 is constructed by stepwise adding a predetermined number of back mast subsections 36.

In the example as shown in FIG. 6, first, a plurality of back mast subsections 36 is provided. Then, the primary connection end 37 of a first back mast subsection 36 is connected to the back mast side end 32 of the back mast upper section 30. Herewith, the primary connection end 37 becomes the first end 36 of the back mast intermediate section 34.

It can be seen in FIG. 6 that in this stage of this exemplary embodiment, the back mast subsection 36 does not yet extend in line with the axial direction of the back mast upper section 30. To achieve such an alignment, in this exemplary embodiment the back mast top slide 4 is moved upwards along the ballast mast 2, allowing the back mast subsection 36 to rotate around the connection to the back mast upper section 30. Therewith, the first back mast subsection 36 can come to extend in line with the axial direction of the back mast upper section 30 with the secondary connection end 38 of the first back mast subsection 36 facing downwards. Once this relative position has been obtained, the first back mast subsection 36 can be fixed to the back mast upper section 30.

The back mast intermediate section 34 is then further constructed by adding further back mast subsections.

This is for example carried out by subsequently connecting the primary connection end of a further back mast subsection to the secondary connection end of the first back mast subsection. Then, the back mast top slide 4 is moved upwards along the ballast mast 2. Therewith, the further back mast subsection can come to extend in line with the axial direction of the first back mast subsection 36 with the secondary connection end of the further back mast subsection facing downwards. The further back mast subsection is then fixed to the first back mast subsection. So, the further back mast subsection is connected to, aligned with and fixed to the first back mast subsection in the same way as the first back mast subsection 36 has been connected to, aligned with and fixed to the back mast upper section.

Then, in this exemplary embodiment, the primary connection end of a subsequent further back mast subsection is connected to the secondary connection end of the previous further back mast subsection. The back mast top slide 4 is again moved upwards along the ballast mast 2 the subsequent further back mast subsection is made to come to extend in line with the axial direction of said previous further back mast subsection with the secondary connection end of the subsequent further back mast subsection facing downwards. The subsequent further back mast subsection is then fixed to said previous first back mast subsection. This is repeated by adding further subsequent back mast subsections until a desired length of the back mast intermediate section is obtained.

The secondary connection end of the last back mast subsection that is applied forms the second end of the back mast intermediate section.

Optionally, a back mast subsection is constructed from elongated elements that are releasably connected to each other, for example by pen-slot connections. Optionally, such elongate elements have a length such that they fit in standard size road containers or standard size sea containers. The elongate elements can for example be tubes, e.g. tubes with an octagonal cross section, or beams.

Optionally, a back mast subsection is constructed on the site where the crane is assembled in accordance with the first aspect of the invention.

As a preparation for the subsequent stages of the method according to the first aspect of the invention, a mast foot assembly 7 is provided.

Figure 7:
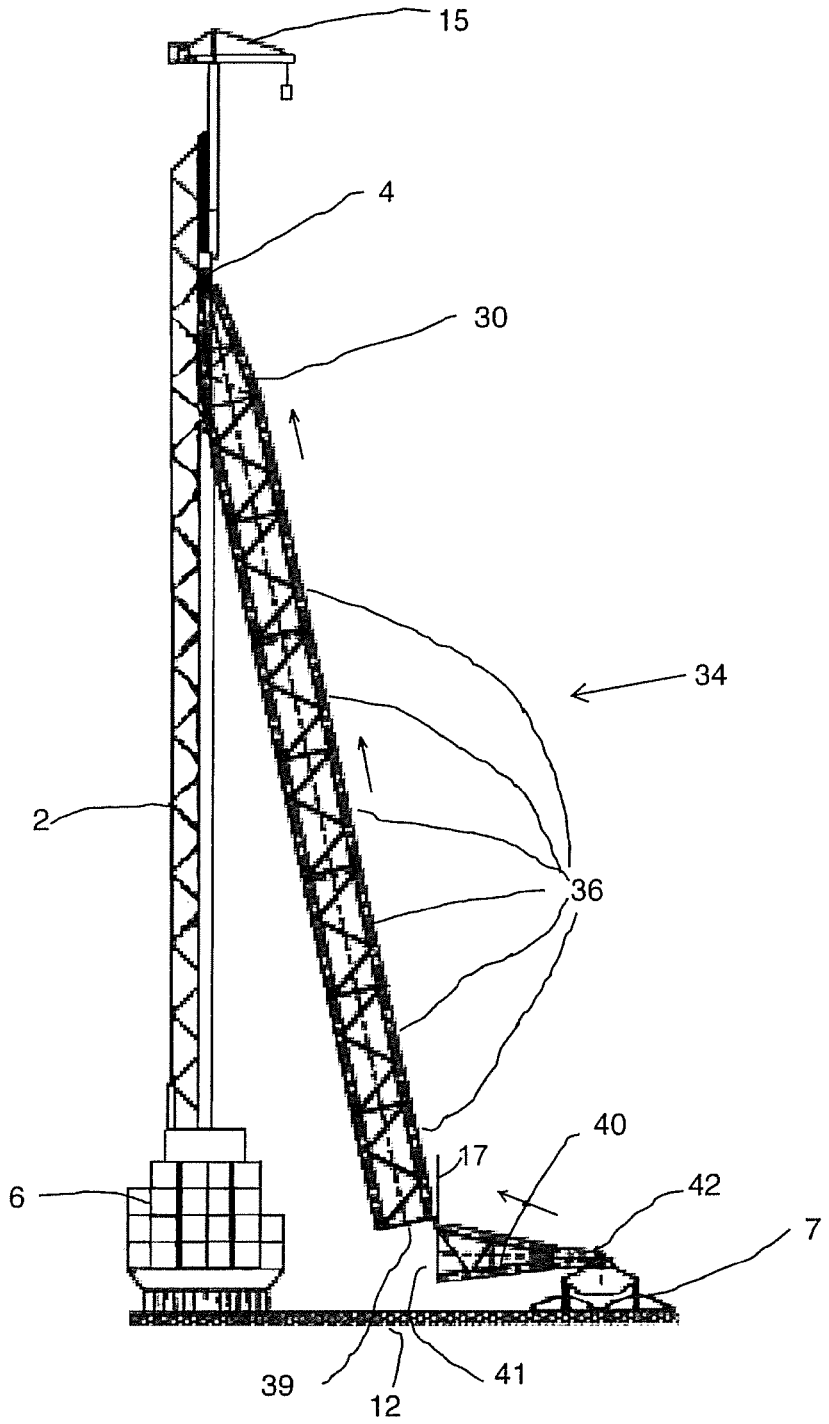

FIG. 7 shows a subsequent stage in a possible embodiment of the method according to the first aspect of the invention.

The back mast intermediate section 34 has now been completed. It has been constructed from multiple back mast subsections 36 as described above.

The secondary connection end of the back mast subsection that is arranged on the lower end of the back mast intermediate section 34 forms the second end 39 of the back mast intermediate section 34.

The back mast intermediate section 34 extends in line with the axial direction of the back mast upper section 30, and the back mast intermediate section 34 is fixed to the back mast upper section 30. In the fixed position, the back mast intermediate section 34 extends in line with the axial direction of the back mast upper section 30.

Now, a back mast lower section 40 is provided. The back mast lower section 40 has a length that is shorter than the final length of the back mast 3. The back mast lower section has a foot side end 42 and a back mast side end 41.

As is shown in FIG. 7, the back mast side end 41 of the back mast lower section 40 is connected to the second end 39 of the back mast intermediate section 34.

The foot side end 42 of the back mast lower section 40 is pivotably connected to the mast foot assembly 7. This may take place before or after the back mast lower section 40 is connected to the back mast intermediate section 34.

The mast foot assembly 7 may be a fixed, that is, immobile, mast foot assembly, which has a fixed position on the support surface onto which the crane is assembled, or a moveable mast foot assembly, which can travel on the support surface onto which the crane is assembled, either freely or along a track. The mast foot assembly 7 comprises multiple mast feet. The mast foot assembly 7 contains a rotation device, which is adapted to allow the main boom and the back mast to rotate around a vertical rotation axis.

The back mast lower section 40 is made to come to extend in line with the axial direction of the back mast intermediate section 30. Then, the back mast intermediate section is fixed to the back mast lower section. In the fixed position, the back mast lower section 40 extends in line with the axial direction of the back mast intermediate section 34. This alignment and/or fixing may take place either after or before the foot side end 42 of the back mast lower section 40 is connected to the mast foot assembly 7.

Making the back mast lower section 40 to come to extend in line with the axial direction of the back mast intermediate section 34 optionally involves moving the back mast top slide 4 upwards along the ballast mast 2 and fixing the back mast top slide 4 at a higher position than the position it had on the ballast mast 2 when the back mast lower section 40 was connected to the back mast intermediate section 34.

Making the back mast lower section 40 to come to extend in line with the axial direction of the back mast intermediate section 34 optionally involves moving the mast foot assembly 7 closer to the ballast mast 2 and lifting (climbing) the back mast top slide 4.

After assembly of the back mast and the connection of the back mast to the mast foot assembly, the ballast mast that has up to now been fixed to the ballast, is allowed to move, e.g. with some restriction and/or damping, around one or more horizontal axes and a vertical axis.

Now, the ballast mast and the back mast have been constructed. As a next phase in the assembly of the crane in accordance with the first aspect of the invention, a main boom 5 is assembled, which main boom 5 is pivotably connected to the mast foot assembly 7. The main boom 5 may for example be of a linear design, or it may for example have an A-shape, an inverted Y-shape, a shape with two parallel masts (e.g. an H-shape) or a V-shape.

The main boom may be assembled in many different ways. In the embodiment shown in FIG. 2 to FIG. 12, the main boom is assembled in accordance with the second aspect of the invention. Alternatively, a different way of assembling the main boom and pivotably connecting the main boom to the mast foot assembly may be used in the method according to the first aspect of the invention.

The method of assembling the main boom in accordance with the second aspect of the invention may be applied in combination with the method in accordance with the first aspect of the invention. It may however also be applied to assemble a main boom using the method in accordance with the second aspect of the invention. The back mast of the crane may in this case be provided in any way considered suitable.

Figure 8:
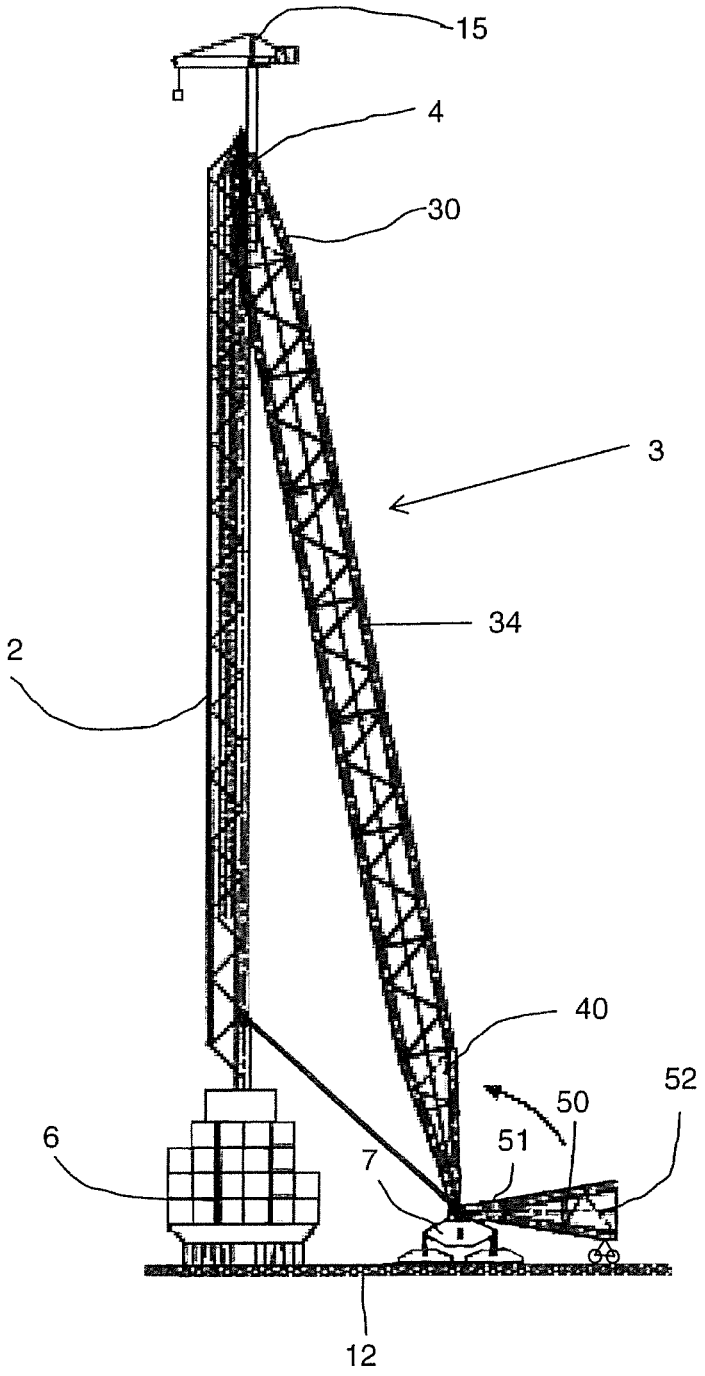
FIG. 8-FIG. 12: schematically illustrate further subsequent stages in an exemplary embodiment of the method according to the first aspect of the invention, in which an exemplary embodiment of the second aspect of the invention is used.

FIG. 8 shows a subsequent stage in a possible embodiment of the method according to the first aspect of the invention, in which now an exemplary embodiment of the method according to second aspect of the invention is applied.

For the assembly of the main boom 5, a main boom lower section 50 is provided. The main boom lower section 50 has a length that is shorter than the final length of the main boom 5. The main boom lower section 50 has a foot side end 51 and a main boom side end 52.

The foot side end 51 of the main boom lower section 50 is pivotably connected to the mast foot assembly 7. However, before this is done, preferably the ballast mast 2 is allowed to pivot relative to the ballast 6 and the position of the mast foot assembly 7 is fixed in position relative to the ballast mast 2, e.g. using temporary tubes that can absorb tensile as well as compressive forces. Then, the main boom lower section 50 is pivoted upwardly relative to the mast foot assembly 7.

Figure 9:
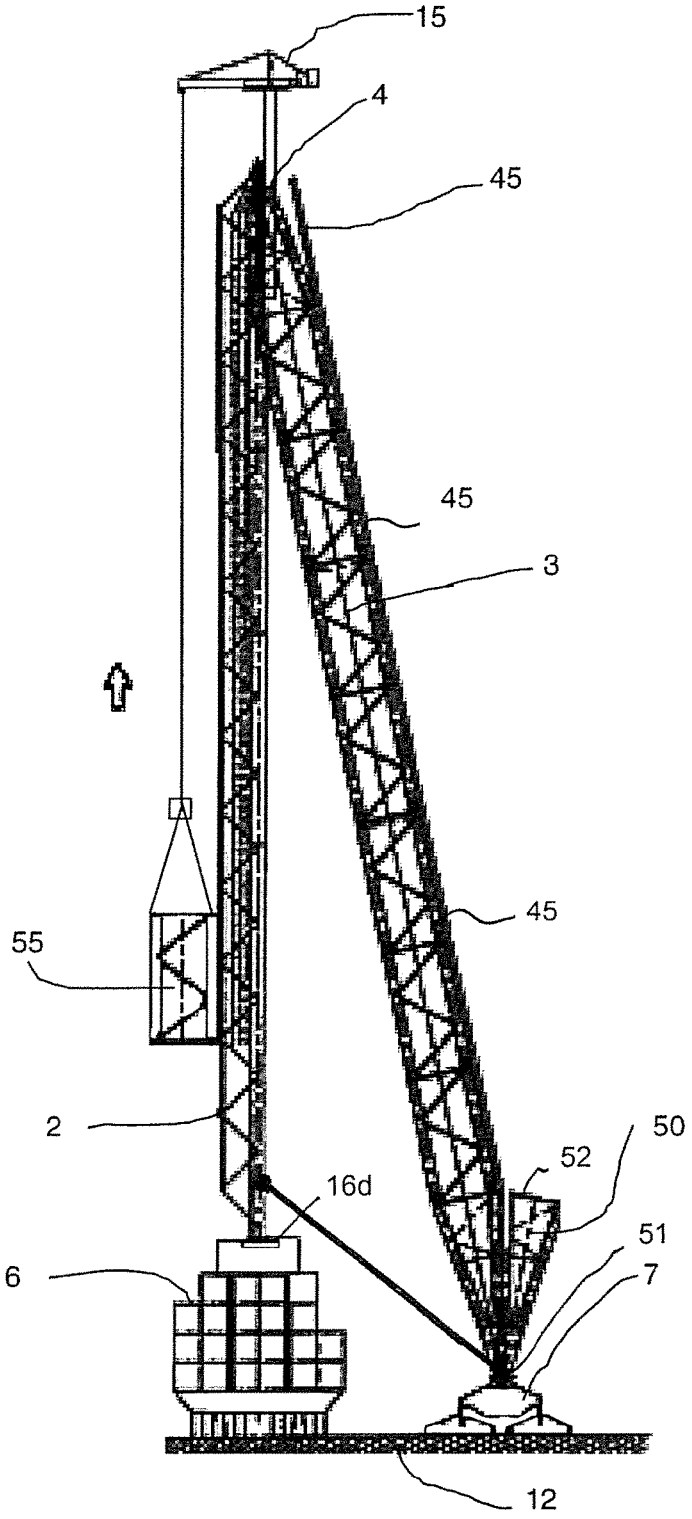

FIG. 9 shows a subsequent stage in a possible embodiment of the method according to the first aspect of the invention, in which now an exemplary embodiment of the method according to second aspect of the invention is applied.

In this stage, the main boom lower section 50 has been pivoted upwardly relative to the mast foot assembly 7. In this example, it now rests against the back mast lower section 40.

In the next phase, a main boom intermediate section 55 is provided. The main boom intermediate section 55 has a length that is shorter than the final length of the main boom 5. The main boom intermediate section has a first end and a second end.

The first end of the main boom intermediate section 55 is provided upon the main boom side end 52 of the main boom lower section 50.

In the embodiment shown in FIG. 9, the main boom intermediate section is constructed by stacking multiple main boom subsections 55 on top of each other.

In the embodiment shown in FIG. 9, a mast section guide 45 is provided along the back mast 3. Each main boom subsection 55 is lifted to the top of the back mast 3, for example by the auxiliary crane 15 which is arranged on top of the ballast mast 2.

The mast section guide also allows the main boom to be assembled by adding main boom sections, e.g. main boom intermediate sections, to the foot side end of a main boom section already provided against the mast guide sections. The main boom section to be added is pushed upwards by suitable pushing or lifting means. The main boom may thus be constructed by addition of main boom sections at the bottom or by addition of main boom sections at the top thereof.

If the entire main boom intermediate section is arranged on the main boom lower section in one go, the main boom intermediate section is lifted to the top of the back mast 3. A separate crane may be provided for this.

Figure 10:
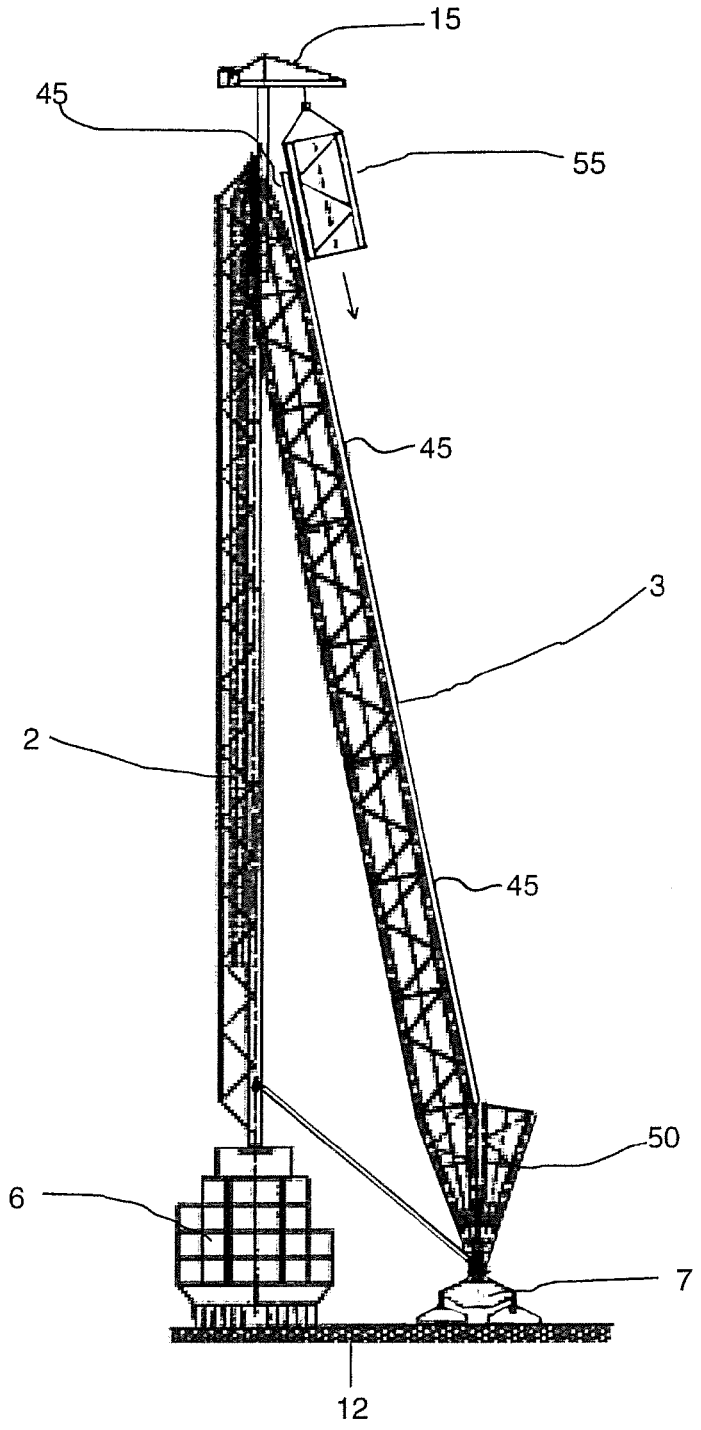

FIG. 10 shows a subsequent stage in a possible embodiment of the method according to the first aspect of the invention, in which now an exemplary embodiment of the method according to second aspect of the invention is applied.

Each main boom subsection 55 is now lowered onto the main boom lower section 5 along the mast section guide 45. This way, a main boom intermediate section is assembled onto the main boom lower section 50 by stepwise addition of multiple main boom subsections 55.

Figure 11:
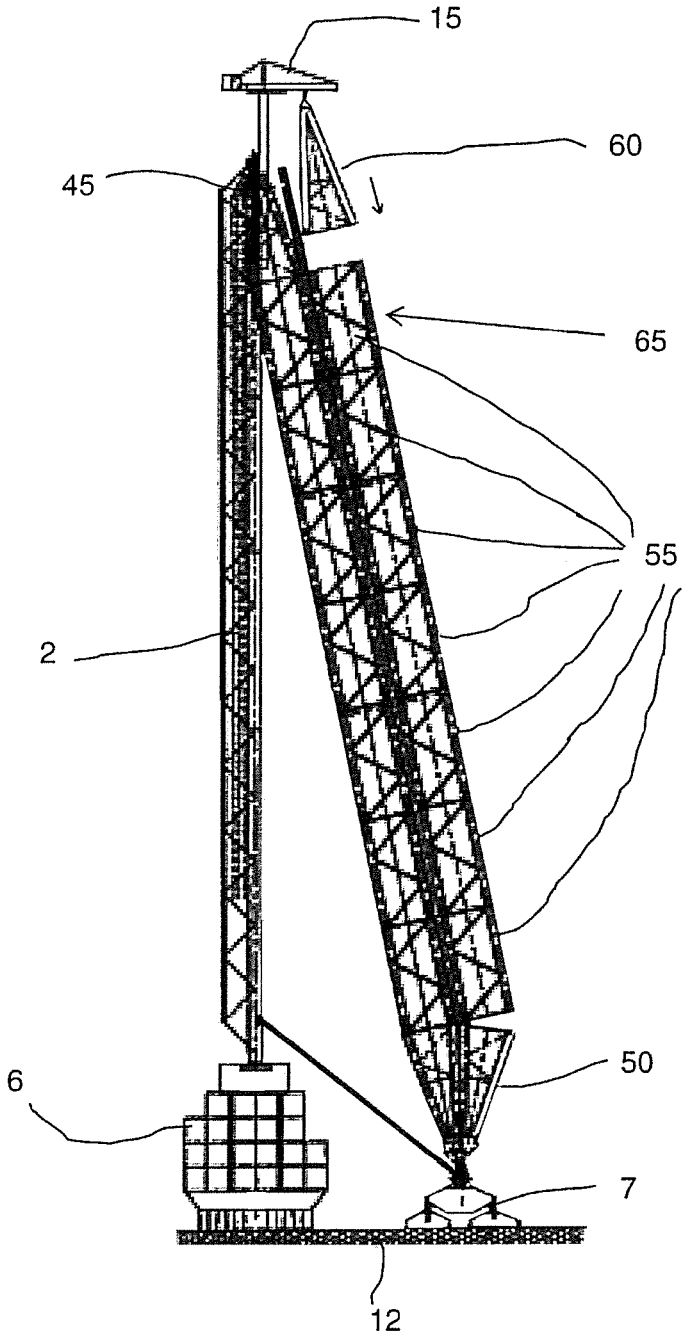

FIG. 11 shows a subsequent stage in a possible embodiment of the method according to the first aspect of the invention, in which now an exemplary embodiment of the method according to second aspect of the invention is applied.

The main boom intermediate section 65 has now been constructed using multiple main boom subsections 55 which have been stacked on top of one another.

On top of the main boom intermediate section 65, a main boom upper section 60 is now arranged. It is aligned relative to the main boom intermediate section preferably using the mast section guide 45. The main boom upper section 60 is in the example lifted into place by the auxiliary crane 15 which is arranged on top the ballast mast 2, but alternatively a separate crane can be used.

The main boom upper section 60 is fixed onto the main boom intermediate section 65.

Figure 12:
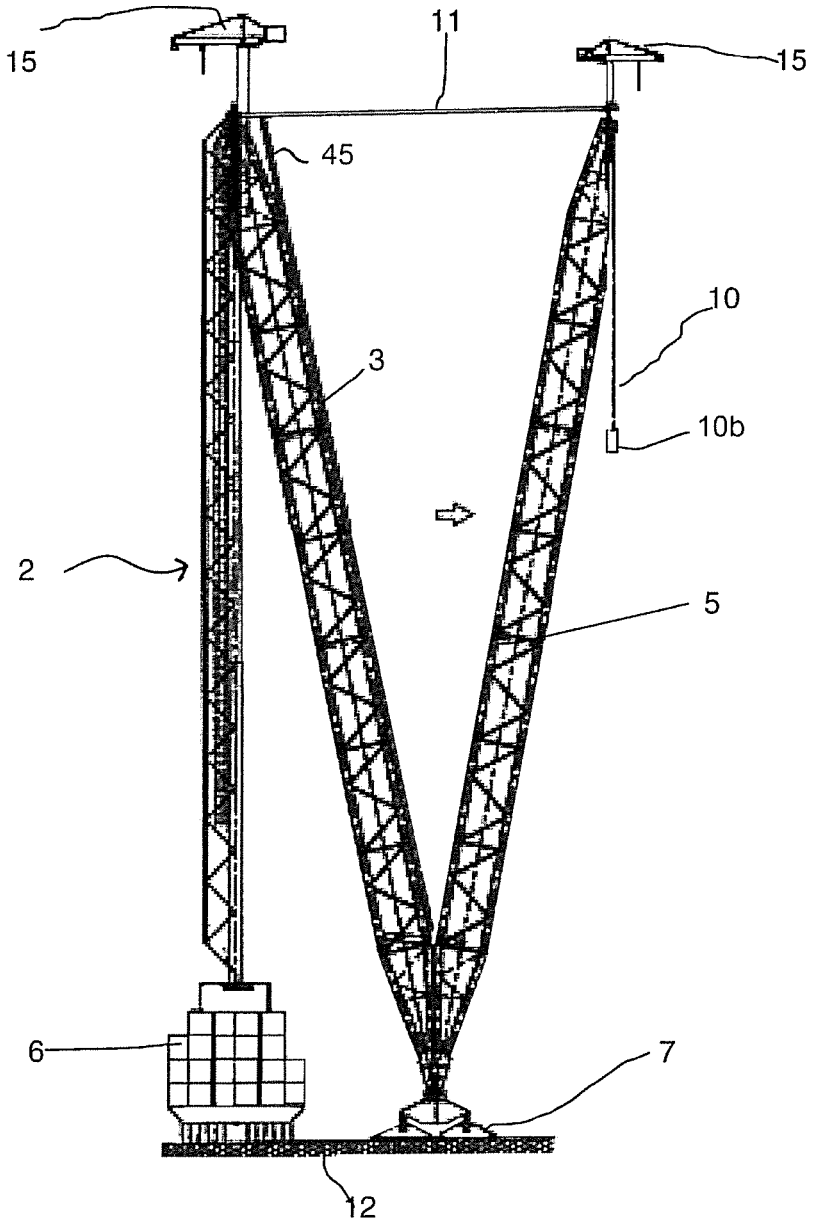

FIG. 12 shows a subsequent stage in a possible embodiment of the method according to the first aspect of the invention, in which now an exemplary embodiment of the method according to second aspect of the invention is applied.

The main boom intermediate section 65 with the connected main boom upper section 60 are now pivoted around the connection of the main boom intermediate section 65 and the main boom lower section 50. In this way the main boom intermediate section 65 with the attached main boom upper section 60 become aligned with the axial direction of the main boom lower section 50.

The main boom intermediate section 65 is then fixed to the main boom lower section 50.

Further elements of the crane 1 may be added or made operational, such as a guy-line 11 and a main hoisting system 10.

Figure 13:
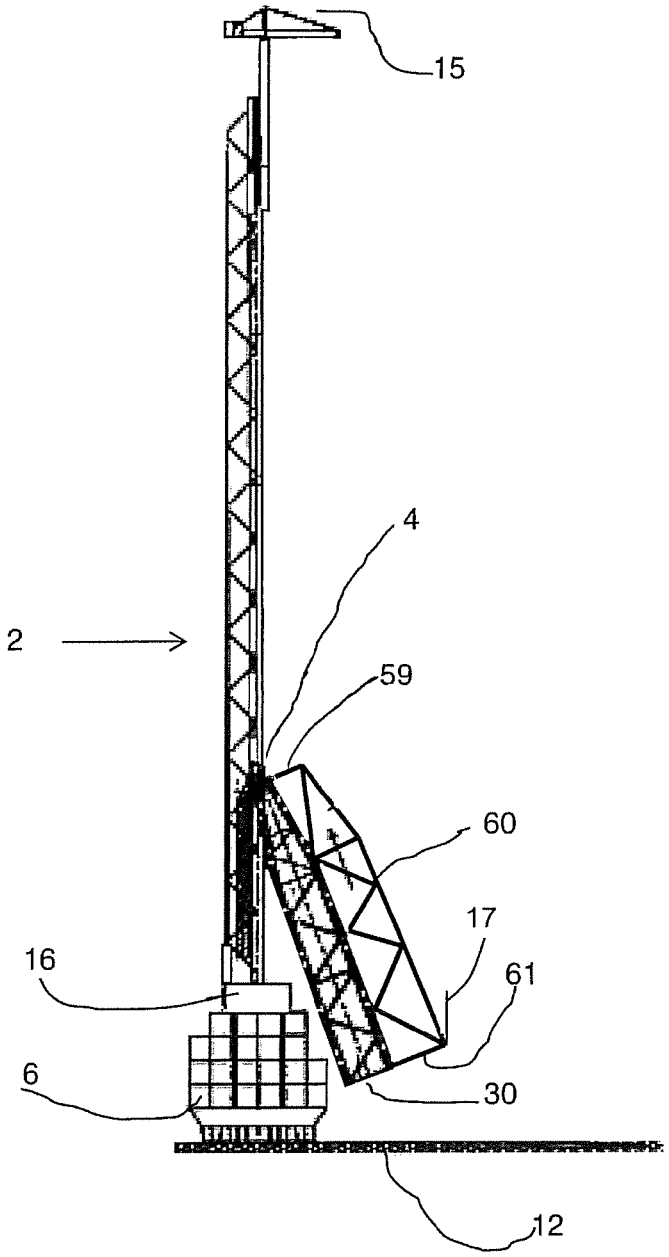
FIG. 13-FIG. 15: schematically illustrate subsequent stages of an example of an alternative method for assembling a main boom which can be used in combination with the method according to the first aspect of the invention.

FIG. 13 shows a first stage of an example of an alternative method for assembling a main boom which can be used in combination with the method according to the first aspect of the invention.

In this example of the alternative embodiment, the main boom 5 is constructed along with the construction of the back mast 3.

In this example, a main boom upper section 60 is provided. The main boom upper section 60 has a length that is shorter than the final length of the main boom 5. The main boom upper section 60 has a main boom side end 61.

Then, before connecting the back mast intermediate section 34 to the back mast upper section 30, the main boom upper section 60 is arranged adjacent to the back mast upper section 30. The main boom upper section 60 is then connected to the back mast upper section 30 by connection element 59. This is shown in FIG. 13.

The main boom upper section 60 will therewith generally be retained at least by this connection element 59. Optionally, the main boom upper section 60 comes to rest against back mast upper section 30.

Figure 14:
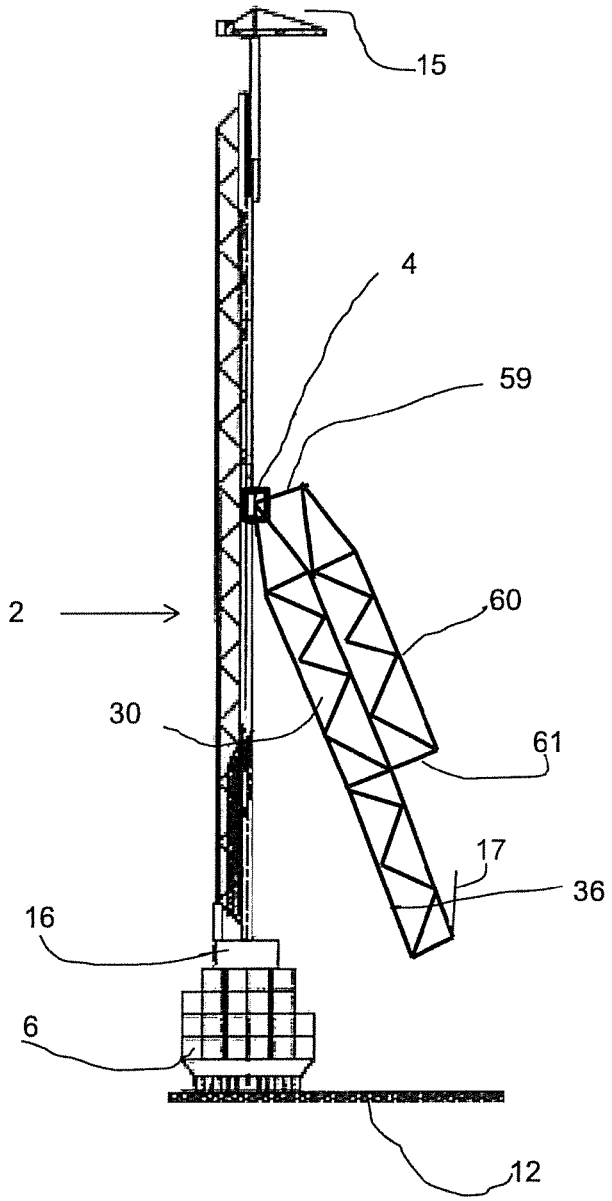

FIG. 14 shows a subsequent stage of an example of an alternative method for assembling a main boom which can be used in combination with the method according to the first aspect of the invention.

In this stage, a first back mast subsection 36 of a back mast intermediate section is connected—and preferably also aligned with and fixed—to the back mast upper section 30. The back mast top slide 4 is moved upwardly along the ballast mast 2 after connecting the main boom upper section 60 to the back mast upper section 30 but before connecting the back mast subsection 36 to the back mast upper section 30. Preferably, after this upward movement, the back mast top slide 4 is fixed in position relative to the ballast mast 2.

Instead of a back mast subsection, the entire back mast intermediate section can be connected to the back mast upper section in this stage.

Figure 15:
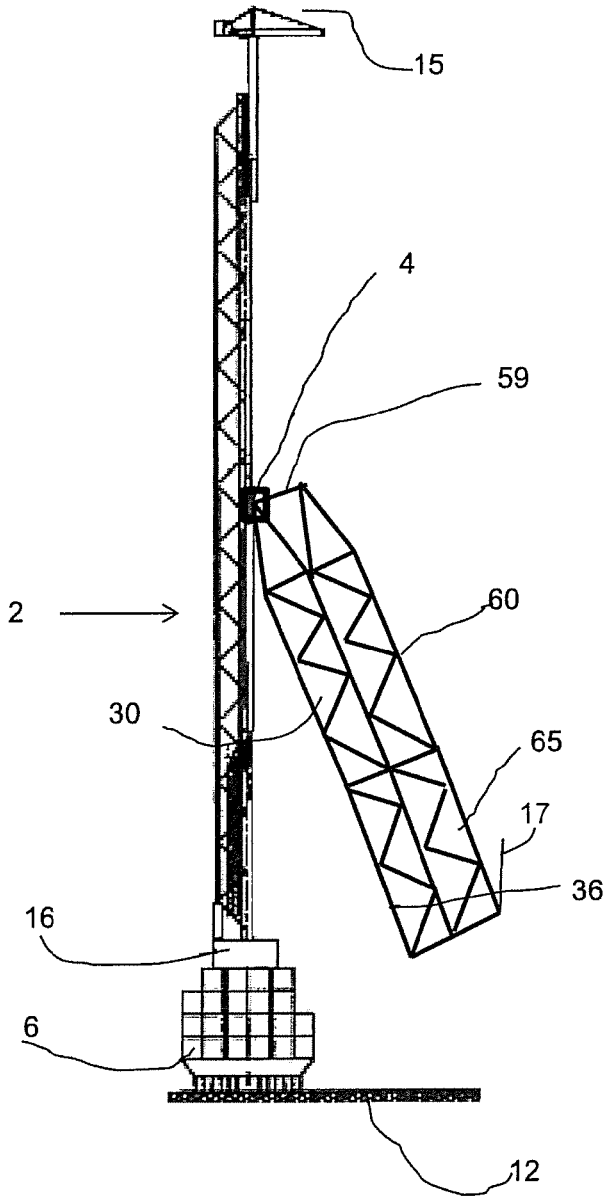

FIG. 15 shows a subsequent stage of an example of an alternative method for assembling a main boom which can be used in combination with the method according to the first aspect of the invention.

After connecting a back mast subsection 36 or the entire back mast intermediate section to the back mast upper section, a main boom subsection 65 or the entire main boom intermediate section is connected to—and preferably also aligned with and fixed to—the main boom upper section 60. Optionally, the main boom intermediate section or main boom subsection 65 comes to rest against back mast intermediate section or back mast subsection 36, respectively.

So, a possible variant of this embodiment, the back mast intermediate section and the main boom intermediate section are assembled by stepwise addition of multiple back mast subsections and main boom subsections, respectively. Optionally, the back mast top slide is moved upwardly along the ballast mast after and/or before the addition of a subsequent subsection, e.g. before the addition of each subsequent back mast subsection and/or before the addition of each subsequent main boom subsection.

Then, after connecting the back mast lower section to the back mast intermediate section, a main boom lower section is connected to—and preferably also aligned with and fixed to—the main boom intermediate section. Optionally, the main boom lower section comes to rest against back mast lower section.

Then, the main boom lower section is connected to the mast foot assembly. Optionally, the main boom is then pivoted away from the back mast.

Figure 16:
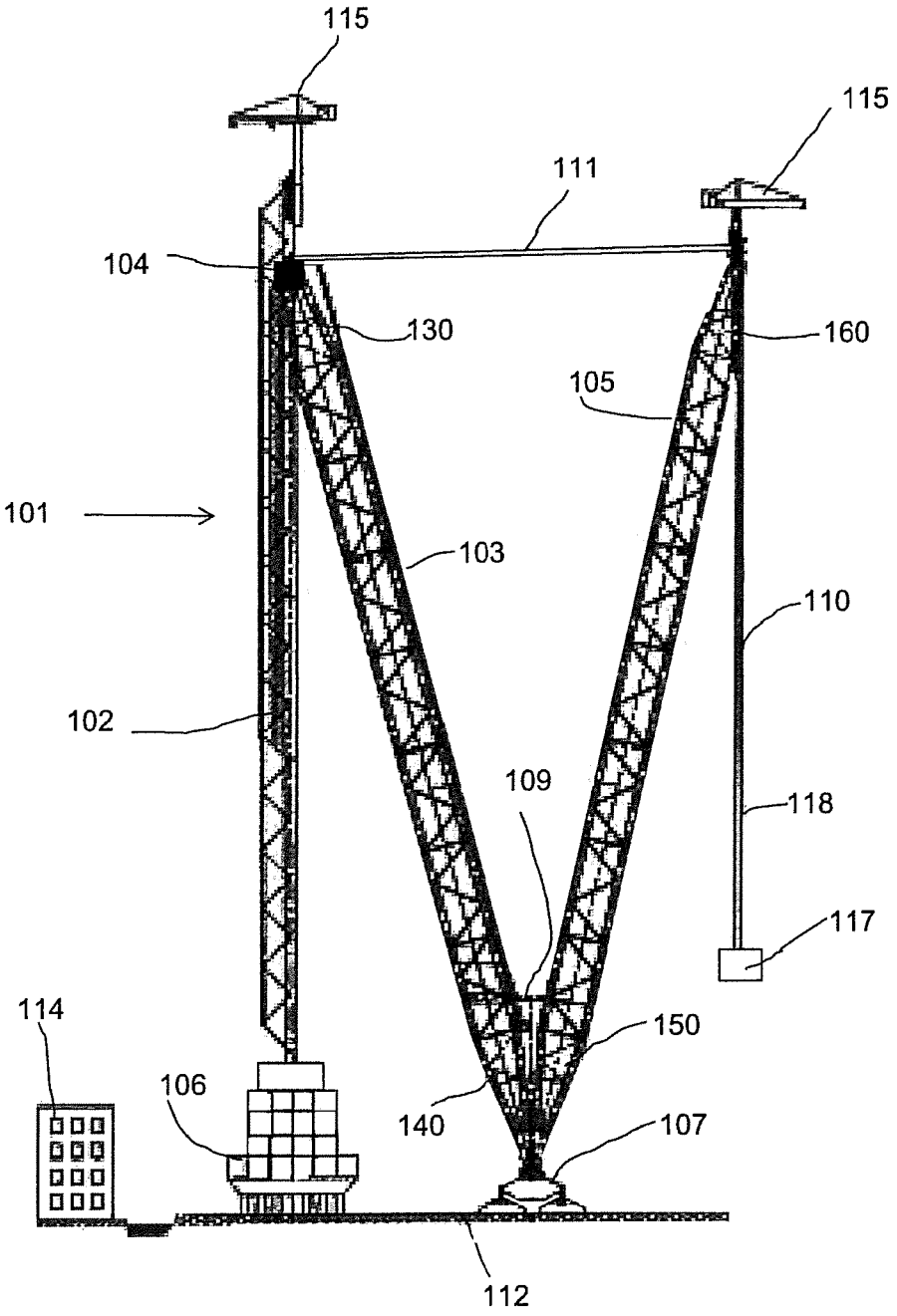
FIG. 16: schematically illustrates an exemplary embodiment a crane which can be used in an exemplary embodiment of a method according to the third aspect of the invention.

FIG. 16 schematically illustrates an exemplary embodiment a crane which can be used in an exemplary embodiment of a method according to the third aspect of the invention.

A crane 101 which can be used in the method according to the third aspect of the invention comprises a first anchor connection 102, e.g. a first ballast mast, an anchor chain, an anchor cable or a set of anchor chains and/or anchor cables.

The crane further comprises a primary anchor 106 and a secondary anchor 126 (see FIG. 17), which are located at a distance from each other. Before operating the crane in accordance with the third aspect of the invention, the first anchor connection 102 is connected to the primary anchor 106.

The primary anchor 106 and/or the secondary anchor 126 can for example be a ballast, for example made from stacked heavy objects such as metal weights or containers, for example sea containers filled with sand. Alternatively, the primary anchor 106 and/or the secondary anchor 126 can be a heavy object, for example a heavy object that is fixed to the ground, or an anchor e.g. in the form of a hook or ring that is fixed to the world, e.g. to a rock.

The crane further comprises a back mast 103. The back mast 103 has a back mast lower section 140 which is pivotably connected to a mast foot assembly 107 and a back mast upper section 130 which is in two directions pivotably connected to the first anchor connection 102. The anchor connection 102, which can rotate around its vertical axis, provides a connection, e.g. a flexible connection, between the primary anchor 106 and the back mast upper section 130.

The crane further comprises a main boom 105. The main boom 105 has a main boom lower section 150 which is pivotably connected to the mast foot assembly 107, and a main boom upper section 160.

The crane further comprises a main load hoisting system 110 comprising a hoisting member 117, which is moveable and suspended from the main boom via one or more hoisting lines 118. The crane also comprises a guy-line 111 which connects the back mast upper section and the main boom upper section.

In the example shown in FIG. 16, the first anchor connection 102 is a first ballast mast. The crane further comprises a back mast top slide 104 which is arranged on the first ballast mast. The back mast top slide 104 is movable along the first anchor connection 102 in the axial direction of the first anchor connection 102. The back mast top slide 104 is fixable in a plurality of positions relative to the first anchor connection 102.

In the example shown in FIG. 16, the crane comprises a main boom stop 109 which is adapted to prevent undesired pivoting of the main boom, in particular in the direction towards the back mast.

In the example shown in FIG. 16, auxiliary cranes 115 are provided on the top of the back mast 103 or on the top of the first anchor connection 102, and on the top of the main boom 105.

The crane which is used in the third aspect of the invention can be a crane that is assembled in accordance with the first aspect of the invention and/or the second aspect of the invention, but this is not necessary.

In the example of FIG. 16, the crane is arranged on surface 112, adjacent to a building 114.

Figure 17:
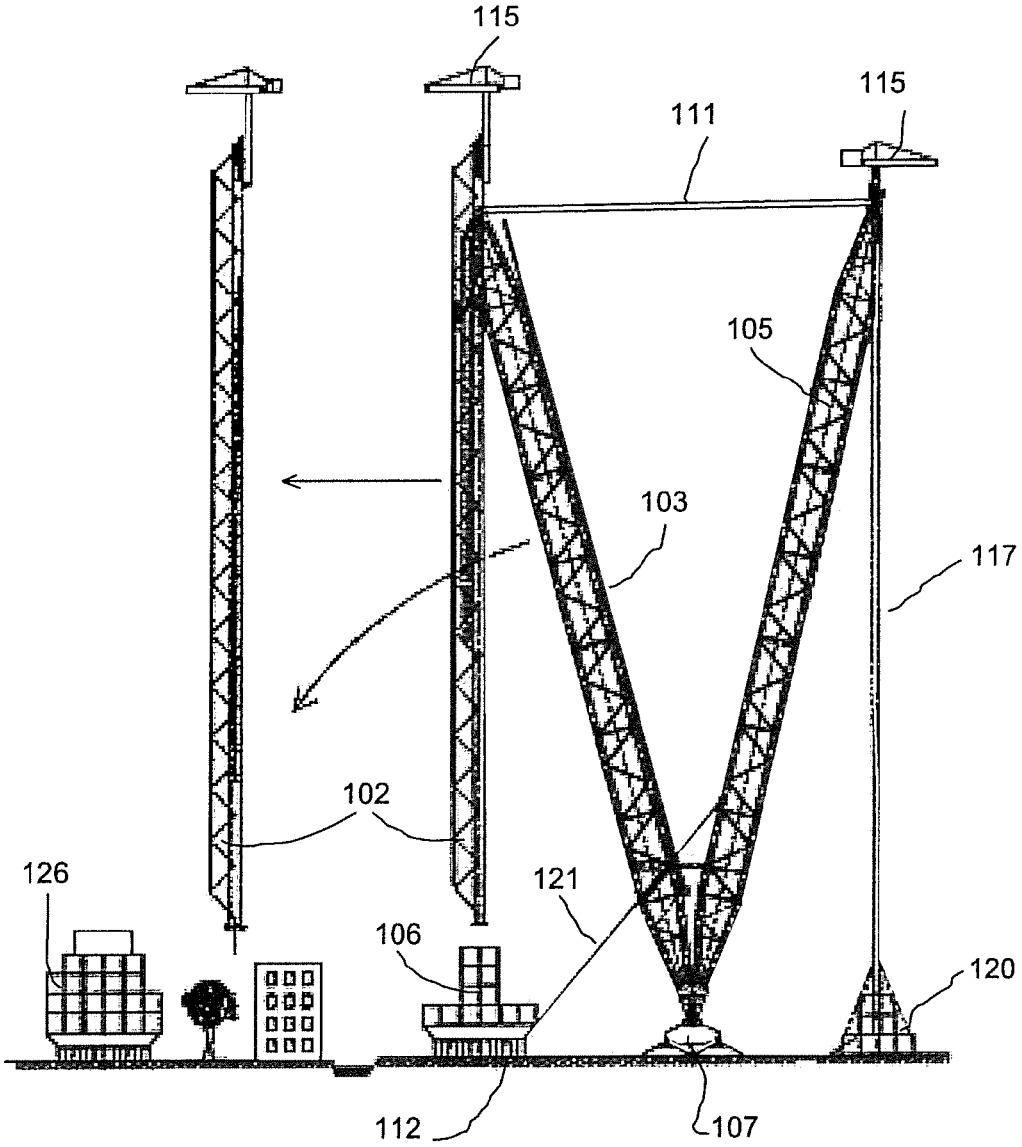
FIG. 17: schematically illustrates a first stage in an exemplary embodiment of a method according to the third aspect of the invention.

FIG. 17 schematically illustrates a first stage in an exemplary embodiment of a method according to the third aspect of the invention.

In this embodiment, the method according to the first aspect of the invention starts from the situation that is shown in FIG. 16.

In this first stage in the example shown in FIG. 17, the main boom 105 is fixed relative to the mast foot assembly 107 such that pivoting of the main boom 105 relative to the mast foot assembly 107 towards and away from the back mast 103 is prevented. To achieve this, the hoisting line 117 is connected to a main boom anchor 120. The main boom anchor 120 can for example be a ballast, for example made from stacked heavy objects such as metal weights or containers, for example sea containers filled with sand. Alternatively, the main boom anchor 120 can be a heavy object, for example a heavy object that is positioned on the ground, or an anchor e.g. in the form of a hook or ring that is fixed to the world, e.g. to a rock. In this example, the fixing of the main boom is carried out by fixing the length of the hoisting line 117 between the main boom anchor 120 and the top of the main boom 105, and by providing a guy-line 121 that connects between the side of the back mast away from the main boom and the ballast 106.

As a subsequent step the back mast upper section 130 is disconnected from the primary anchor 106.

There are several ways in which this can be carried out. For example, the first anchor connection can be disconnected from the primary anchor, or the back mast top slide can be disconnected from the first anchor connection, or the back mast upper section can be disconnected from the back mast top slide.

In the embodiment shown in FIG. 17, the first anchor connection 102 is a first ballast mast, and the disconnecting of the back mast upper section 130 from the primary anchor 106 is carried out by disconnecting the first ballast mast from the primary anchor 106.

As a subsequent step, the back mast upper section 130 is moved, e.g. rotated, towards the secondary anchor 126. It is not necessary that the back mast upper section 130 is brought all the way to the secondary anchor 126. In the embodiment shown in FIG. 17, at the end of the movement the back mast upper section 130 is at a distance from the secondary anchor 126. For example, at the end of the movement, the back mast upper section 130 is located at a distance above the secondary anchor 126, optionally at a distance straight above the secondary anchor 126.

In the embodiment of FIG. 17, the distance from the primary anchor 106 to the mast foot assembly 107 is shorter than the distance from the secondary anchor 126 to the mast foot assembly 107, at least in this step of the exemplary embodiment. In this particular embodiment, the secondary anchor 126 is located on the other side of the building 114 compared to the primary anchor 106.

Figure 18:
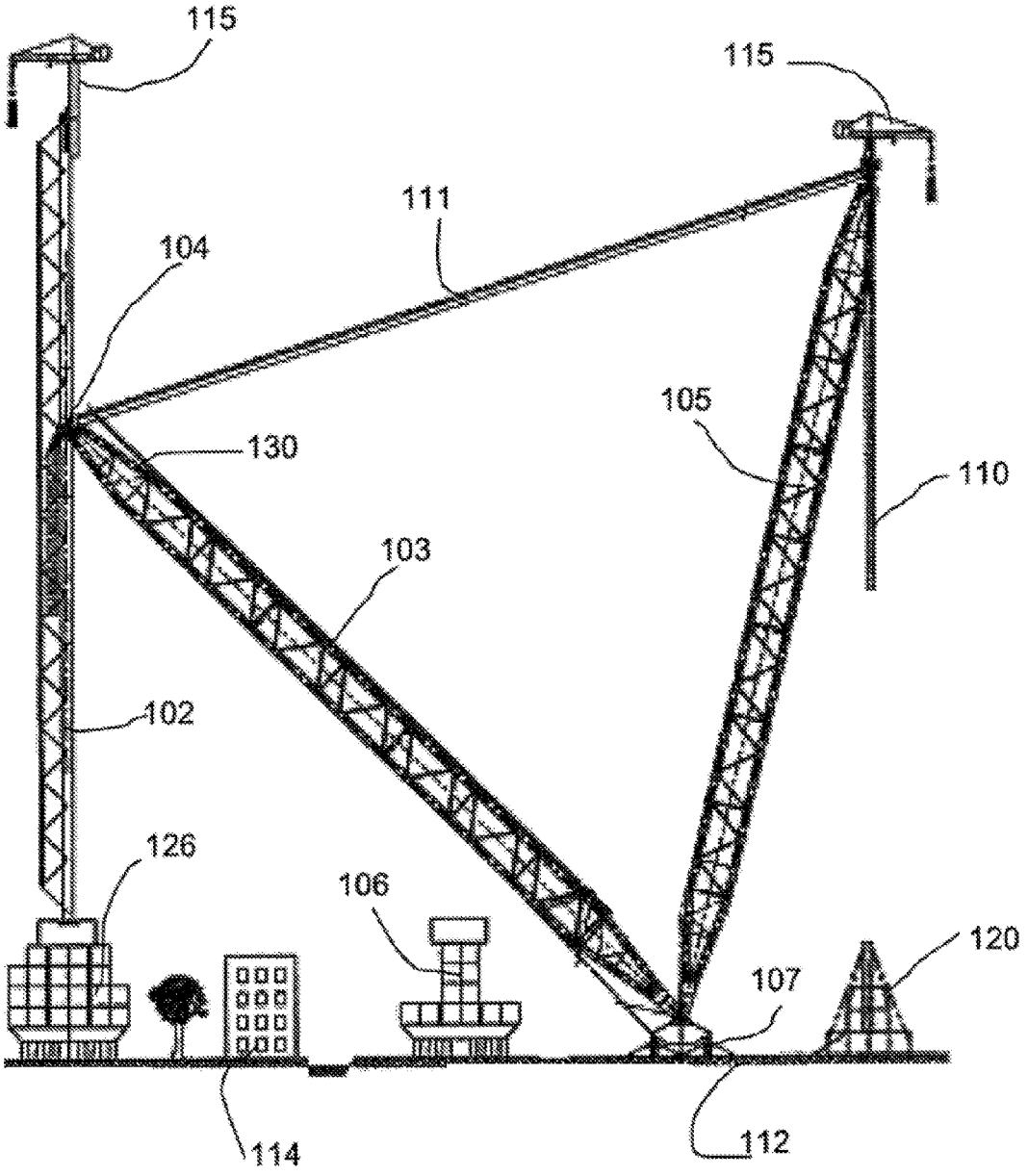
FIG. 18: schematically illustrates a subsequent stage in the exemplary embodiment as shown in FIG. 17, FIG. 19: schematically illustrates an alternative embodiment of the method according to the third aspect of the invention.

As a subsequent step, which is shown in FIG. 18, the back mast upper section 130 is connected to the secondary anchor 126. This can be carried out in several ways, depending on how the back mast upper section 130 was disconnected from the primary anchor 106.

In the embodiment shown in FIG. 18, the back mast upper section 130 is connected to the secondary anchor 126 by connecting the first ballast mast 102 to the secondary anchor 126.

Optionally, in this embodiment, after the first ballast mast has been disconnected from the primary anchor but before the first ballast mast is connected to the secondary anchor, the first ballast mast is moved upwardly relative to the back mast top slide 104 and away from the primary anchor and then the first ballast mast is moved downwardly relative to the back mast top slide 104 and towards the secondary anchor. This may help to lift the first ballast mast over any obstacles that are present in the path, e.g. building 114, of the first ballast mast 102 between the primary anchor 106 and the secondary anchor 126.

As can be seen in FIG. 18, the distance from the primary anchor 106 to the back mast top slide 104 when the first ballast mast 102 is connected to the primary anchor 106 is longer than the distance from the primary anchor 126 to the back mast top slide 104 when the first ballast mast 102 is connected to the secondary anchor 126.

Optionally, as shown in FIG. 17, the first ballast mast 102 is moved to the secondary anchor 126 while maintaining the first ballast mast 102 in a substantial vertical position.

As next steps, shown in FIG. 18, the hoisting line 117 is disconnected from the main boom anchor 120 and guy-line 121 is removed, so that the fixing of the main boom 105 relative to the mast foot assembly 107 is released, thereby allowing pivoting of the main boom 105 relative to the mast foot assembly 107 again.

The crane is now ready for hoisting a load.

In a variant of this embodiment, not shown in the drawing, the first anchor connection 102 is a primary anchor cable, a primary anchor chain or a set of primary anchor chains and/or primary anchor cables, or a combination of one or more primary anchor cables or one or more primary anchor chains with a fall back tube. In this variant, optionally an additional boom stop and/or additional cables are provided to prevent undesired motions of the back mast.

In this variant, the primary anchor cable, a primary anchor chain or a set of primary anchor chains and/or primary anchor cables, or a combination of one or more primary anchor cables or one or more primary anchor chains with a fall back tube is disconnected from the primary anchor 106, and then optionally hoisted up towards the back mast upper section 130. Then, the back mast upper section 130 is moved towards the secondary anchor 126. Then, a primary anchor chain or a set of primary anchor chains and/or primary anchor cables or a combination of one or more primary anchor cables or one or more primary anchor chains with a tube is optionally, if necessary, lowered again towards the secondary anchor 126 so that it can be connected to the secondary anchor 126.

Figure 19:
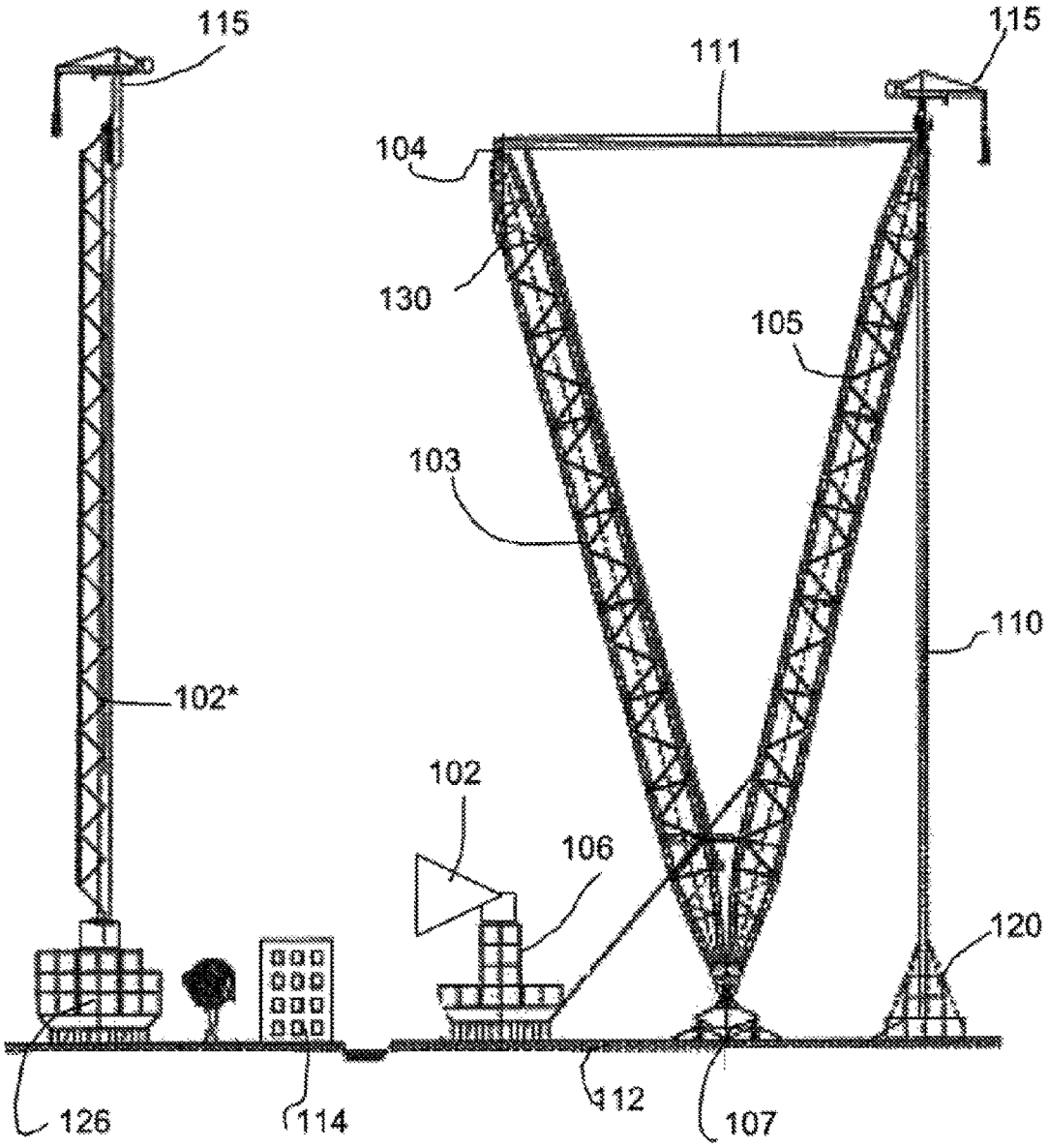

FIG. 19 shows an alternative embodiment of the method according to the third aspect of the invention.

In this embodiment, disconnecting the back mast upper section 130 from the primary anchor 106 is carried out by disconnecting the first anchor connection 102 from the back mast upper section 130. In the embodiment shown in FIG. 19, the first anchor connection 102 is a first ballast mast with a back mast top slide 104, but alternatively it can be a primary anchor cable, a primary anchor chain or a set of primary anchor cables and/or anchor chains.

The back mast upper section 130 is then moved, e.g. rotated, towards the secondary anchor 126.

Then, in this embodiment, the back mast upper section 130 is connected to the secondary anchor 126 by connecting the back mast upper section 130 to a second anchor connection 102*. This second anchor connection 102* is connected to the secondary anchor 126. In the embodiment shown in FIG. 19, the second anchor connection 102* is a second ballast mast but alternatively, it can be for example a second anchor cable, a second anchor chain or a second set of anchor cables and/or anchor chains.

As shown in FIG. 19, optionally, the first anchor connection 102 is moved away from a line that extends between the mast foot assembly 107 and the secondary anchor 126 after disconnecting the back mast upper section 130 from the primary anchor 106 but before moving the back mast upper section 130 towards the secondary anchor 126.

In the embodiment shown in FIG. 19, the first anchor connection 102 is moved downwards by pivoting around a horizontal pivot axis after disconnecting the back mast upper section 130 from the primary anchor 106 but before moving the back mast upper section 130 towards the secondary anchor 126.

Figure 20:
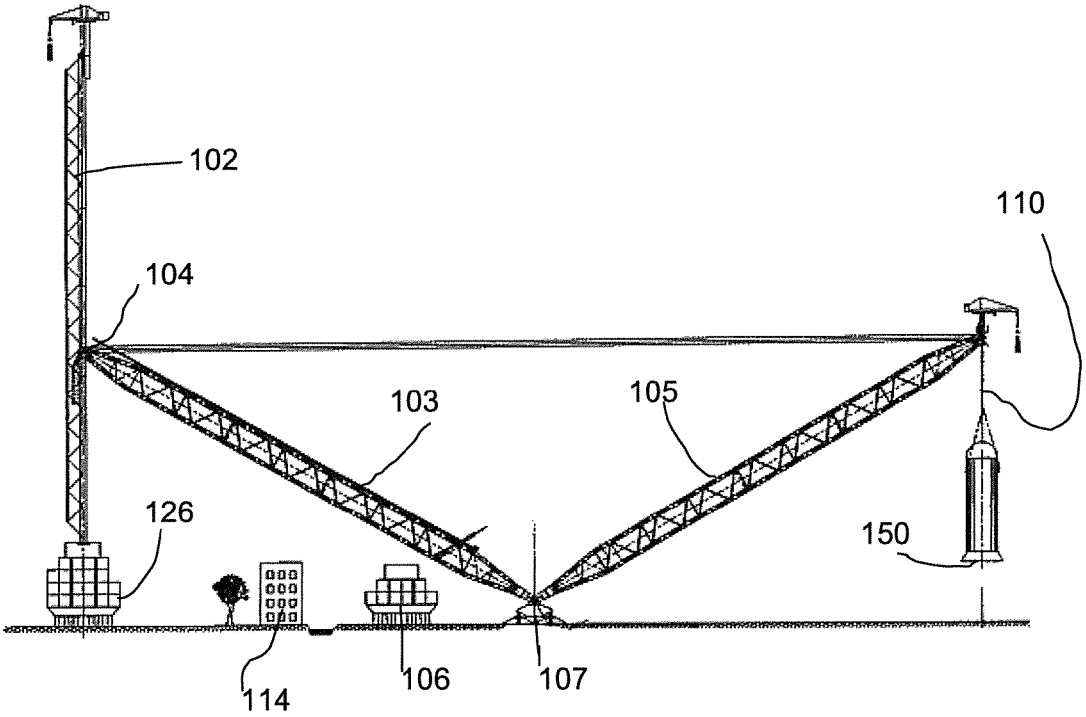
FIG. 20: schematically illustrates an example in which a load is lifted with the first anchor connection being connected to the secondary anchor.

FIG. 20 shows an example in which a load 150 is lifted with the first anchor connection 102 being connected to the secondary anchor 126.

In order to be able to lift the load 150, the main boom 105 and the hoisting cable of the main hoisting system 110 are moved to the load 150. The hoisting cable is then connected to the load 150, and the load can be moved, e.g. lifted, to a first load position 160, which is for example relatively close to the mast foot assembly 107. This is shown in FIG. 21.

Figure 21:
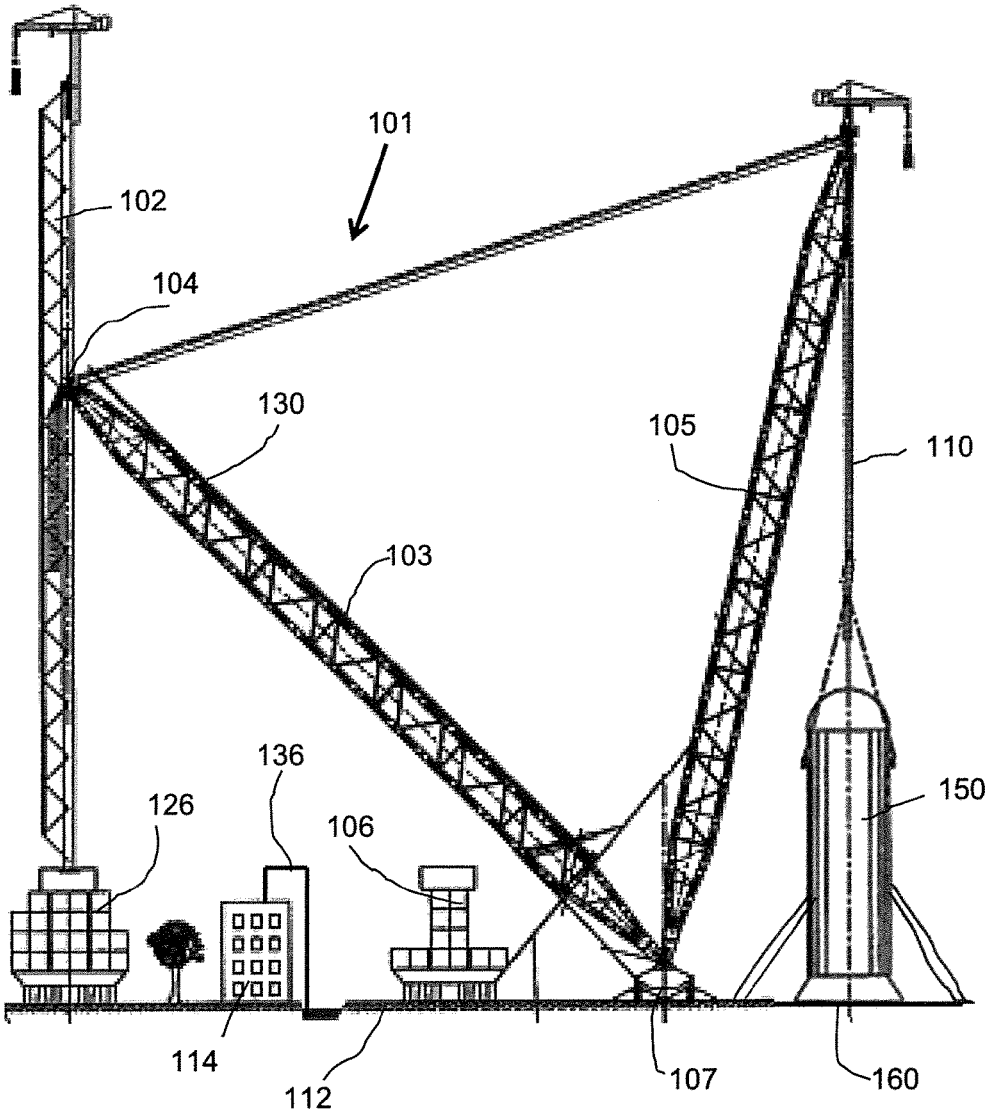
FIG. 21: schematically illustrates the example of FIG. 21, with the load arranged at the first load position.

Starting from the situation shown in FIG. 21, the first anchor connection can be switched again to the primary anchor 106, for example to allow rotating the crane 101 around a vertical axis in a small space, for example between buildings and arrange the load 150 at a second load location. The crane 101 could for example rotate around the mast foot assembly 107 or around the primary anchor 106.

If the load 150 is heavy enough and it can be anchored securely to the world, the load can serve as a main boom anchor 120. By using the load 150 as main boom anchor, the back mast upper section 130 can be connected again to another anchor, for example the primary anchor 106.

To this end, the following steps are then taken:

- fixing the main boom 105 relative to the mast foot assembly 107 such that pivoting of the main boom 105 relative to the mast foot assembly 107 towards and away from the back mast 103 is prevented,
- disconnecting the back mast upper section 130 from the secondary anchor 126,
- moving the back mast upper section 130 towards the primary anchor 106, and
- connecting the back mast upper section 130 to the primary anchor 106.

In a variant of this embodiment, it is possible that the back mast upper section 130 is connected to a further, e.g. a tertiary, anchor 136 to move the load to a third load position. To that end, optionally the following steps may be performed:

- fixing the main boom 105 relative to the mast foot assembly 107 such that pivoting of the main boom 105 relative to the mast foot assembly 107 towards and away from the back mast 103 is prevented,
- disconnecting the back mast upper section 130 from the primary anchor 106,
- moving the back mast upper section 130 towards a tertiary anchor 136,
- connecting the back mast upper section 130 to the tertiary anchor 136,
- releasing the fixing of the main boom 105 relative to the mast foot assembly 107, thereby allowing pivoting of the main boom 105 relative to the mast foot assembly 107 again,
- rotating the crane around the tertiary anchor 136 or around the mast foot assembly 107, and
- arranging the load at a third load position.

Figure 22:
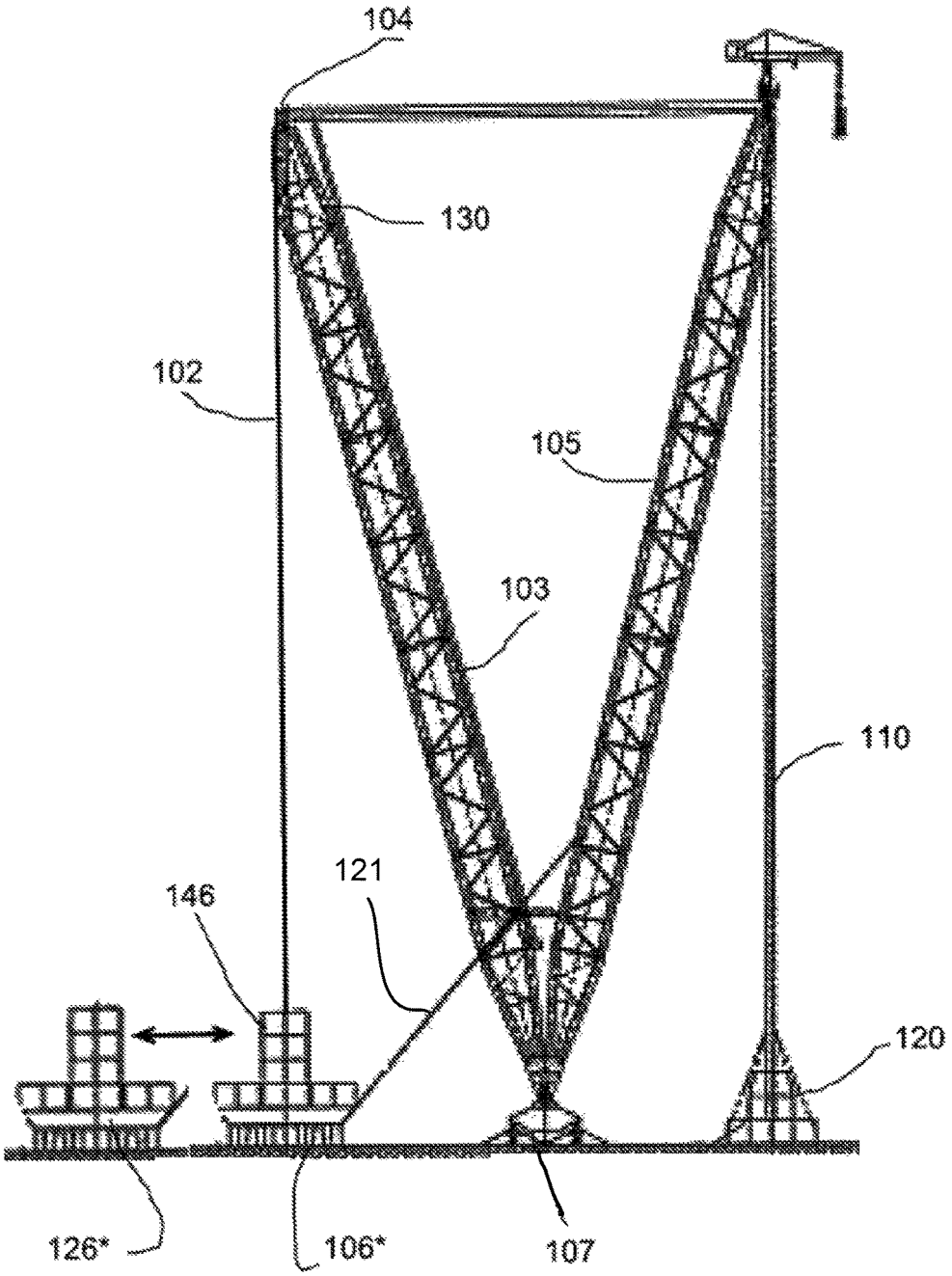
FIG. 22: schematically illustrates a further possible embodiment of the method according to the third aspect of the invention, FIG. 23A and FIG. 23B schematically illustrate a ballast mast according to the invention and a detail thereof on a larger scale, FIG. 24 schematically illustrates in side view the ballast mast of FIG. 23A and FIG. 23B, the associated back mast slider, the top end of the back mast, and the connection of the guy wires, FIG. 25 schematically illustrates in horizontal cross section the ballast mast of FIG. 23A and FIG. 23B and an embodiment of the associated back mast slider, FIG. 26 schematically illustrates in horizontal cross section the ballast mast of FIG. 23A and FIG. 23B and an alternative embodiment of the associated back mast slider.

FIG. 22 shows a further possible embodiment of the method according to the third aspect of the invention. In this embodiment, a moveable anchor 146 is provided, e.g. in the form of a moveable ballast. The moveable anchor 146 is moveable between a primary anchor position 106* and a secondary anchor position 126*. In this embodiment, the moveable anchor 146 is the primary anchor when it is in the primary anchor position 106* and the moveable anchor 146* is the secondary anchor when it is in the secondary anchor position 126*.

Optionally, the back mast top section remains connected to the moveable anchor during the movement of said anchor from the primary anchor position to the secondary anchor position or vice versa. This will require that the length of the first anchor connection 102 is changed during this movement of the moveable anchor 146.

An advantageous embodiment and advantageous details of a ballast mast are described with reference to FIG. 23-FIG. 24.

As described with reference to FIG. 3-FIG. 4 in a possible embodiment the ballast mast 2 comprises multiple vertically stackable further ballast mast sections 22.

Figure 23B:
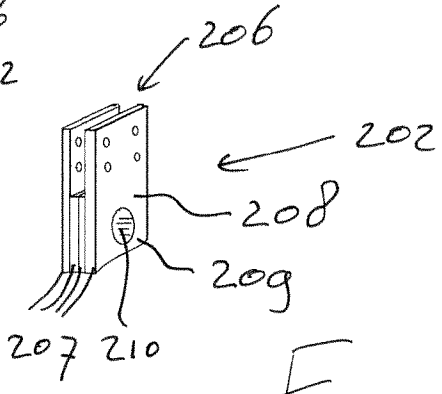
Figure 23A:
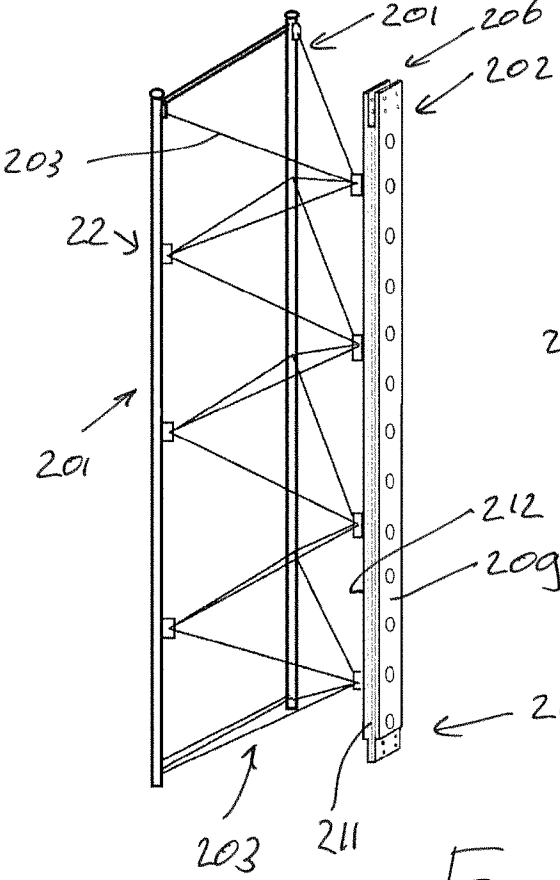
Figure 24:
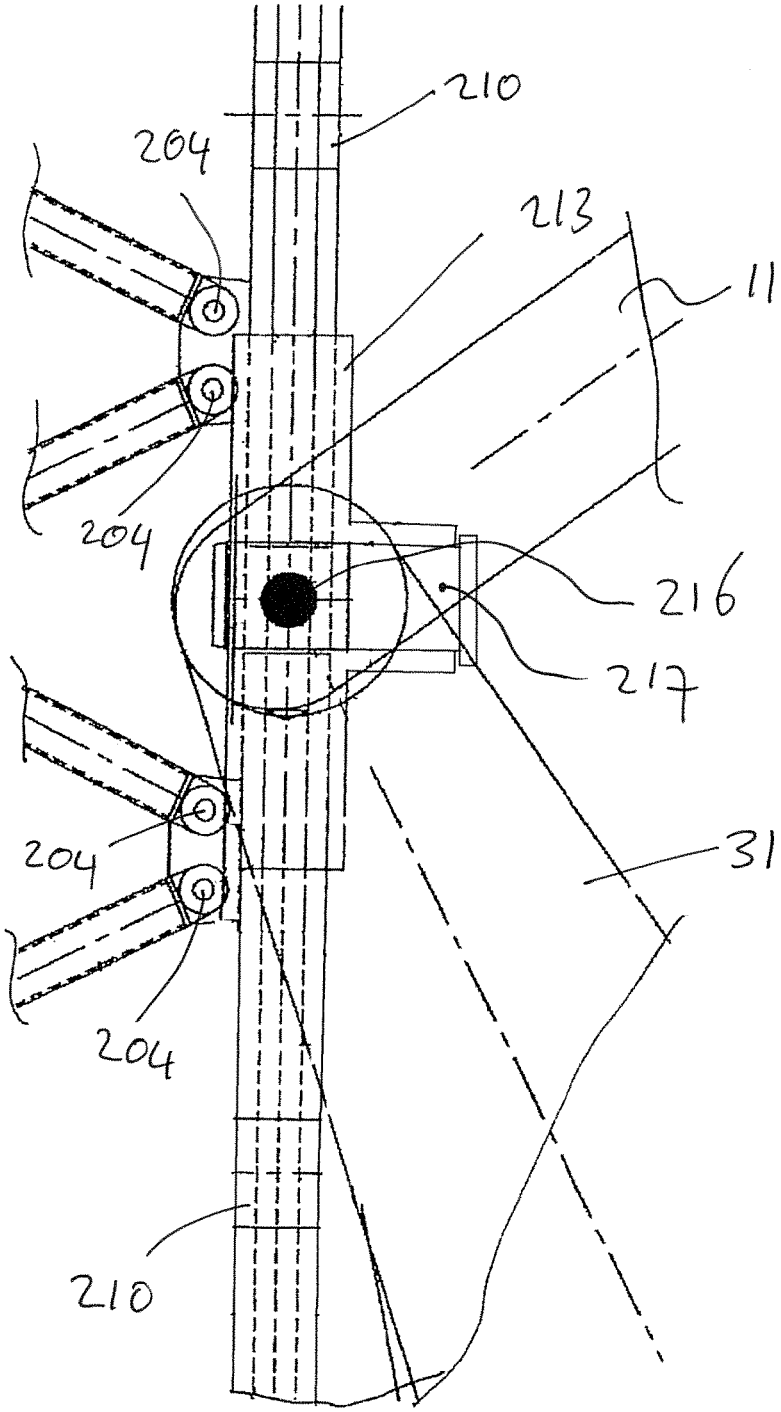

FIG. 23 shows a further ballast mast section 22 embodied as a triangular tower mast section. Each tower mast section comprises two main elongate elements each embodied as a corner tube section 201, a back mast top slider guide section 202 and multiple connector elongate elements embodied as connector tubes 203. The back mast top slide guide section 202 is provided parallel to and at a distance, preferably an equal distance, from both vertical corner tube sections 201, thereby spanning a volume having a triangular base, preferably an equilateral triangular base. The connector tubes 203 interconnect the two corner tube sections and the back mast top slide guide. By stacking further ballast mast sections a strong, yet light-weight, tower mast is provided.

The connector tubes 203 may be connected to and disconnected from the corner tube sections and back mast top slide guide section by means of connector elements 204. In FIG. 24 said connector elements are embodied as connector pins. The connector elements 204 allow for disassembly of the ballast mast section 22 into its two corner tube sections 201, back mast top slide guide section 202, connector tubes 203 and connector elements 204, e.g. for transport. Preferably the corner tube sections, back mast top slide guide section, connector tubes and connector elements fit in standard size road or sea containers.

The back mast top slide guide sections 202 are connected end-to-end to form the back mast top slide guide. The back mast top slide guide guides the back mast top slide 4 in its motion along the ballast mast 2. In this embodiment of FIG. 23 and FIG. 24 the load during hoisting is to a large extent, presumably even fully, carried by the back mast top slide guide. The other elements of the tower mast provide support and stability, e.g. when the ballast mast is out of the vertical and when the back mast is going to lean against or onto the ballast mast.

The back mast top slide guide will, especially during hoisting, be exposed to large tensile forces. To pass the tensile force between back mast top slide guide sections 202 a ridge 205 is provided to the lower end of each back mast top slide guide section and a groove 206 is provided to the upper end of each back mast top slide guide section. The ridge 205 of an upper back mast top slide guide section is inserted into a groove 206 of a back mast top slide section provided below said upper back mast top slide guide section. The upper back mast top slide guide sections are subsequently fastened to each other.

The back mast top slide guide section 202 may be embodied in various ways. For instance, the guide section may be rack of a rack-and-pinion actuator or may be the leg chord rack of the jacking system of U.S. Pat. No. 6,231,269.

An advantageous embodiment of the back mast top slide guide section and back mast top slide 4 is described with reference to FIG. 23-FIG. 26.

The back mast top slide guide section 202 is embodied as steel strip bundle section comprising multiple, here four, parallel and adjoining steel strips 207. The back mast top slide guide comprises multiple steel strip bundle sections connected end-to-end as described in the foregoing description of the back mast top slide guide. Each steel strip 207 has a front side 208 that extends vertically and horizontally substantially parallel to the connector tubes that interconnect the two corner tube sections. The normal direction of the steel strip front side points away from said connector tubes that interconnect the two corner tube sections. Steel strips 207 adjoin with their front side to a back side of a neighboring steel strip so as to provide a steel strip bundle section with a front side 209 that corresponds to the front side 208 of the foremost steel strip 207. The side planes 211 of the strip bundle section extend vertically and horizontally substantially perpendicular to the connector elements that interconnect the two corner tube sections. The steel strip comprises multiple climbing holes 210 that each extend through the multiple steel strips from the front side to the back side of the strip bundle.

The back mast top slide 4 comprises a housing 213 that can be provided around said front side 209, side planes 211 and a portion of the back side 212 of a portion of a strip bundle section 202. The housing 213 thus has, seen from above, substantially a C-shape with the two ends of said C-shape provided adjacent the back side of the strip bundle. The front portion 213*a* of the housing is provided adjacent the front side of the strip bundle, the side portions 213*b* of the housing adjacent the sides of the strip bundle, and the back portions of the housing provided adjacent the back 213*c* of the strip bundle. Bearing shoes 214 are provided onto one or more interior sides of the housing 213 that face the strip bundle. Said bearing shoes 214 are provided against said strip bundle so as to allow said housing 213 to move along the strip bundle. A clearance is provided between the side faces of the steel strip bundle and side faces of the housing, so as to allow the housing to assume a slightly tilted orientation with respect to the strip bundle. Moreover, a front pin hole 215 equal in size to a climbing hole 209 of the strip bundle extends through the front portion of the housing. The front pin hole 215 is provided such that at the positions of the strip bundle 202 where a climbing hole 209 is provided, the front pin hole 215 is aligned with said climbing hole 209.

The back mast top slide furthermore comprises two trunnions 216. Each trunnion is provided to a side portion 213*b* of the housing. The ballast mast side end 31 of the back mast and an end of the guy line 11 are attached to said trunnions 216 in such a way as to allow a rotation of said mast side end 31 and guy line end around said trunnions 216.

The back mast top slide furthermore comprises a fastening pin 217. The fastening pin 217 can be moved by a suitable actuator (not shown), e.g. a hydraulic cylinder provided in said locking pin, from a withdrawn position to a locking position and vice versa. In the withdrawn position, shown in FIG. 25, the fastening pin 217 is provided to the front of the front side 209 of the strip bundle, allowing the back mast top slide to move vertically along the strip bundle. In the locking position the fastening pin 217 is provided through the front pin hole 215 and through the climbing hole 209. In this way the back mast top slide 4, the ballast mast side end 31 and guy line 11 attached to it are locked in position with respect to the ballast mast 2.

The housing 213, trunnions 216 and fastening pin 217 together form a gimbal.

Furthermore, the back mast top slide 4 comprises a hydraulic climbing device (not shown), preferably a step-wise hydraulic climbing device, that provides the movement of the back mast top slide along the strip bundle. Such a hydraulic climbing device and step-wise hydraulic climbing device are known in the art. A possible embodiment of a step-wise hydraulic climbing device comprises an upper and a lower connector compartment each comprising a connection pin. Said connection pin can be inserted and removed from said climbing holes by a suitable actuator mechanism. Said step-wise hydraulic climbing device moreover comprises in between said lower and upper compartment one or more hydraulic cylinders, e.g. cylinders with a stroke of 1-3 meters. In operation the connection pin of the lower connector compartment is provided into a climbing hole for support. The hydraulic cylinder is then extended, such that the upper connector compartment can reach a higher climbing hole, into which the connection pin of the upper connector compartment is provided. The connection pin of the lower connector department is withdrawn, after which the cylinder of the hydraulic cylinder with attached lower connector department is pulled upwards. The above cycle is then repeated.

The back mast top slide guide and back mast top slide 4 as described above allows the lifting, e.g. step-wise lifting, of the one or more back mast subsections during the assembly of said back mast subsections as described in the foregoing FIG. 5-FIG. 7.

During hoisting of a load with the crane 1 said back mast top slide passes the load on the guy line 11 to the strip bundle. Said strip bundles than passes said load to the ballast 6.

Figure 26:
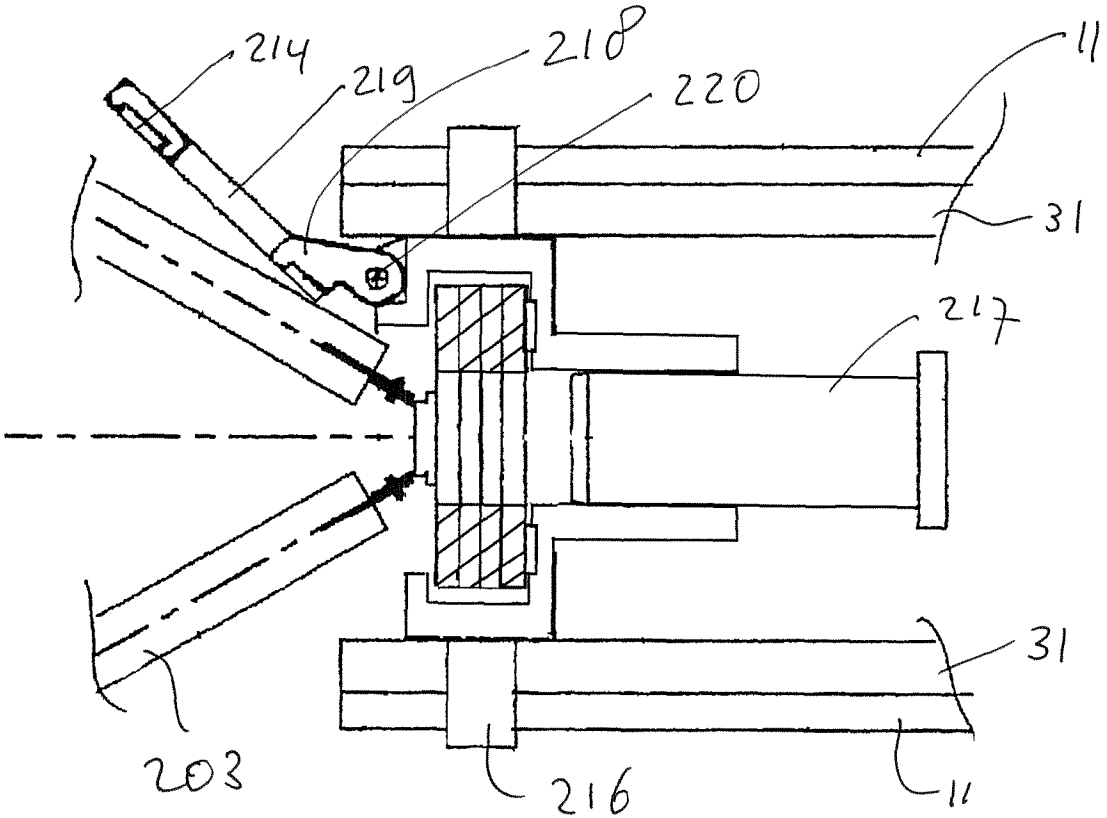
Figure 27A:
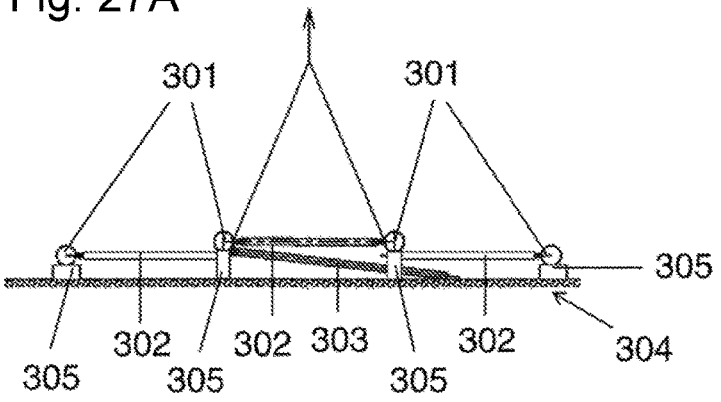
FIG. 27A-FIG. 27E illustrate schematically a method of assembly of a subsection of a mast, e.g. back mast, and/or boom, of a crane.
Figure 27B:
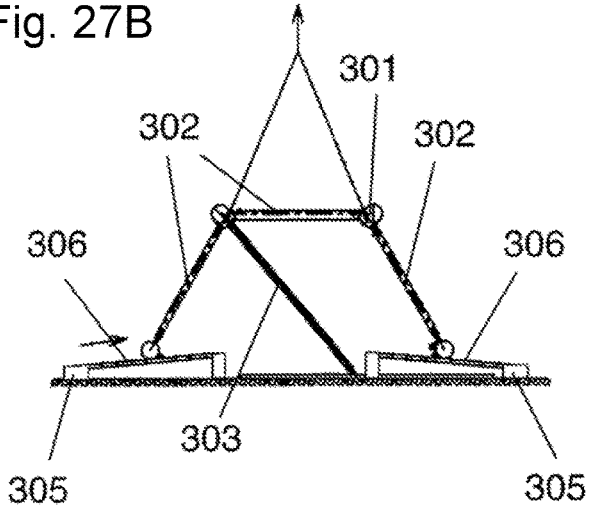
Figure 27C:
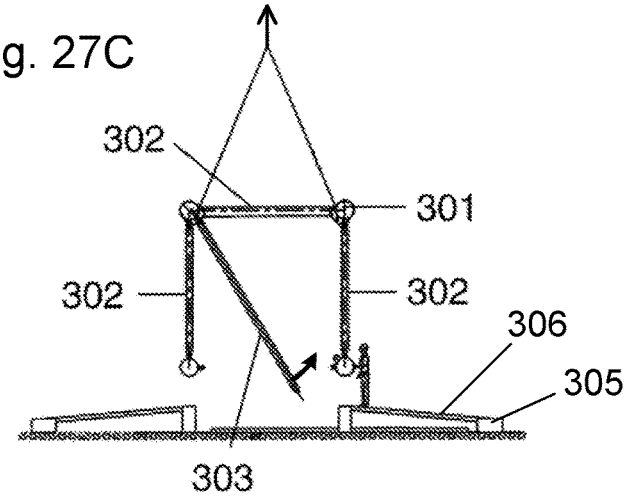
Figure 27D:
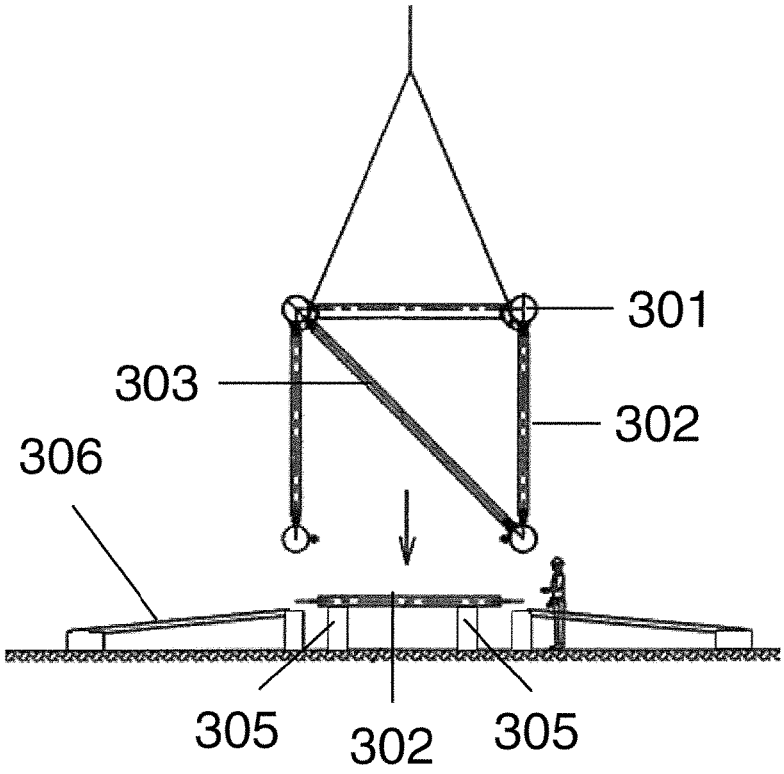
Figure 27E:
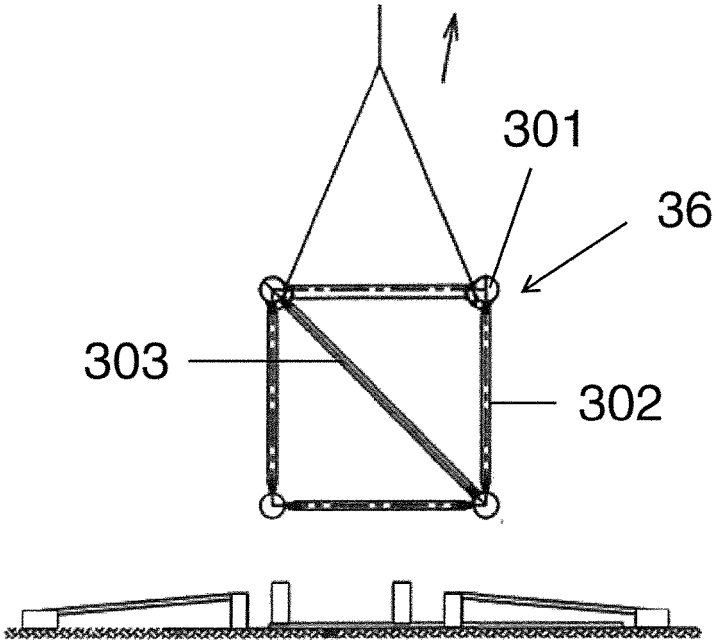

Optionally the back mast top slide further comprises a movable closure part 218. Said movable closure part is provided to and movable, e.g. pivotable or slidable, with respect to the housing 213 between an open position and a closed position. The movable closure part 218 comprises a back pin hole 219 that is equal in size to the front pin hole 215 and climbing hole 209. The movable closure part 218 may also comprise bearing shoes 214 at a side thereof that in the closed position faces the strip bundle. The bearing shoes 214 are in the closed position provided against said strip bundle. In the open position the movable closure part 218 allows the back mast top slide 4 to move past connector tubes 203 and connector elements 204 that are connected to the back mast top slide guide. In the closed position the closure part 218 extends adjacent the back side 212 of the strip bundle between the two ends of the C-shaped housing 213, so that the housing 213 and movable closure part 218 together encircle the strip bundle. In the closed position the back pin hole 219 is provided such that at the positions of the back mast top slide guide where a climbing hole 209 is provided, the back pin hole 219 is aligned with said climbing hole 209. When the fastening pin 217 is moved to the lock position it is supported by the housing 213 around the front pin hole 215, by the strip bundle around climbing hole 209 and the movable closure part around back pin hole 219, so as to provide a locking that can withstand a high load. In the embodiment of FIG. 26 the movable closure part 218 is embodied as a movable closure part pivotable with respect to housing around a vertical axis 220 so as to provide a door-like movable closure part.

Figure 25:
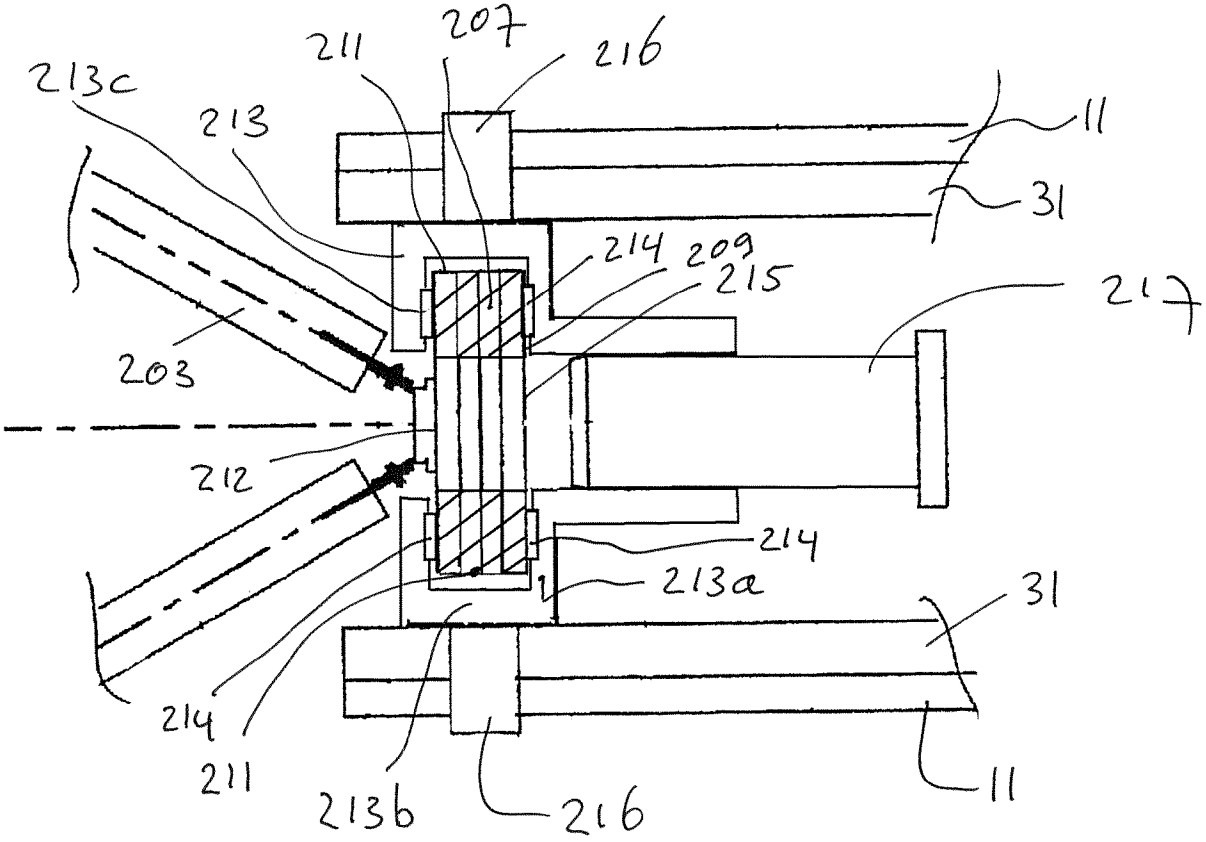

Alternative to or in combination with said movable closure part the housing 213 may extend to the front of the strip bundle around said pin 217 as shown in FIG. 25 and FIG. 26. This embodiment also provides further support to the fastening pin when said fastening pin has been moved to the lock position.

An embodiment of the back mast 3 and a method of assembly of the back mast subsections 36 is described with reference to FIG. 27A-FIG. 27E. The embodiment and method of assembly apply to a main boom subsection 55 as well. Main boom subsections 55 and back mast subsections 36 are envisioned to contain the same type of components. However, the dimensions of said components or details of their construction may vary.

The back mast 3 comprises multiple back mast subsections 36. Each back mast subsection 36 is first assembled and then provided in place, e.g. provided on top of or below another back mast subsection 36 in a manner described in the foregoing.

The back mast subsection comprises four main elongate elements embodied as corner tube sections 301, four connector elongate elements embodied as side connector tubes 302, and one or more diagonal elongate elements embodied as connector tubes 303. The corner tube section may have a circular or polygonal, e.g. octagonal, cross-section. The side connector tubes have a length between 3 and 11 meters, e.g. 8 meters. Preferably the corner tube sections, back mast top slide guide section, connector tubes and diagonal connector tubes fit in standard size road containers or standard size sea containers. Thus, a crane comprising a back mast and/or main boom assembled as described here may be a containerized crane.

In an assembled state, the corner tube sections 301 are provided parallel to each other and at a distance from each other. The four side connector tubes 302 interconnect the parallel corner tube sections 301 at one end of said corner tube sections so as to provide a back mast subsection 36 with a square ground plane. Optionally connector tubes 302 may also be provided between the vertical corner tube sections 301 at the other end of said vertical tube sections 301. The diagonal connector tubes 303 interconnect two corner tube sections 301 across a diagonal. The connection points of said diagonal connector tubes 303 to the two corner tube sections 301 are preferably offset along the length of the corner tube sections 301. Multiple, e.g. two, three or four diagonal connector tubes 303 may be provided. When two diagonal connector tubes 303 are used, a first diagonal connector tube 303 may interconnect two corner tube sections 301, while the second diagonal connector tube 303 may interconnect the other two corner tube sections 301.

The back mast subsection 36 is assembled using a suitable assembly device 304. Said assembly device comprises four parallel and offset elongated supports 305 onto which the corner tube sections can be provided. The upper surface of the outer elongated supports 305 are preferably lower than the upper surface of the inner elongated supports 305. A sliding surface 306 is provided between each outer and adjacent inner support 305. Connector tubes 302 are provided between each of the adjacent corner tube sections. The connector tubes 302 provided between an outer and an inner elongated support 305 are pivotally connected to the corner tube sections provided on the inner elongated supports. Said pivotal connection is pivotable around an axis parallel to the main axis of the corner tube section. A diagonal connector tube 303 is provided to one of the corner tube sections 301 provided on the inner elongated supports 305. The system of corner tube sections 301 and connector tubes 302, 303 is then lifted. The corner tube sections 301 on the outer elongated supports 305 preferably slide along the sliding surface 306 to a position below the corner tube sections 301 that were previously provided on the inner elongated supports 305. The free end of the diagonal connector tube 303 is connected to a lower corner tube section 301. Another connector tube 302 is provided on two additional supports 305 and connected to the lower corner tube sections 301. The back mast subsection 36 is now assembled and may be included in the crane 1.

In this embodiment the back mast subsection 36 has a square ground plane. With a method similarly to that presented here back mast subsections with differently shaped polygonal ground planes, e.g. rectangular or triangular, may be provided.

An embodiment of the crane comprising a movable mast foot assembly 7 and skidding tracks 401, 402 is described under reference to FIG. 28A-FIG. 28D.

In an advantageous embodiment the crane is provided with a circular skidding track 402 around the ballast mast 2 and one or more linear skidding tracks 401 extending from the ballast mast 2. Moreover, the mast foot assembly 7 comprises two mast feet provided at a distance from each other. Each of the feet may comprise multiple mast feet parts, said mast feet parts preferably being distant from each other in a direction perpendicular to the direction in which the two mast feet are distant. This double-split mast feet structure may provide a most stable mast foot assembly 7. Said mast feet part may for instance comprise skid shoes or wheels. Said mast foot assembly 7, and therefore the back mast and main boom are provided onto circular skidding track 402 or linear skidding track 401. The linear skidding track 401 intersects the circular skidding track 402 and the mast foot assembly 7 is adapted to skid on both the linear skidding track 401 and the circular skidding track 402. The circular skidding track 402 provides to the crane 1 additional flexibility in use, as it can now for instance transfer loads 18 from one side of the ballast mast 2 to the other side thereof. By means of said one or more linear skidding tracks 401 the distance between ballast mast 2 and mast foot assembly 7 can be varied.

Figure 28A:
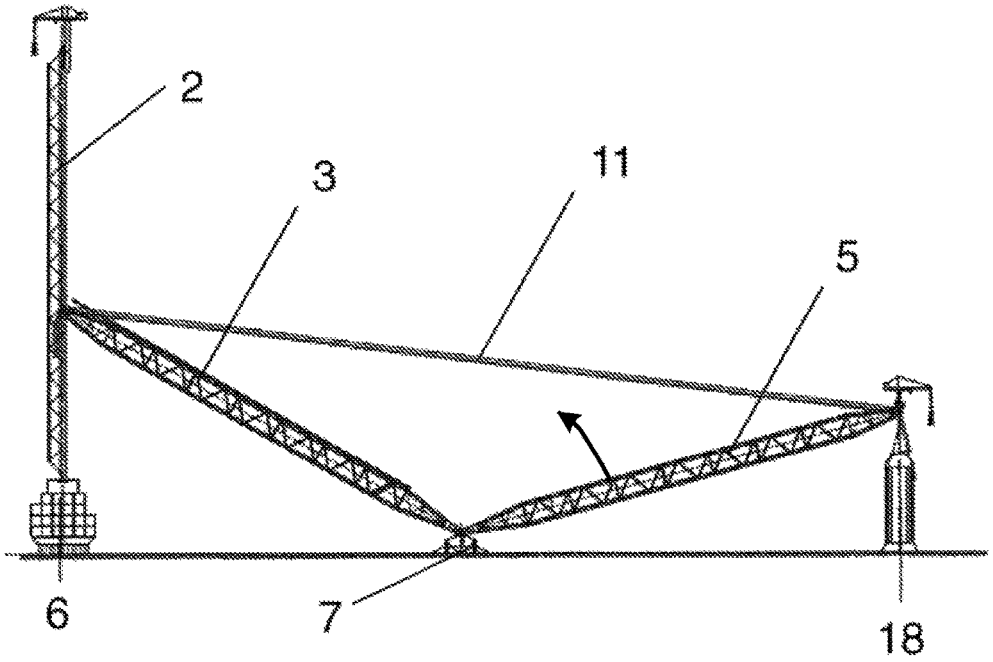
FIG. 28A-FIG. 28D illustrate schematically an operational method and preferred or optional details of a crane according to the invention.
Figure 28B:
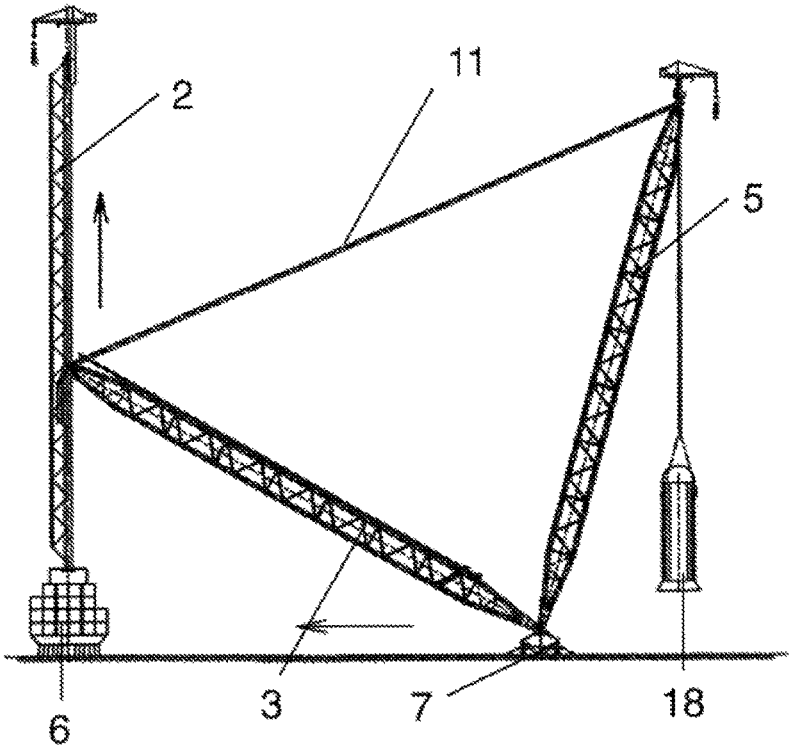
Figure 28C:
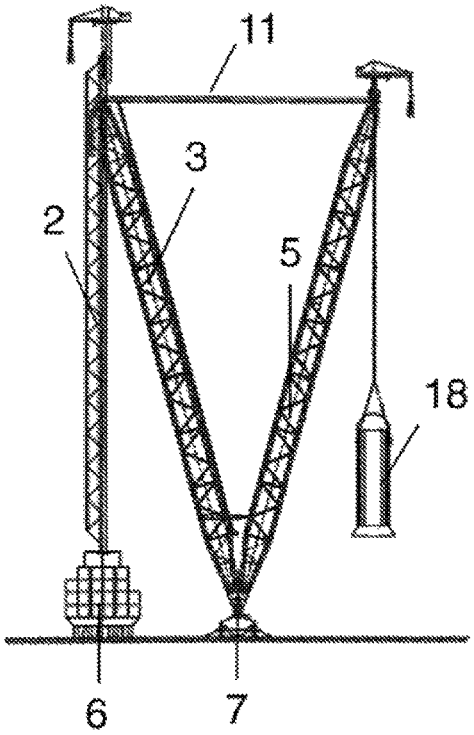
Figure 28D:
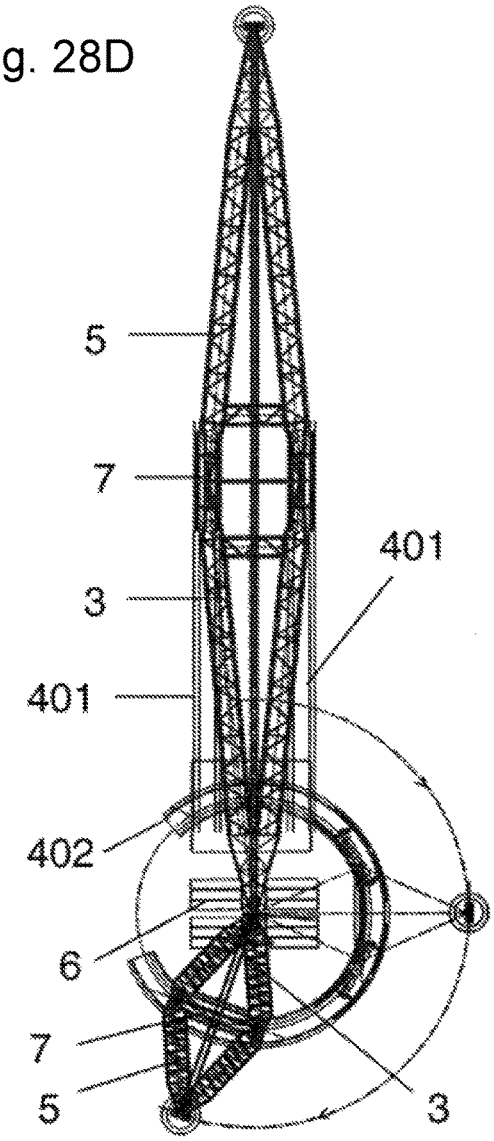

The combination of a linear skidding track 401 and circular skidding track 402 allows the mast foot assembly 7 first to be moved along the linear skidding track 401 to a position relatively far away from the ballast mast 2, allowing it to pick up a load 18 at a distant position, while keeping the ends of the back mast 3 and the main boom 5 at the same elevation. This is shown in FIG. 28A. The main boom 5 is subsequently hailed, thereby lifting the load 18, as shown in FIG. 28B. Next, shown in FIG. 28C, the mast foot assembly 7 is moved to a position closer to the ballast mast 2 where the linear skidding track 401 intersects the circular skidding track 402, thereby erecting the back mast 3. If desired, the load 18 can now be rotated with respect to the ballast mast 2 by further movement of the mast foot assembly 7, back mast 3 and main boom 5 around the ballast mast 2. The rotation is shown in FIG. 28D. The rotational motion is performed relatively close to the ballast mast 2, so that the free area required for said rotation is reduced.

Figure 29:
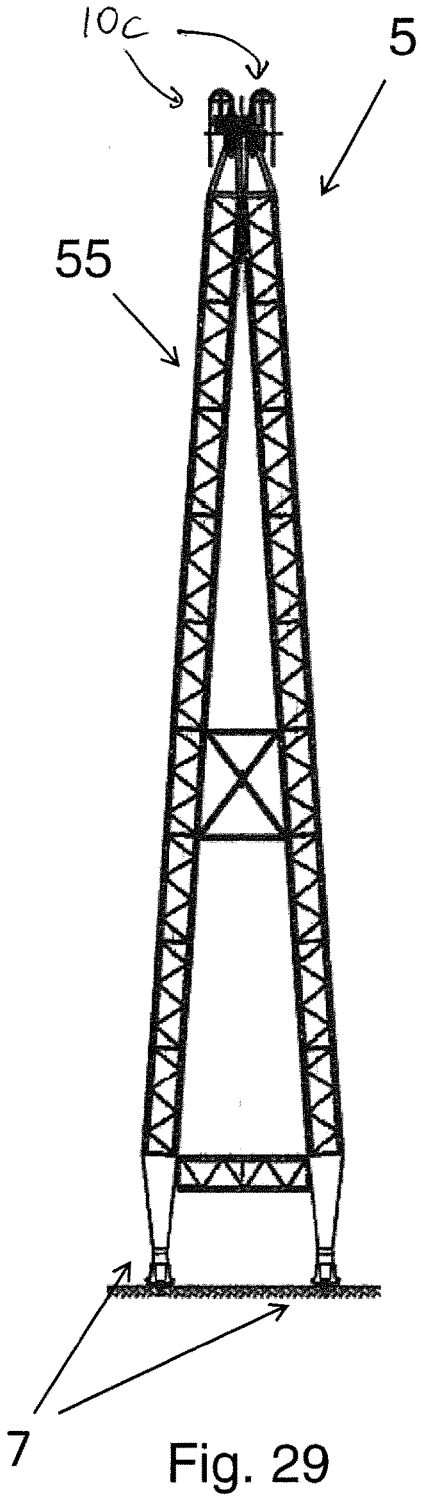
FIG. 29 illustrates schematically an A-shaped back mast or main boom of a crane according to the invention.
Figure 30:
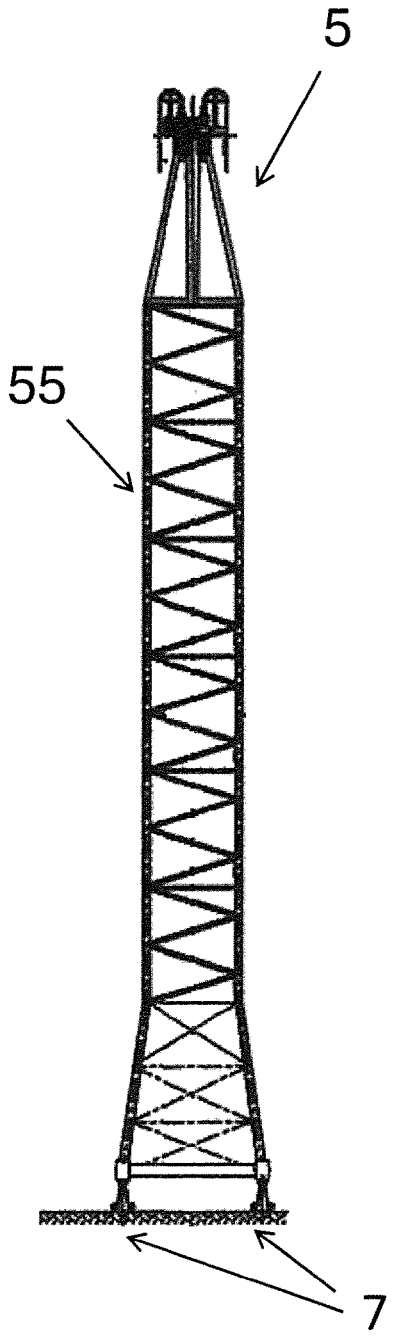
FIG. 30 illustrates schematically a single leg back mast or main boom of a crane according to the invention.

Side views of an A-shaped ballast mast 3 or main boom 5 and a side view of a single leg shaped ballast mast 3 or main boom 5 are provided in FIG. 29 and FIG. 30 respectively.

Figure 31:
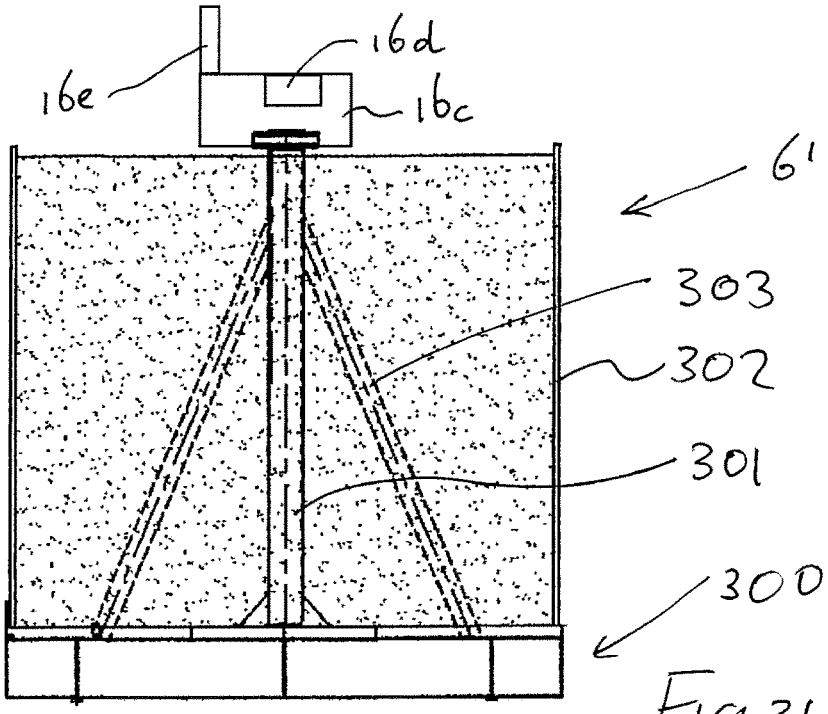
FIG. 31-FIG. 33 illustrate schematically an alternative embodiment of a ballast container in accordance with the invention for a crane, e.g. to be used in combination with a crane as described herein.
Figure 32:
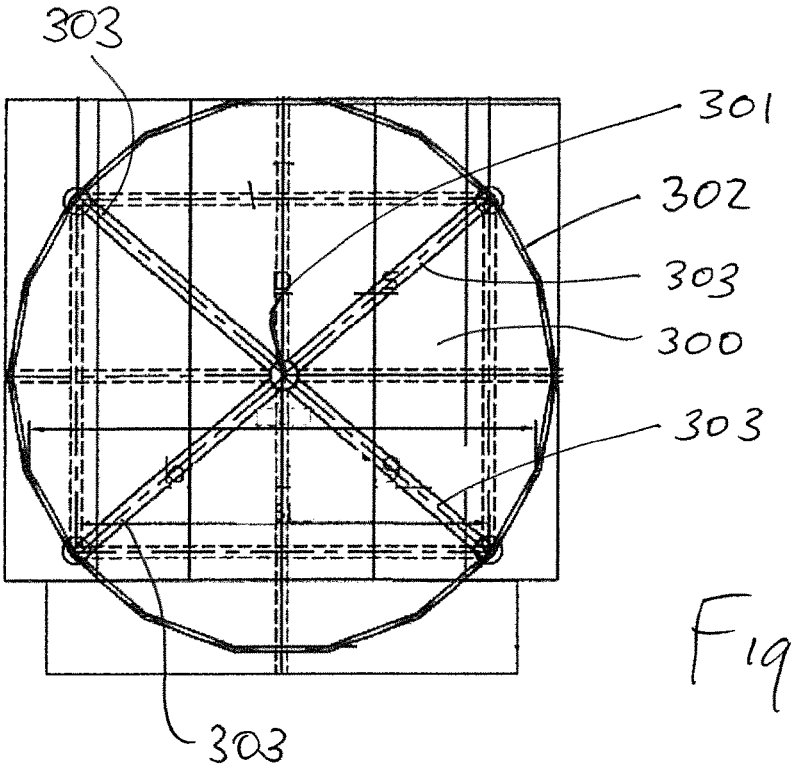
Figure 33:
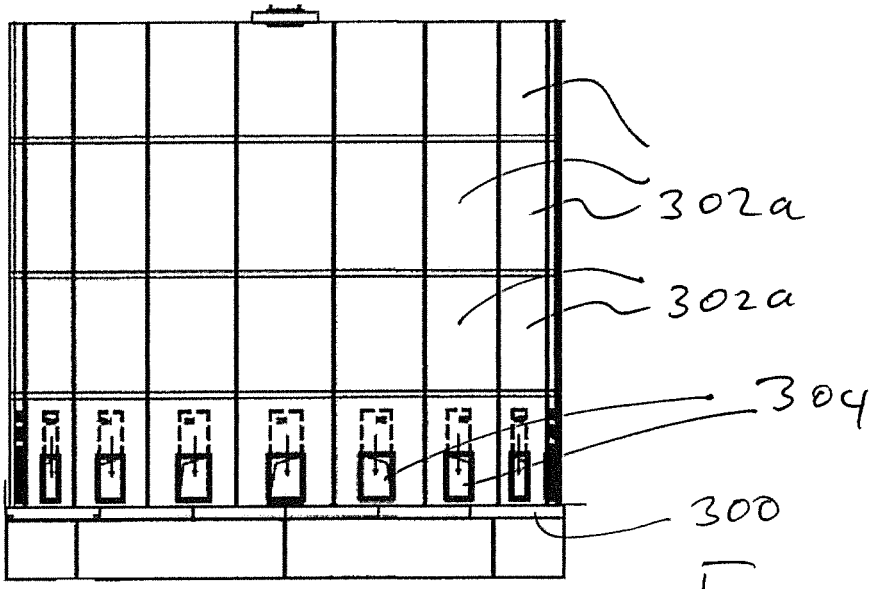

FIG. 31-FIG. 33 illustrate schematically an alternative embodiment of a ballast for a crane, e.g. to be used in combination with a crane as described herein. FIG. 31 is a vertical cross section, FIG. 32 a top view, and FIG. 33 a side view.

The ballast comprises a floor 300, a column 301 connected to and raised from said floor 300, and a circumferential wall 302 that forms together with said floor 300 a ballast container that is to be filled with ballast material, e.g. with sand, gravel, etc.

For reference the depicted ballast may have a wall 302 that is about 12 meters high with a diameter of about 14 meters.

The column 301 is arranged centrally with the ballast container and, as preferred, a ballast mast is connectable to the top end of the column 301, e.g. as described herein.

The column 301 is preferably stabilized by diagonal braces 303 that extend to the floor 300.

The floor 300 preferably is composed of a framework and floor panels placed over the framework.

As is preferred the ballast container has a volume that exceeds 1000 cubic meter, e.g. is able to retain more than 1500 tons of sand.

As is preferred the wall 302 is assembled from wall panels 302*a*, e.g. in a polygonal arrangement, wherein each wall panel fits within an ISO container, e.g. has a length of less than 12 meters and a width of at most 2.40 meters. The wall panels 302*a* can be interconnected in various manners, e.g. pairs being hinged to one another.

In an embodiment tension rods or cables extend diametrically across the wall 302 and/or to the central column.

In an embodiment doors 304 or the like are provided in multiple of the wall panels 302*a*, e.g. along the lower edge of the wall 302, e.g. so as to allow for discharge of ballast material when the crane is to be disassembled.

The invention claimed is:

1. A method for assembling a crane, which crane comprises a main boom, a back mast and a ballast mast, said back mast having in an assembled state a foot end and a ballast mast end, said main boom having in an assembled state a foot end and a load end, wherein both the main boom foot end and the back mast foot end are pivotably connected to a mast foot assembly, and wherein the ballast mast end of the back mast is pivotably connected to the ballast mast, which method comprises the following steps:

erecting the ballast mast with a back mast top slide that is movable along the ballast mast and which back mast top slide is fixable in a plurality of positions relative to the ballast mast, constructing the back mast using the ballast mast, which comprises the following steps:

providing a back mast upper section, which has a length that is shorter than the final length of the back mast, and which back mast upper section has a ballast mast side end and a back mast side end, providing multiple back mast intermediate sections, which each have a length that is shorter than the final length of the back mast, and each have a first end and a second end, providing a back mast lower section, which has a length that is shorter than the final length of the back mast, and which back mast lower section has a foot side end and a back mast side end, connecting a part of the back mast including at least the back mast upper section, and further including one or more pre-connected intermediate sections, to the back mast top slide, stepwise extending the part of the back mast that has been connected to the back mast top slide by attaching further back mast intermediate sections and the back mast lower section, and stepwise raising the back mast top slide along the ballast mast during the extending of the back mast.

2. The method according to claim 1, wherein during the extending of the back mast, the part of the back mast connected to the back mast top slide is also held by a surface based crane.

3. The method according to claim 1, wherein the extending of the part of the back mast connected to the back mast top slide by a further intermediate section involves making a pivotal connection of said further intermediate section to said part of the back mast and then raising the back mast top slide along the upright ballast mast so as to align the further intermediate section with said part of the back mast and then fixing said intermediate section to said part of the back mast.

4. The method according to claim 1, wherein the back mast lower section is pivotally connected to the part of the back mast connected to the back mast top slide and also to the mast foot assembly, of the crane, where after the back mast top slide is raised along the ballast mast, so that the back mast lower section is aligned with said part of the back mast, where after the back mast lower section is fixed to said part of the back mast.

5. The method according to claim 1, wherein the back mast top slide is moved a step upwards along the upright ballast mast after pivotably connecting the back mast upper section to the back mast top slide, but before further extending the back mast by connecting a further back mast intermediate section to the back mast side end of the back mast upper section.

6. The method according to claim 1, wherein during the stepwise raising of the back mast top slide, said slide is periodically fixed relative to the ballast mast in positions thereof along the ballast mast.

7. The method according to claim 6, wherein the back mast top slide comprises a fastening pin and the ballast mast comprises holes at differing heights to receive the fastening pin therein.

8. The method according to claim 1, wherein erecting said ballast mast comprises the following steps:

arranging a ballast mast support on a surface on which the crane is assembled, placing ballast on said arranged ballast mast support, providing a first ballast mast section, which first ballast mast section has a length which is shorter than the final length of the ballast mast to be constructed, arranging the first ballast mast section on top of the ballast mast support in an upright position, providing a second ballast mast section, which second ballast mast section has a section length which is shorter than the length of the ballast mast to be constructed, fixing the second ballast mast section on top of the first ballast mast section in an upright direction, providing one or more further ballast mast sections, and stepwise extending the ballast mast until a desired length of the ballast mast has been obtained.

9. The method according to claim 8, wherein use is made of an auxiliary climbing crane to lift a ballast mast section onto the top of the ballast mast, said climbing crane stepwise climbing upwards as the ballast mast is extended.

10. The method according to claim 1, wherein the method comprises the assembling of the main boom which comprises the following steps:

providing a main boom lower section, which has a length that is shorter than the final length of the main boom, and which main boom lower section has a foot side end and a main boom side end, providing multiple main boom intermediate sections, which each have a length that is shorter than the final length of the main boom, and which main boom intermediate sections each have a first end and a second end, providing a main boom top section, which has a length that is shorter than the final length of the main boom, and stepwise completing the main boom by interconnection of said lower, intermediate, and top sections of the main boom.

11. The method according to claim 10, wherein assembling of the main boom comprises the use of a mast section guide that is held by and extends along the completed back mast, said mast section guide having an upper end and a lower end, wherein main boom sections are successively made to engage with said mast section guide at one of said upper end and lower end thereof, and are displaced there along towards the other end so as to stack said main boom sections end to end, said main boom sections being fixed to each other so as to complete the main boom.

12. The method according to claim 11, wherein the lower main boom section is connected pivotably to a mast foot assembly of the crane, and wherein further main boom sections are engaged with the mast section guide via the upper end of the mast section guide, said further main boom sections being connected to the lower main boom section.

13. The method according to claim 12, wherein said further main boom sections are engaged with the mast section guide via the upper end of the mast section guide using an auxiliary crane mounted on the ballast mast.

14. The method according to claim 11, wherein the main boom section is engaged with the mast section guide via the lower end of the mast section guide.

15. The method according to claim 11, wherein the completely assembled main boom is released from the mast section guide or the mast section guide is released from the back mast whilst remaining connected to the main boom, and wherein the main boom is tilted away from the back mast into an operation main boom position.

16. The method according to claim 11, wherein the main boom section is engaged with the mast section guide via the lower end of the mast section guide using a surface based auxiliary crane.

17. The method according to claim 11, wherein the main boom section is engaged with the mast section guide via the lower end of the mast section guide, the lower end of the mast section guide comprising an actuator device adapted to push main boom sections upward along the mast section guide.

18. The method according to claim 1, wherein the back mast and the main boom are of the same shape and of the same length.

19. The method according to claim 1, wherein the ballast mast comprises triangular cross-section mast sections, each having an elongated element at a corner of said triangular cross-section, wherein the back mast top slide moves along a top slider guide section that forms or is secured to one or said elongated elements.

20. The method according to claim 19, wherein said top slider guide section is adapted to act as a tensile force connection between said back mast top slide and a ballast.

21. The method according to claim 19, wherein said top slider guide section is adapted to act as a tensile force connection between the back mast top slide and a ballast, the top slider guide section forming the primary or sole tensile connector between the back mast top slide and the ballast.

22. The method according to claim 1, wherein use is made of a climbing device between the ballast mast and the back mast top slide in order to displace the back mast top slide along the ballast mast, and wherein, said climbing device is operated to lift the ballast mast.

23. The method according to claim 1, wherein use is made of a climbing device between the ballast mast and the back mast top slide in order to displace the back mast top slide along the ballast mast, and wherein, said climbing device is operated to lift the ballast mast when the ballast mast is detached from the ballast mast support in a process of relocating the ballast mast.

24. A method for assembling a crane, which crane comprises a main boom and a back mast, wherein the main boom and the back mast are each pivotably connected to a mast foot assembly of the crane, which method comprises the following steps:

arranging the back mast at an incline relative to a surface on which the crane is assembled, said back mast being provided with a mast section guide that extends along and is held by the back mast, said mast section guide having an upper end and a lower end, providing a main boom lower section, which has a length that is shorter than the final length of the main boom, and which main boom lower section has a foot side end and a main boom side end, providing multiple main boom intermediate sections, which each have a length that is shorter than the final length of the main boom, and which main boom intermediate sections each have a first end and a second end, and providing a main boom top section, has a length that is shorter than the final length of the main boom, wherein main boom sections are successively made to engage with said mast section guide at one of said upper end and lower end of the mast section guide, and are displaced along said mast section guide so as to stack said main boom sections end to end, said main boom sections being fixed to each other so as to complete the main boom.

25. The method according to claim 24, wherein the lower main boom section is connected pivotally to the mast foot assembly of the crane, and wherein further main boom sections are engaged with the mast section guide via the upper end of said mast section guide, said further main boom sections being connected to the lower main boom section.

26. The method according to claim 24, wherein the main boom section is engaged with the mast section guide via the lower end of said mast section guide.

27. The method according to claim 26, wherein the main boom is extended beyond the top end of the back mast so as to assemble the main boom longer than said back mast.

28. The method according to claim 24, wherein the completed main boom is released from the mast section guide or the mast section guide is released from the back mast whilst remaining connected to the main boom, and wherein the main boom is tilted away from the back mast into an operational main boom position.

29. The method according to claim 24, wherein the lower main boom section is connected pivotably to the mast foot assembly of the crane, and wherein further main boom sections are engaged with the mast section guide via the upper end of said mast section guide by using an auxiliary crane mounted on a ballast mast that supports the back mast at a top end of the back mast, said further main boom sections being connected to the lower main boom section.

30. The method according to claim 24, wherein the lower main boom section is connected pivotably to the mast foot assembly of the crane, and wherein further main boom sections are engaged with the mast section guide via the upper end of said mast section guide by using a climbing crane in assembly of the back mast, the further main boom sections being connected to the lower main boom section.

31. The method according to claim 24, wherein the main boom section is engaged with the mast section guide via the lower end of said mast section guide by using a surface based auxiliary crane.

32. The method according to claim 24, wherein the main boom section is engaged with the mast section guide via the lower end of said mast section guide, an actuator device arranged near the lower end of said mast section guide, the actuator device adapted and operated to push main boom sections upward along the mast section guide.

* * * * *